US011852373B2

(12) United States Patent
Barlettano

(10) Patent No.: US 11,852,373 B2
(45) Date of Patent: Dec. 26, 2023

(54) EVAPORATIVE AIR COOLER HAVING AN ICE PACK

(71) Applicant: Ontel Products Corporation, Fairfield, NJ (US)

(72) Inventor: Scott Barlettano, Wayne, NJ (US)

(73) Assignee: Ontel Products Corporation, Fairfield, NJ (US)

( * ) Notice: Subject to any disclaimer, the term of this patent is extended or adjusted under 35 U.S.C. 154(b) by 0 days.

(21) Appl. No.: 17/833,325

(22) Filed: Jun. 6, 2022

(65) Prior Publication Data

US 2022/0299216 A1 Sep. 22, 2022

Related U.S. Application Data

(63) Continuation-in-part of application No. 17/157,098, filed on Jan. 25, 2021, which is a continuation-in-part
(Continued)

(51) Int. Cl.
*F24F 6/04* (2006.01)
*F24F 5/00* (2006.01)
(Continued)

(52) U.S. Cl.
CPC ..... *F24F 5/0035* (2013.01); *F24F 5/0017* (2013.01); *F24F 5/0021* (2013.01);
(Continued)

(58) Field of Classification Search
CPC ..... F24F 5/0017; F24F 5/0035; F24F 6/12; F24F 6/14; F24F 6/16; F24F 2006/006;
(Continued)

(56) References Cited

U.S. PATENT DOCUMENTS 2,166,401 A * 7/1939 Frank ..... F24F 5/0017 62/387
D185,748 S 7/1959 Goettl
(Continued)

FOREIGN PATENT DOCUMENTS

CA 2624807 A1 9/2009
CN 3589286 S 12/2006
(Continued)

OTHER PUBLICATIONS

United Kingdom Search and Examination Report for GB Application No. 2214610.4, dated Feb. 14, 2023, 8 pages.
(Continued)

*Primary Examiner* — Jerry-Daryl Fletcher
*Assistant Examiner* — Daniel C Comings
(74) *Attorney, Agent, or Firm* — Dickinson Wright PLLC

(57) ABSTRACT

An evaporative air cooler includes a housing including a top portion and a bottom portion coupled to the top portion. The evaporative air cooler further includes a water tank disposed in the top portion of the housing and configured to store water therein. The water tank includes an upper portion and a lower portion extending from the upper portion. The evaporative air cooler also includes a fan disposed within the housing. The evaporative air cooler further includes a holder removably attached to a back face of the housing. The evaporative air cooler also includes an ice pack at least partially received and supported by the holder. The ice pack is configured for cooling air entering the evaporative air cooler.

20 Claims, 42 Drawing Sheets

Related U.S. Application Data of application No. 16/911,797, filed on Jun. 25, 2020, which is a continuation-in-part of application No. 16/897,678, filed on Jun. 10, 2020, which is a continuation-in-part of application No. 16/239,161, filed on Jan. 3, 2019, now Pat. No. 10,712,029.

(51) Int. Cl.

| | |
|---|---|
| ***F24F 13/20*** | (2006.01) |
| ***F24F 6/16*** | (2006.01) |
| ***F24F 6/14*** | (2006.01) |
| *F24F 6/00* | (2006.01) |

(52) U.S. Cl.

CPC ..... *F24F 6/04* (2013.01); *F24F 6/14* (2013.01); *F24F 6/16* (2013.01); *F24F 13/20* (2013.01); *F24F 2006/006* (2013.01); *F24F 2006/008* (2013.01)

(58) Field of Classification Search

CPC ..... F24F 2006/008; F24F 2006/146; F24F 2006/16; F24F 5/0021; F24F 6/04

See application file for complete search history.

(56) References Cited

U.S. PATENT DOCUMENTS

| | | | | |
|---|---|---|---|---|
| D188,357 | S | 7/1960 | Klotz | |
| 3,176,117 | A | 3/1965 | Knoll | |
| 4,016,835 | A | 4/1977 | Yarden et al. | |
| RE31,675 | E | 9/1984 | Vesper | |
| D279,815 | S | 7/1985 | Yuen | |
| D282,101 | S | 1/1986 | Yuen | |
| D282,102 | S | 1/1986 | Yuen | |
| D291,350 | S | 8/1987 | Sherman | |
| 4,835,982 | A | 6/1989 | Ferdows | |
| 4,860,556 | A | 8/1989 | Hammett | |
| 4,968,457 | A * | 11/1990 | Welch | F24F 5/0035 261/DIG. 46 |
| D313,069 | S | 12/1990 | McCormick | |
| 4,977,755 | A | 12/1990 | Tulley | |
| 5,034,033 | A | 7/1991 | Alsup | |
| D319,498 | S | 8/1991 | Huang | |
| D323,874 | S | 2/1992 | Hirman et al. | |
| 5,162,088 | A | 11/1992 | Peng et al. | |
| 5,309,726 | A | 5/1994 | Asbridge | |
| D361,828 | S | 8/1995 | Chen | |
| D367,525 | S | 2/1996 | Gruebel | |
| D376,418 | S | 12/1996 | Wang | |
| D384,407 | S | 9/1997 | Yamada | |
| D402,745 | S | 12/1998 | Termeer et al. | |
| D402,746 | S | 12/1998 | Clark et al. | |
| 5,860,293 | A * | 1/1999 | Piro | F24F 5/0017 62/425 |
| 5,925,172 | A * | 7/1999 | Rick | F24F 8/10 55/467 |
| D414,253 | S | 9/1999 | Kobayashi | |
| 5,953,933 | A * | 9/1999 | Cheng | F24F 5/0017 62/457.2 |
| D416,993 | S | 11/1999 | Dong et al. | |
| 6,098,895 | A | 8/2000 | Walzel et al. | |
| D433,111 | S | 10/2000 | Wright | |
| 6,155,782 | A | 12/2000 | Hsu | |
| 6,192,702 | B1 * | 2/2001 | Shimogori | F24F 1/04 62/406 |
| 6,214,076 | B1 | 4/2001 | Beier | |
| D448,071 | S | 9/2001 | Birdsell et al. | |
| 6,293,121 | B1 | 9/2001 | Labrador | |
| D453,558 | S | 2/2002 | Segawa et al. | |
| 6,367,277 | B1 * | 4/2002 | Kinkel | F28D 5/00 62/310 |
| 6,422,030 | B1 | 7/2002 | Calvert | |
| D468,005 | S | 12/2002 | Bailey | |
| 6,581,402 | B2 | 6/2003 | Maisotsenko et al. | |
| 6,598,414 | B1 | 7/2003 | Cline | |
| 6,955,696 | B1 | 10/2005 | Ost | |
| D516,689 | S | 3/2006 | Salmon et al. | |
| D517,190 | S | 3/2006 | Wang | |
| D536,780 | S | 2/2007 | Lerche et al. | |
| D543,614 | S | 5/2007 | Chen | |
| D553,725 | S | 10/2007 | Shimzu | |
| 7,305,848 | B2 * | 12/2007 | Glover | F24F 7/007 62/425 |
| D559,973 | S | 1/2008 | Rabito | |
| D594,960 | S | 6/2009 | Orihara | |
| D606,645 | S | 12/2009 | Orihara | |
| 7,698,906 | B2 | 4/2010 | Jarvis | |
| D616,080 | S | 5/2010 | Ching | |
| D621,026 | S | 8/2010 | Peterson et al. | |
| 7,997,565 | B1 | 8/2011 | Chan | |
| D691,250 | S | 10/2013 | Chan | |
| D731,633 | S | 6/2015 | Farone et al. | |
| D733,273 | S | 6/2015 | Ueon | |
| D733,860 | S | 7/2015 | Konno | |
| D769,431 | S | 10/2016 | Lopez | |
| D788,279 | S | 5/2017 | Lee et al. | |
| D791,290 | S | 7/2017 | Shapiro | |
| D804,001 | S | 11/2017 | Cartwright | |
| 10,006,648 | B2 | 6/2018 | Vandermeulen et al. | |
| D827,115 | S | 8/2018 | Petersen | |
| D841,795 | S | 2/2019 | Chen | |
| D848,593 | S | 5/2019 | Exley | |
| D849,220 | S | 5/2019 | Fang | |
| D852,340 | S | 6/2019 | Barlettano | |
| D875,235 | S | 2/2020 | Coleman et al. | |
| D884,858 | S | 5/2020 | Zhang et al. | |
| 10,712,029 | B1 | 7/2020 | Barlettano | |
| D896,936 | S | 9/2020 | Ou | |
| 2004/0129014 | A1 | 7/2004 | Richman et al. | |
| 2008/0006953 | A1 | 1/2008 | Won | |
| 2009/0211291 | A1 | 8/2009 | Gildersleeve et al. | |
| 2013/0008195 | A1 | 1/2013 | Taljaard | |
| 2014/0174116 | A1 | 6/2014 | Habeebullah | |
| 2014/0260402 | A1 | 9/2014 | Varma | |
| 2015/0247644 | A1 | 9/2015 | Stearns | |
| 2015/0253046 | A1 | 9/2015 | Parker | |
| 2016/0327289 | A1 | 11/2016 | Mothfar | |
| 2017/0138650 | A1 | 5/2017 | Eiserer | |
| 2019/0056124 | A1 | 2/2019 | Shen | |
| 2019/0226696 | A1 | 7/2019 | Kim et al. | |
| 2019/0277519 | A1 * | 9/2019 | Petersen | B01F 23/215 |
| 2020/0217527 | A1 | 7/2020 | Barlettano | |
| 2020/0326081 | A1 | 10/2020 | Barlettano | |
| 2021/0148584 | A1 | 5/2021 | Barlettano | |

FOREIGN PATENT DOCUMENTS

| | | | |
|---|---|---|---|
| CN | 3643876 | S | 5/2007 |
| CN | 201103976 | Y | 8/2008 |
| CN | 201331225 | Y | 10/2009 |
| CN | 201425353 | Y | 3/2010 |
| CN | 201434460 | Y | 3/2010 |
| CN | 301559760 | S | 11/2010 |
| CN | 301635055 | S | 8/2011 |
| CN | 202032693 | U | 11/2011 |
| CN | 301743975 | S | 11/2011 |
| CN | 202470270 | U | 10/2012 |
| CN | 302405864 | S | 4/2013 |
| CN | 203385114 | U | 1/2014 |
| CN | 302782479 | S | 4/2014 |
| CN | 302809630 | S | 4/2014 |
| CN | 302809632 | S | 4/2014 |
| CN | 203848426 | U | 9/2014 |
| CN | 303013053 | S | 11/2014 |
| CN | 303321645 | S | 8/2015 |
| CN | 106091220 | A | 11/2016 |
| CN | 304047506 | S | 2/2017 |
| CN | 304206641 | S | 7/2017 |
| CN | 304229250 | S | 8/2017 |
| CN | 304232931 | S | 8/2017 |
| CN | 304275843 | S | 9/2017 |
| CN | 107327992 | A | 11/2017 |
| CN | 304409176 | S | 12/2017 |

(56) References Cited

FOREIGN PATENT DOCUMENTS

| | | | | | |
|---|---|---|---|---|---|
| CN | 206905164 | U | | 1/2018 | |
| CN | 207262610 | U | | 4/2018 | |
| CN | 304589588 | S | | 4/2018 | |
| CN | 304594138 | S | | 4/2018 | |
| CN | 304607851 | S | | 5/2018 | |
| CN | 304607887 | S | | 5/2018 | |
| CN | 207527751 | U | | 6/2018 | |
| CN | 207975768 | U | | 10/2018 | |
| CN | 304870145 | S | | 10/2018 | |
| CN | 108826551 | A | | 11/2018 | |
| CN | 208042402 | U | | 11/2018 | |
| CN | 304934939 | S | | 12/2018 | |
| CN | 304947235 | S | | 12/2018 | |
| CN | 305072142 | S | | 3/2019 | |
| CN | 305218131 | S | | 6/2019 | |
| CN | 305223717 | S | | 6/2019 | |
| CN | 305281766 | S | | 7/2019 | |
| CN | 209279327 | U | | 8/2019 | |
| CN | 305292866 | S | | 8/2019 | |
| CN | 305382546 | S | | 10/2019 | |
| CN | 209639184 | U | | 11/2019 | |
| CN | 209689113 | U | | 11/2019 | |
| CN | 305448417 | S | | 11/2019 | |
| CN | 305474029 | S | | 12/2019 | |
| CN | 305612741 | S | | 2/2020 | |
| CN | 305612750 | S | | 2/2020 | |
| CN | 305627369 | S | | 2/2020 | |
| CN | 305627370 | S | | 2/2020 | |
| CN | 305672142 | S | | 3/2020 | |
| CN | 210290192 | U | | 4/2020 | |
| CN | 210425370 | U | | 4/2020 | |
| CN | 305708993 | S | | 4/2020 | |
| CN | 306072989 | S | | 9/2020 | |
| CN | 306107691 | S | | 10/2020 | |
| CN | 306316183 | S | | 2/2021 | |
| CN | 306360588 | S | | 3/2021 | |
| CN | 306414462 | S | | 3/2021 | |
| CN | 306916981 | S | | 11/2021 | |
| CN | 307246435 | S | | 4/2022 | |
| CN | 307246436 | S | | 4/2022 | |
| CN | 216667877 | U | | 6/2022 | |
| CN | 216844922 | U | | 6/2022 | |
| CN | 216976984 | U | | 7/2022 | |
| CN | 217274586 | U | | 8/2022 | |
| EP | 661504 | A1 | | 7/1995 | |
| EP | 0017127704-0001 | | | 6/2010 | |
| GB | 2420083 | A | | 5/2006 | |
| GB | 2591149 | A | | 7/2021 | |
| JP | H03105127 | A | | 5/1991 | |
| JP | D1258427 | | | 12/2005 | |
| JP | 1374275 | | | 11/2009 | |
| JP | 1388881 | | | 5/2010 | |
| JP | D1671987 | S | | 10/2020 | |
| JP | D1712333 | S | | 4/2022 | |
| KR | 100543336 | B1 | | 12/1899 | |
| KR | 30-0309259 | | | 10/2002 | |
| KR | 30-0309260 | | | 10/2002 | |
| KR | 20030097047 | A | | 12/2003 | |
| KR | 20050039112 | A | * | 4/2005 | ..... F24F 11/52 |
| KR | 30602966-1 | | | 6/2013 | |
| KR | 30-0764177 | | | 10/2014 | |
| KR | 30-0765886 | | | 10/2014 | |
| KR | 30-0865259 | | | 7/2016 | |
| KR | 20160083171 | A | | 7/2016 | |
| TW | M490518 | U | | 11/2014 | |
| WO | 9513506 | A1 | | 5/1995 | |
| WO | 03074945 | A | | 9/2003 | |
| WO | 03074945 | A1 | | 9/2003 | |
| WO | 2005073642 | A1 | | 8/2005 | |
| WO | 2018058132 | A1 | | 3/2018 | |
| WO | DM208439 | | | 4/2020 | |
| WO | DM213160 | | | 12/2020 | |
| WO | WO-2021076741 | A1 | * | 4/2021 | ..... F24D 11/00 |
| WO | DM216807 | | | 9/2021 | |
| WO | DM216945 | | | 9/2021 | |
| WO | 2021242295 | A1 | | 12/2021 | |

OTHER PUBLICATIONS

Costway Evaporative Cooler—Oscillating Air Cooler with LED Display—Remote Control—125 Square Foot Cooling, 8-Hour Timing Function, for Home & Office, Cooling & Humidification Function (41-Inch), https://www.amazon.com/dp/B07XNTDGLD, accessed May 29, 2020.

GLmbllo Baby Stroller Mini Fan, https://www.amazon.com/GLmbllo-Stroller-Portable-Cooler-Child/dp/B07V6R2DC8/ef=sr_1_2?keywords=portable+evaporalive+cooler+slroller&qid=1578343377&sr=8-2, retrieved Mar. 26, 2020.

European Search Report; Appl. No. 19154738.9, dated Aug. 29, 2019; 4 pages.

Filter for Personal Space Cooler, Arctic Air Cooler Replacement Filler Humidifier, www.amazon.com/dp/B07DGWMSH6/, retrieved Oct. 31, 2018.

NewAir AF-310 Portable Evaporative Air Fan and Humidifier. Personal Indoor Outdoor Swamp Cooler, https://www.amazon.com/NewAir-Portable-Evaporalive-Humidifier-AF-310/dp/B009KGB4FK/, accessed on May 29, 2020.

Luma Comfort EC45S Tower Evaporative Cooler with 125 Square Foot Cooling, 250 CFM, https://www.amazon.com/Luma-Comfort-EC45S-Evaporative-Cooling/dp/B007SNQ4FM/, accessed on May 29, 2020.

Luonita Portable Air Conditioner, https://www.amazon.com/Luonita-Portable-Condilioner-Humidifier-Evaporalive/dp/B07TXZ57XR/, retrieved Mar. 26, 2020.

Global Sources Home Products, No. 10, vol. 8, p. 11, Docket No. HB26005377: Design Division of the Japan Patent Office; Nov. 27, 2014.

GDSTime EC Cooling Fan, www.amazon.com/dp/B07H8W376G, retrieved Nov. 7, 2018.

Ontel AA-MC4 Arctic Air Personal Space & Portable Cooler | The Quick & Easy Way to Cool Any Space, As Seen on TV, www.amazon.com/AA-MC4-Arctic-Personal-Portable-Cooler/dp/B0787DD3RX, retrieved Oct. 31, 2018.

Evapolar Air Cooler evaSMART EV-3000 Opaque White US Plug, www.amazon.com/dp/B075G1HBNW, retrieved Oct. 31, 2018.

Evapolar EV1000CART Replacement Evaporative Cartridge for EV-1000 evaLIGHT Personal Air Cooler and Humidifier, www.amazon.com/Evapolar-EV1000CART-Replacement-Evaporative-Humidifier/dp/B06XT5B742, retrieved Oct. 31, 2018.

HoMedics MyChill Personal Space Cooler in Blue, www.amazon.com/HoMedics-MyChill-Personal-Space-Cooler/dp/B075564HQZ, retrieved Oct. 31, 2018.

Filter for Personal Space Cooler, Arctic Air Cooler Replacement Filter Humidifier, www.amazon.com/dp/B07DGWMSH6/, retrieved Oct. 31, 2018.

Ontel Arctic Air Personal Space Cooler Replacement Filter Authentic OEM, www.amazon.com/dp/B07DQ6DXXC/, retrieved Oct. 31, 2018.

World's First Personal Air Cooler (Evapolar), www.youtube.com/watch?v=k4NxBWPTqOA, published Aug. 23, 2016.

Domus, vol. 767, Jan. 31, 1995, p. 108, Docket No. HB07009193: Design Division of the Japan Patent Office.

Issuance of Notice of Grant for Japanese Design Application No. 2018-013816.

* cited by examiner

EVAPORATIVE AIR COOLER HAVING AN ICE PACK

CROSS REFERENCE TO RELATED APPLICATIONS

This application is a continuation-in-part of U.S. patent application Ser. No. 17/157,098, filed on Jan. 25, 2021, which is a continuation-in-part of U.S. patent application Ser. No. 16/911,797, filed on Jun. 25, 2020, which is a continuation-in-part of U.S. patent application Ser. No. 16/897,678, filed on Jun. 10, 2020, which is a continuation-in-part of U.S. patent application Ser. No. 16/239,161, filed on Jan. 3, 2019, and issued as U.S. Pat. No. 10,712,029 on Jul. 14, 2020, the entire disclosures of which are incorporated herein by reference.

This application is also related to U.S. Design patent application Ser. No. 29/760,128, filed on Nov. 30, 2020, and issued as U.S. Pat. No. RE48,619 on Jul. 6, 2021 which is a reissue application of U.S. Design patent application Ser. No. 29/674,634, filed on Dec. 21, 2018, and issued as U.S. Pat. No. D8 52340 on Jun. 25, 2019.

FIELD OF THE INVENTION

The present disclosure relates generally to an evaporative air cooler.

BACKGROUND

Evaporative personal air coolers are commonly used to cool air in a home, office, or other hot, dry air environment. Conventional evaporative air coolers operate by drawing ambient air into the evaporative air cooler and direct it through a water-soaked filter device. As warm air passes through the water-soaked filters, heat from the ambient air evaporates water trapped in the water-soaked filter device. The evaporated water cools the air as it leaves the water-soaked filter device and exits the evaporative air cooler.

Conventional evaporative air coolers typically include a fan, a filter device, and a water distribution system. The fan draws outside air into the evaporative air cooler, pushes it through the filter device to produce cooler air, and then pushes the cooler air out of the evaporative air cooler. More specifically, the water distribution system provides water to the filter device so that the filter device becomes water soaked. The water distribution system includes a water pump that draws water from a reservoir and distributes the water to a bottom surface of the filter device which soaks upwards. Depending on the type of filter and the amount of water in the reservoir, the water may travel only partially up the filters. If the filters are not fully soaked with water, the evaporative air cooler is less effective at producing cooler air. Filter devices typically include filters made of a paper-like material that have to be replaced often. The filters cannot be reused or easily cleaned.

Some of the water distributed to the filter device evaporates as air flows through the filters. The water in the reservoir depletes as the evaporative air cooler operates due to the evaporation. Any unabsorbed water that recirculates within the evaporative air cooler returns to the reservoir. When the reservoir is fully depleted of water but the filter device is soaked with water, the evaporative air cooler can still produce cooler air, but it becomes less effective. The evaporative air cooler will cease producing cooler air when the filter device is dry. Thus, additional water must be constantly added to replace the water that has been evaporated.

It typically takes conventional evaporative air coolers a considerable period of time to begin cooling air because the filter device must soak up water from the reservoir before the cooling process can begin. In other words, conventional evaporative air coolers do not instantly produce cooler air.

SUMMARY

This section provides a general summary of the present disclosure and is not a comprehensive disclosure of its full scope or all of its features, aspects, and objectives.

Disclosed herein are implementations of an evaporative air cooler. The evaporative air cooler may include a housing including a top portion and a bottom portion coupled to the top portion. The evaporative air cooler may further include a water tank disposed in the top portion of the housing and configured to store water therein. The water tank may include an upper portion and a lower portion extending from the upper portion. The evaporative air cooler may also include a fan disposed within the housing. The evaporative air cooler may further include a holder removably attached to a back face of the housing. The evaporative air cooler may also include an ice pack at least partially received and supported by the holder. The ice pack may be configured for cooling air entering the evaporative air cooler.

Also disclosed herein are implementations of an evaporative air cooler. The evaporative air cooler may include a housing including a top portion and a bottom portion coupled to the top portion. The evaporative air cooler may further include a water tank disposed in the top portion of the housing and configured to store water therein. The water tank may include an upper portion and a lower portion extending from the upper portion. The evaporative air cooler may also include a fan disposed within the housing. The evaporative air cooler may further include a filter structure disposed within the housing. The filter structure may be disposed between the lower portion of the water tank and a front face of the housing. The evaporative air cooler may also include a holder removably attached to a back face of the housing. The evaporative air cooler may further include an ice pack at least partially received and supported by the holder. The ice pack may be configured for cooling air entering the evaporation air cooler.

Further disclosed herein are implementations of an evaporative air cooler. The evaporative air cooler may include a housing including a top portion and a bottom portion coupled to the top portion. The evaporative air cooler may further include a water tank disposed in the top portion of the housing and configured to store water therein. The water tank may include an upper portion and a lower portion extending from the upper portion. The evaporative air cooler may also include a fan disposed within the housing. The evaporative air cooler may further include a first ice pack disposed within the housing. The first ice pack may be disposed between the lower portion of the water tank and a front face of the housing.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
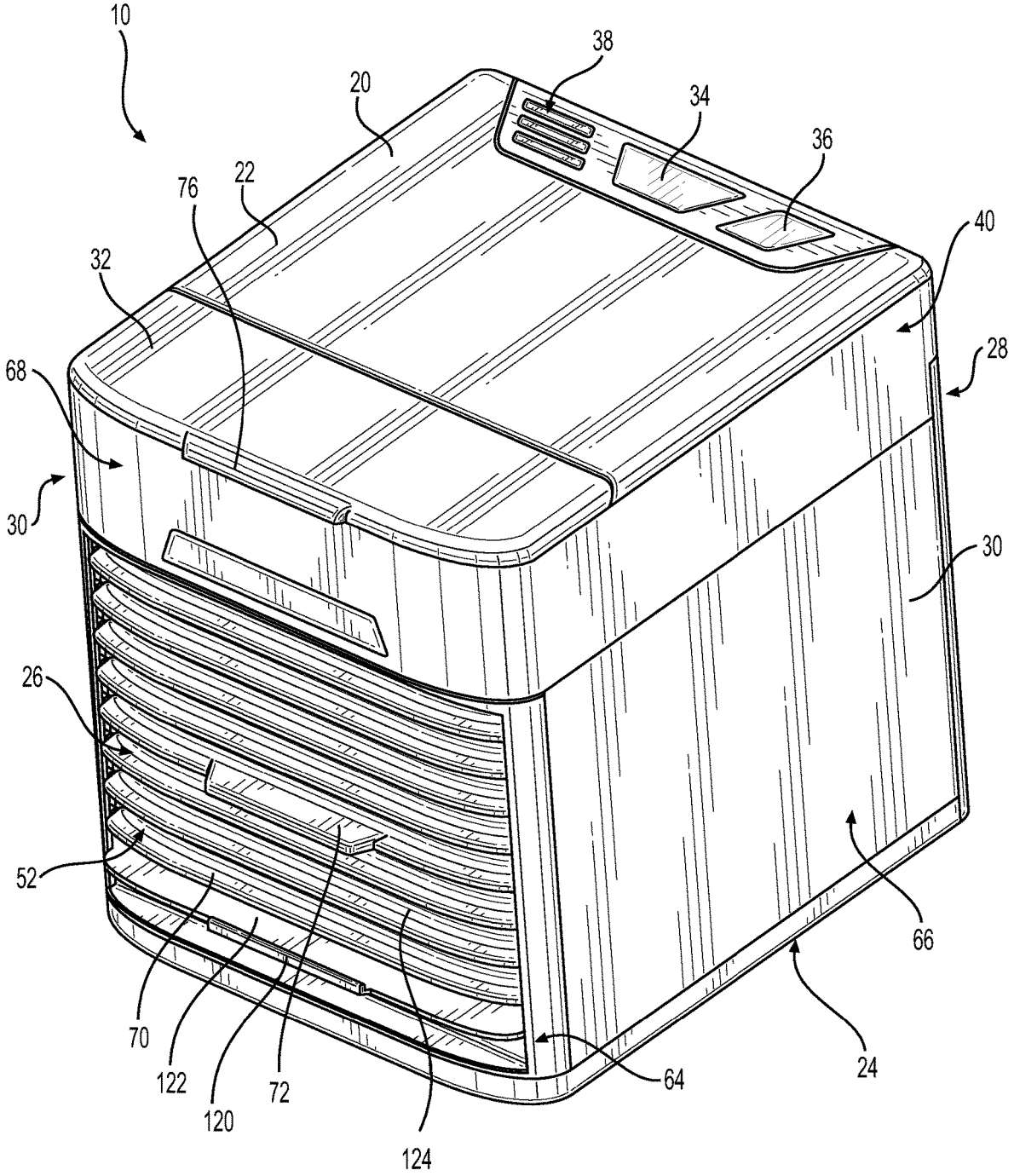
FIG. 1 generally illustrates a perspective view of an evaporative personal air cooler in accordance with aspects of the present disclosure.

The following description is merely exemplary in nature and is not intended to limit the disclosure in its application or uses. For purposes of clarity, the same reference numbers are used in the description and drawings to identify similar elements.

The present disclosure relates generally to an evaporative personal air cooler by which it draws in ambient air, cools the ambient air, and blows out the cooled ambient air. In this disclosure, the evaporative personal air cooler may be referred to as an evaporative air cooler, a portable evaporative air cooler, or any other desirable air cooler.

The evaporative air cooler 10 can include a housing 20 having a power adapter, a water tank 40, a v-shaped shroud 44, a fan 48, a drawer 50, and a filter structure 56.

FIG. 1 illustrates an exemplary evaporative air cooler 10. The evaporative air cooler can include the housing 20 with a top face 22, a bottom face 24, and four lateral faces, such as a front face 26, a back face 28, and side faces 30. The housing 20 can be formed as a cube housing, a rectangular housing, or any other desirable configuration or shape. The housing 20 can be formed from plastic or any other desirable material.

Figure 2:
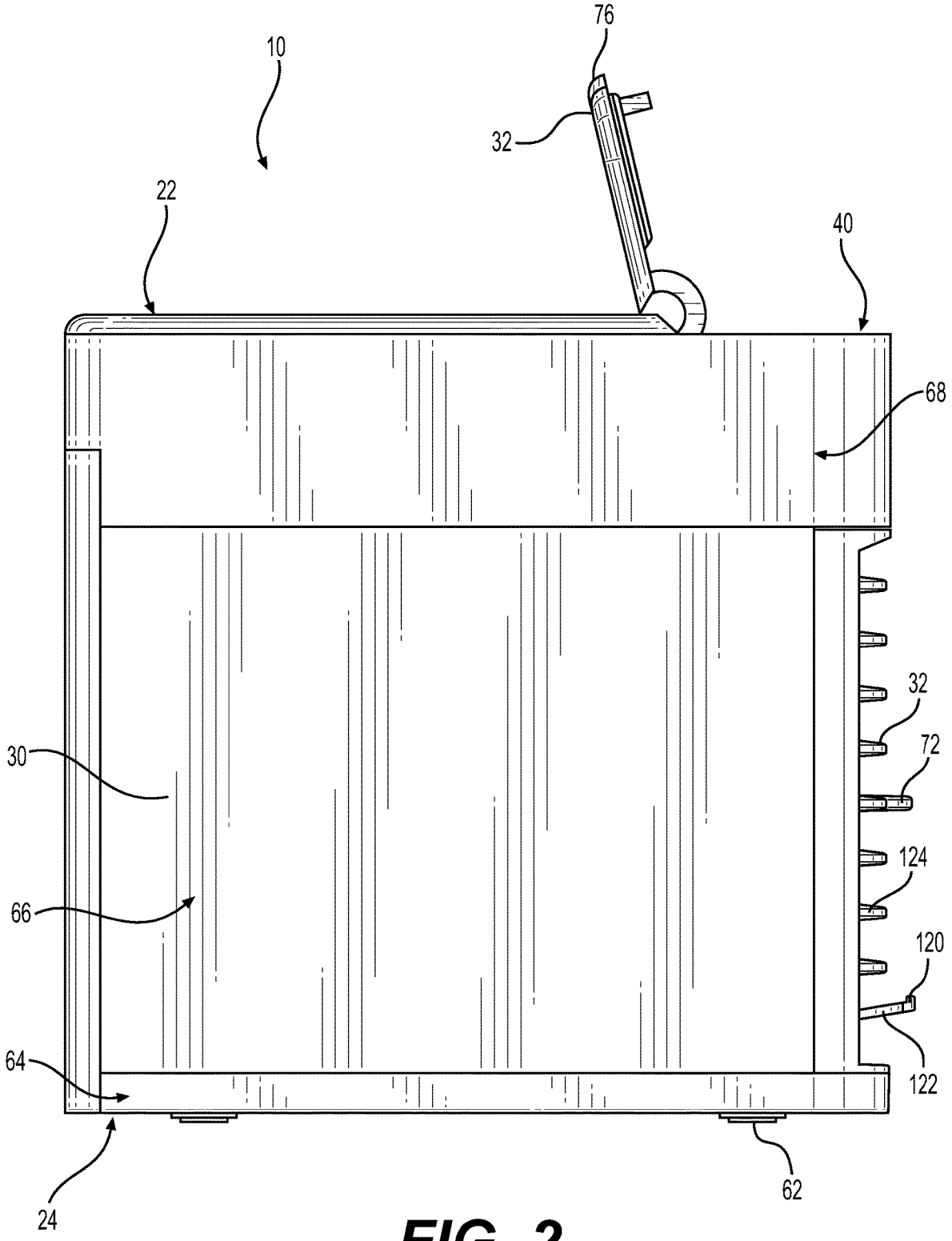
FIG. 2 generally illustrates a side view of the evaporative personal air cooler in accordance with aspects of the present disclosure.

The top face 22 can include a lid, such as a hinged lid 32. FIG. 2 illustrates the evaporative air cooler 10 with the hinged lid 32 opened for access to the water tank 40. The hinged lid 32 can be located along a front portion of the top face 22. The hinged lid 32 can include a lid tab 76 positioned in the front of the hinged lid 32 or any other desirable location. The hinged lid 32 can be opened to allow for water to fill the water tank 40. For example, a user can pull the lid tab 76 upward to open the hinged lid 32. The hinged lid 32 can be formed from plastic or any other desirable material. The opening to the water tank 40 can be any desirable opening and is not limited to the hinged lid 32 described in this disclosure.

The top face 22 can also include buttons, such as a power button 34, a light button 36, or any other desirable button. The top face 22 can also include one or more lights, such as an indicator light 38 or any other desirable light or indicator. The indicator light 38 may be used to indicate a fan speed, a level of water located within the water tank 40, whether filters 58 should be replaced, or any other desirable indication. For example, at a high speed, all three indicator lights 38 can be powered ON. At a medium speed, two indicator lights 38 can be powered ON. At a low speed, one indicator light 38 can be powered ON. In one embodiment, if the power button 34 is held down for at least three seconds, the indicator lights 38 can all turn off. The indicator light 38 may include one or more lights. The indicator light 38 may display a blinking light or a solid light. The indicator light 38 may display different light colors, such as green, red, amber, or any other desirable color.

The power button 34 can be configured to activate (e.g., power ON), change the fan speed of the fan 48, and deactivate (e.g., power OFF) the evaporative air cooler 10. For example, when the power button 34 is first activated, the indicator light 38 (e.g., three indicator lights 38) can turn ON, the fan 48 can turn ON (e.g., to a high speed), and an aperture 42 positioned in the water tank 40 can allow water to flow out of the tank 40 to begin the evaporative air cooling process. When the power button 34 is activated a second time, one of the indicator lights 38 can turn OFF (e.g., two indicator lights 38 remain ON), the fan speed can decrease (e.g., to a medium speed), and the aperture 42 can allow less water to flow out of the tank 40. When the power button 34 is activated a third time, one of the indicator lights 38 can turn OFF (e.g., one indicator light 38 remain ON), the fan speed can decrease (e.g., to a low speed), and the aperture 42 can allow less water to flow out of the tank 40. When the power button 34 is activated a fourth time, one of the indicator lights 38 can turn OFF (e.g., no indicator lights 38 remain ON), the fan 48 can turn OFF, and the aperture 42 can stop the water from flowing out of the tank 40. In other words, the power button 34 can be activated to deactivate, or power OFF the evaporative air cooler 10. In one embodiment, when the power button 34 is activated (e.g. pressed downward) for three or more seconds, it can turn OFF the indicator lights 38 and the evaporative air cooler 10.

The fan 48 can be wired to the evaporative air cooler 10. The wires can be soldered to electrically connect the fan 48 to the evaporative air cooler 10, or attached in any other desirable way. The wires can be hidden in a wire compartment or any other desirable compartment within the evaporative air cooler 10.

A light, such as a blue LED light, can be positioned within the water tank 40, such as beneath the power button 34, or any other desirable area for illuminating the water tank 40. The light can be used for ambiance, as a nightlight, or any other desirable purpose. The light may be on by default when the evaporative air cooler 10 is powered ON. The user can lower the brightness of the light or turn OFF the blue LED completely by pressing the light button 36. For example, after the power button 34 is pressed, the light is on a high brightness mode. When the user presses the light button 36 for a first time, the light can reduce its brightness (e.g., to a low brightness mode). When the user presses the light button for a second time, the light can turn OFF. In one embodiment, if the light button 36 is activated for a minimum amount of time (e.g., three seconds), an illumination setting can be selected and/or locked.

As illustrated in FIG. 2, the bottom face 24 can include feet 62 that project outward from the bottom face 24. The feet 62 can be configured to elevate the evaporative air cooler 10 from a surface it is placed on. The feet 62 can also be configured to prevent the evaporative air cooler 10 from damaging the surface. For example, when sliding the evaporative air cooler 10 across the surface, the feet 62 can prevent the scratching of the surface. The feet 62 may be formed from rubber, plastic, grips, or any other desirable material. The bottom face 24 can include a plurality of feet 62. The feet 62 may be formed as circular feet 62, ovular feet 62, square feet 62, rectangular feet 62, or any other desirable shape. The feet 62 can be positioned toward each corner of the bottom face 24, or any other desirable location. In an alternative embodiment, the bottom face 24 does not include feet 62.

The lateral faces can include a front face 26, a back face 28, and two side faces 30. The lateral faces can be positioned between the top face 22 and the bottom face 24 about their outer perimeters. The lateral faces can be positioned adjacent each other. The lateral faces can include a framed portion 64 and a face portion 66. The framed portion 64 can be positioned about a perimeter of a lateral face, wherein the face portion 66 is positioned within the framed portion 64. For example, the side faces 30 can include an upper portion 68, the framed portion 64 positioned adjacent the upper portion 68 and along the side and bottom edges of the side faces 30, and a face portion 66 positioned within the framed portion 64.

Figure 3:
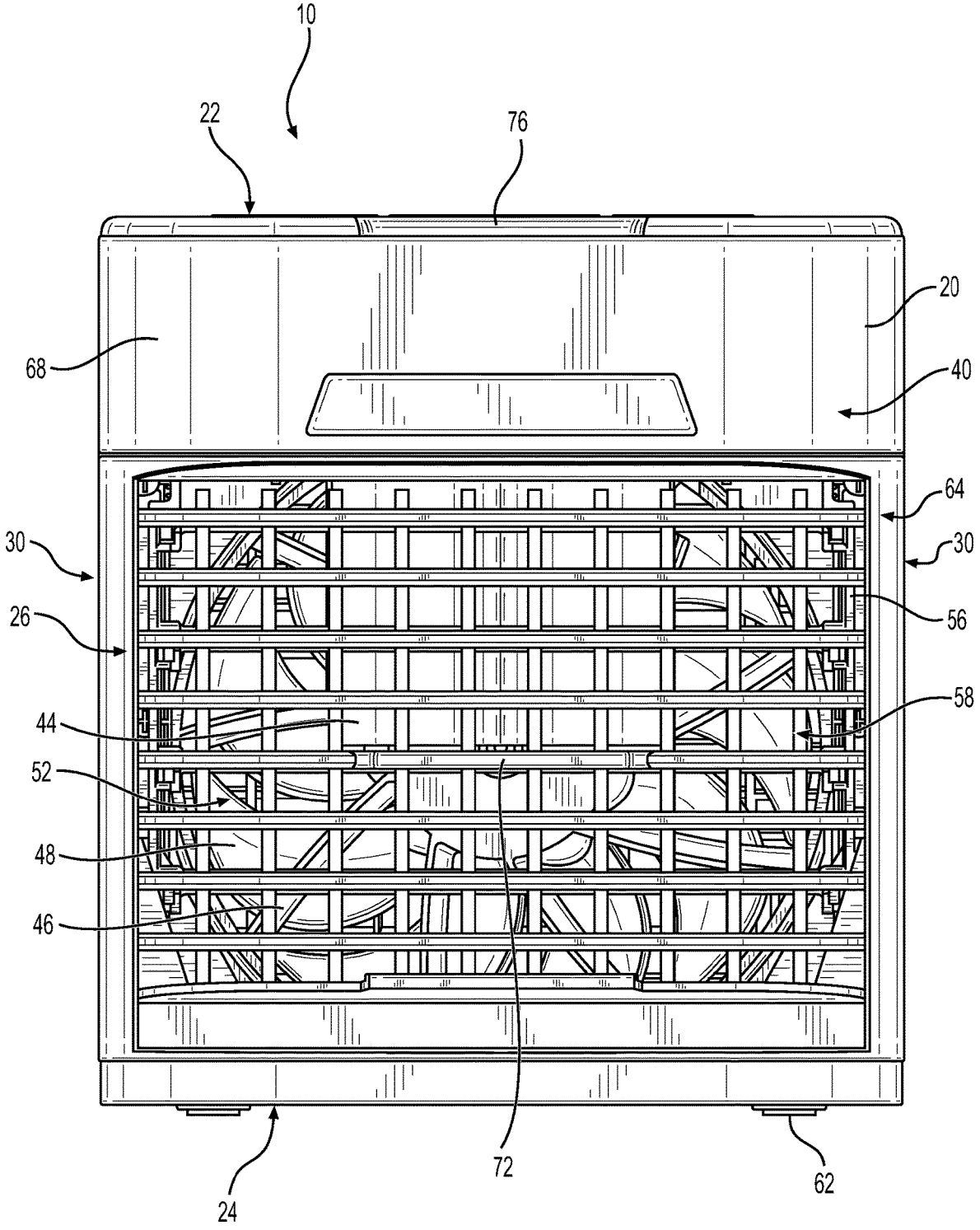
FIG. 3 generally illustrates a front view of the evaporative personal air cooler in accordance with aspects of the present disclosure.

As illustrated in FIG. 3, the front face 26 can include an upper portion 68 and a framed portion 64 positioned adjacent the upper portion 68 and along the side and bottom edges of the top face 22. The front face 26 can also include an outlet vent 52 positioned within the framed portion 64. The outlet vent 52 can include a plurality of vents 70, an air direction tab 72, and a filter drawer tab 120. The plurality of vents 70 can include a fixed vent 122 and an adjustable vent 124. For example, the fixed vent 122 may be positioned as the lowest vent 70 on the outlet vent 52. The remainder of the plurality of vents 70 may consist of the adjustable vent 124. Each of the plurality of vents 70 can be positioned horizontally in the outlet vent 52. Each of the adjustable vents 124 can be movably connected to the air direction tab 72. The air direction tab 72 can be positioned to direct air flowing from inside the evaporative air cooler 10 through the outlet vent 52. For example, if the air direction tab 72 is positioned upward, the adjustable vents 124 may be positioned in an upward position to direct the airflow upward. Similarly, if the air direction tab 72 is positioned downward, the adjustable vents 124 may be positioned in a downward position to direct the airflow downward. If the air direction tab 72 is positioned in a center position, the adjustable vents 124 may be positioned in a substantially horizontal position, directing the air to flow horizontally from the evaporative air cooler 10. The air direction tab 72 can direct the air to flow at any angle between the downward and upward angles.

Figure 4:
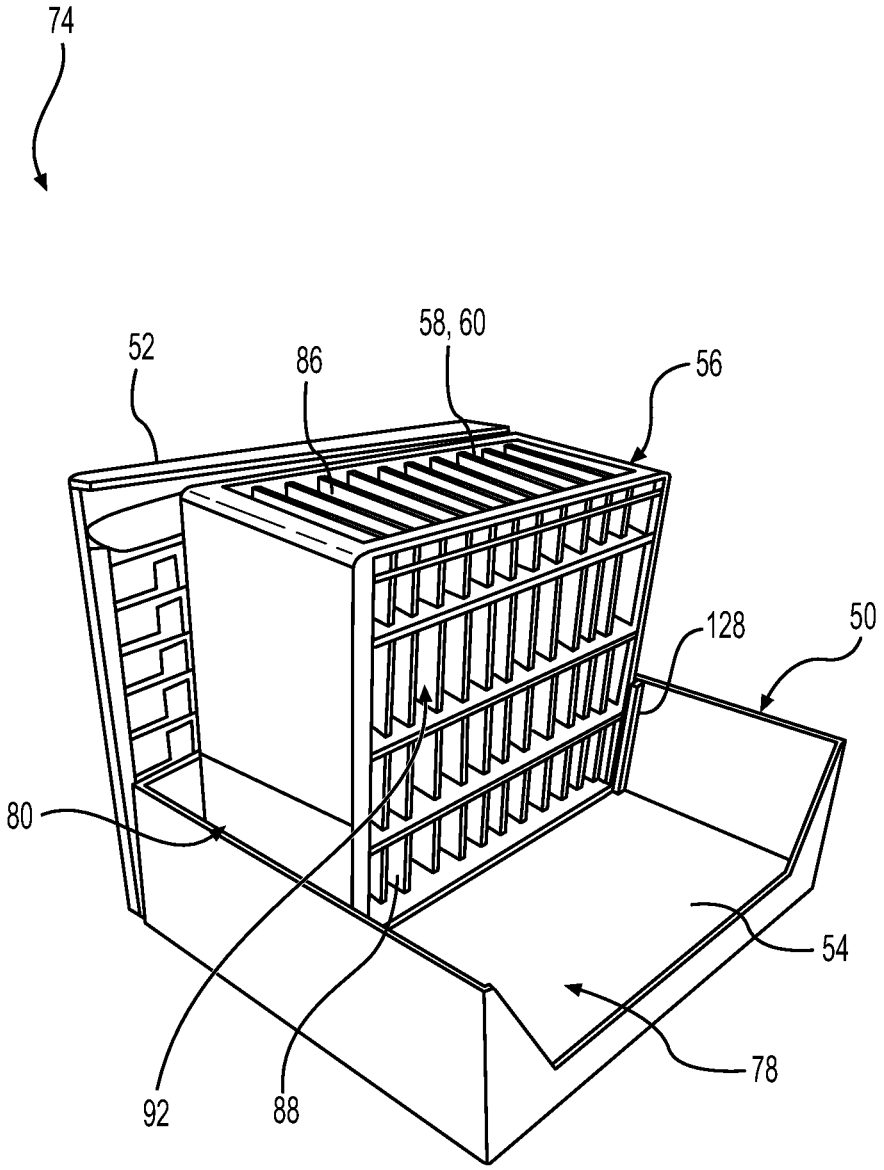
FIG. 4 generally illustrates a perspective view of an internal assembly of the evaporative personal air cooler in accordance with aspects of the present disclosure.
Figure 5:
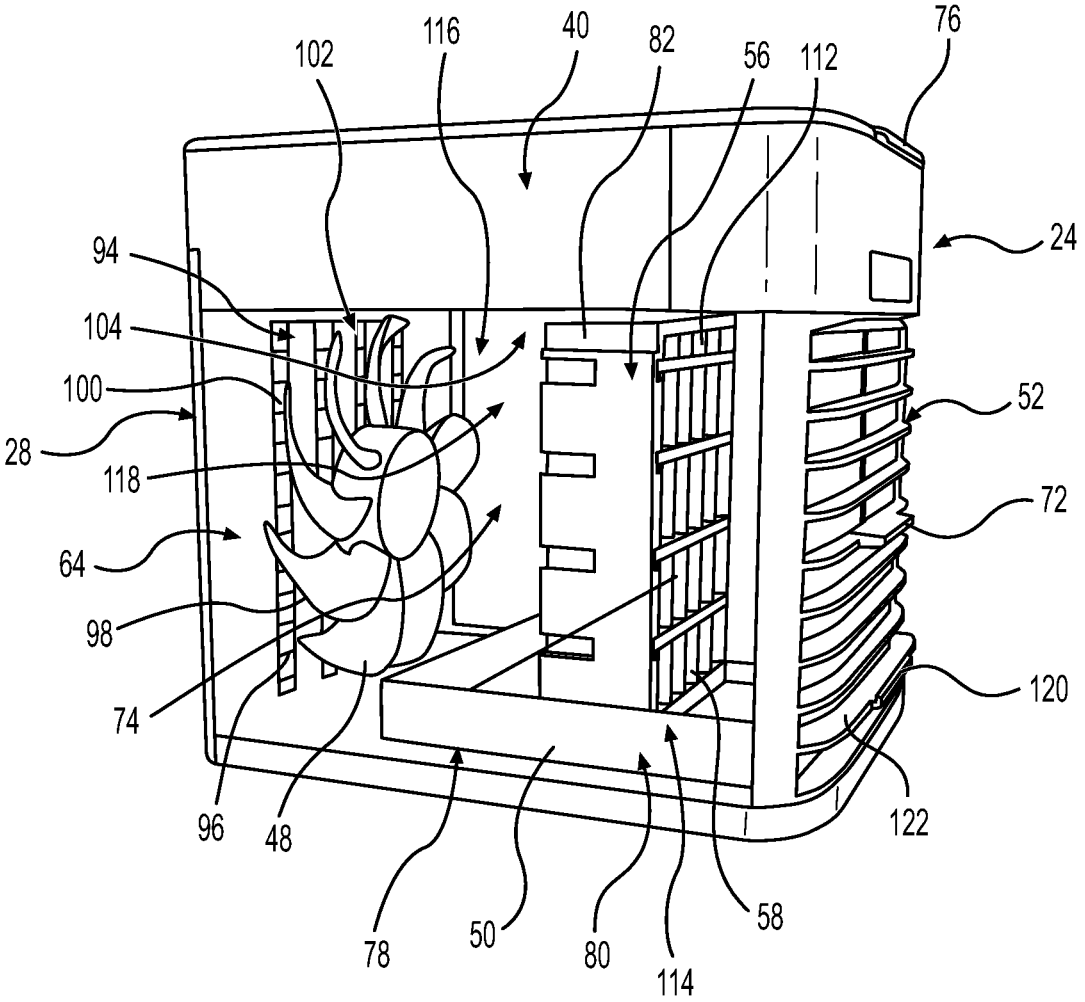
FIG. 5 generally illustrates a perspective view of an interior of the evaporative personal air cooler in accordance with aspects of the present disclosure.

The face portion 66 of the front face 26, such as the outlet vent 52, can be connected to an internal assembly 74 that is removable from the housing 20. As illustrated in FIGS. 4 and 5, the internal assembly 74 of the evaporative air cooler 10 can include the filter structure 56 including filters 58, the drawer 50 including a water tray 54. The internal assembly 74 can fit tightly around the circumference of the fan 48. For example, the internal assembly 74 can form a seal around the fan 48 to direct air out of the evaporative air cooler 10. The internal assembly 74 can be configured to increase the force of the air as it exits the evaporative air cooler 10 to increase the cooling effect of the evaporative air cooler 10. The internal assembly 74 may also be configured to decrease noises produced during operation of the evaporative air cooler 10. For example, the seal, such as an airtight seal, reduces the amount of air escaping from the evaporative air cooler 10 and reduces air vibrating off of other components or the walls of the evaporative air cooler 10.

The drawer 50 can be attached to the outlet vent 52. The outlet vent 52 can be removed from the evaporative air cooler 10. For example, the fixed vent 122 can include a filter drawer tab 120. The user can pull on the filter drawer tab 120 to remove the outlet vent 52 from the evaporative air cooler 10. The outlet vent 52 can have one or more tabs or any other desirable device for removing the outlet vent 52 from the evaporative air cooler 10. An interior side of the side faces 30 can include a drawer guide 108. The drawer guide 108 is configured to assist the user in slidably removing and inserting the drawer from and into the housing 20.

The drawer 50 can include the water tray 54. The water tray 54 can be positioned in the drawer 50. The water tray 54 can be formed at the bottom of the housing 20. The water tray 54 can be angled for any liquid on the water tray 54 to flow in a direction toward the filter structure 56. For example, the water tray 54 can be higher toward a back end 78 of the drawer 50 than toward the front end 80 of the drawer. The water tray 54 can be configured for cleaning. For example, when the drawer 50 is removed from the evaporative air cooler 10 and the filter structure 56 is removed from the water tray 54, the water tray 54 can be easily accessible for cleaning. The user can wipe down and dry or otherwise clean the water tray 54. Cleaning the water tray 54 may result in less mold or other bacteria.

The drawer 50 can be configured to support the filter structure 56. The filter structure 56 can be removably attached to the drawer 50. The drawer 50 can have a drawer notch 128 to secure the filter structure 56 in place. For example, the filter structure 56 can be placed on a top surface of the water tray 54 between the outlet vent 52 and the drawer notch 128.

Figure 6A:
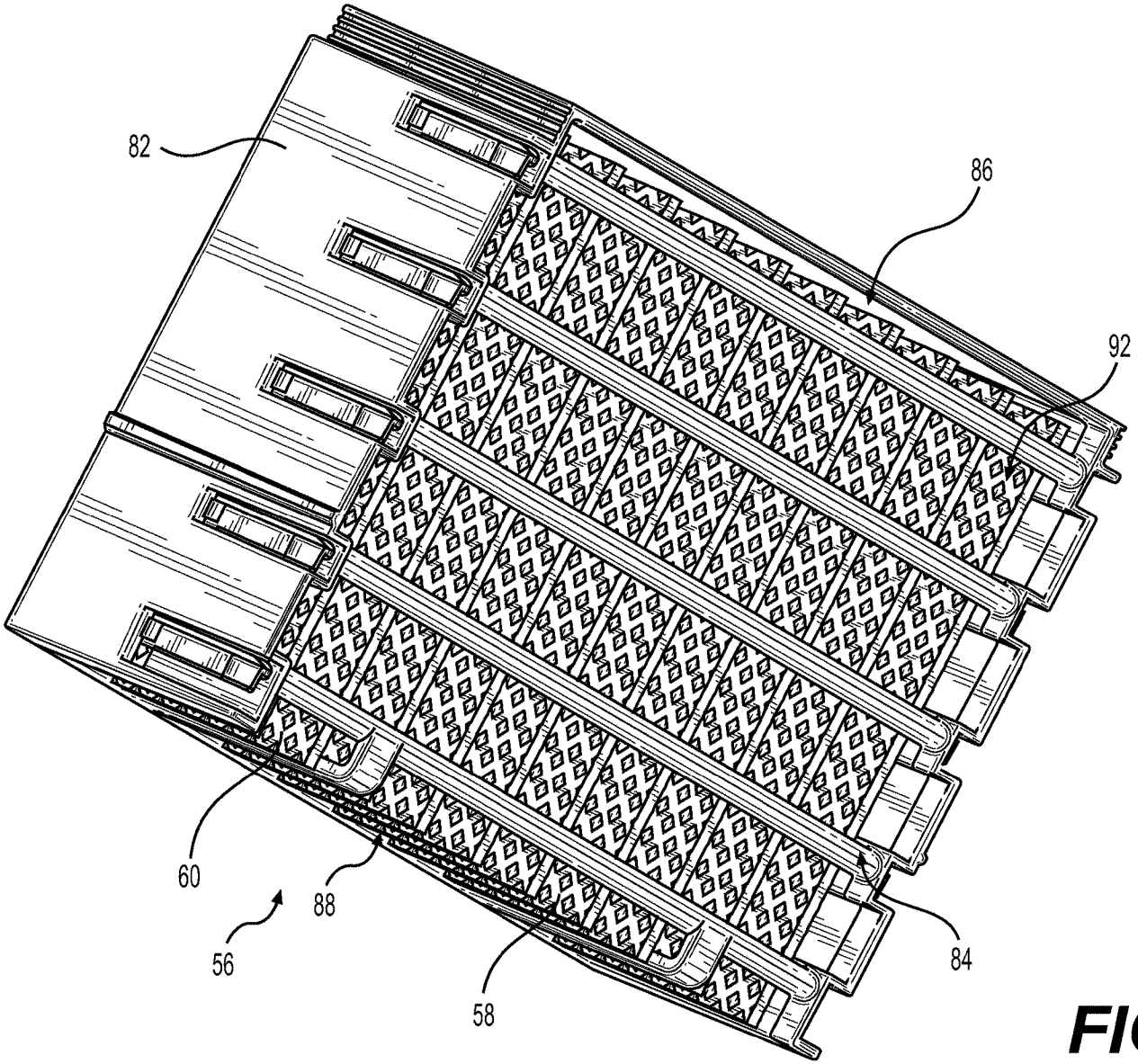
FIGS. 6A-6B generally illustrate perspective views of a filter structure of the evaporative personal air cooler in accordance with aspects of the present disclosure.
Figure 6B:
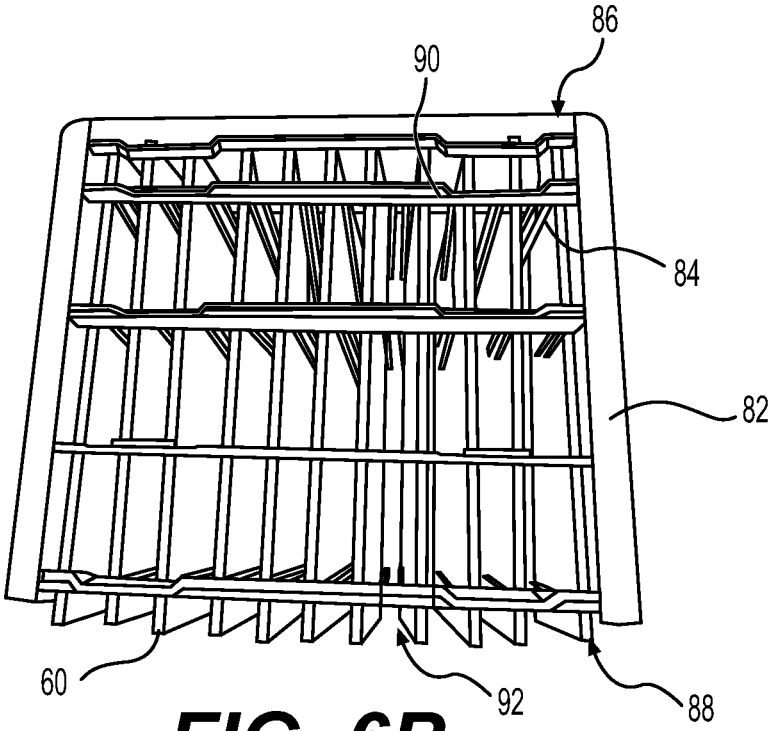
Figure 6C:
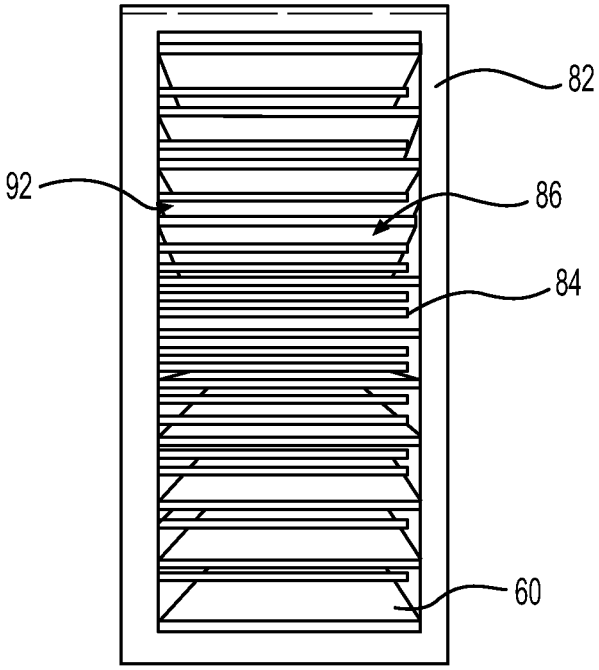
FIG. 6C generally illustrates a top view of a filter structure of the evaporative personal air cooler in accordance with aspects of the present disclosure.

As illustrated in FIGS. 6A-6C, the filter structure 56 can include a filter frame 82 and a plurality of filter holders 84 attached to opposing sides of the filter frame 82. In one exemplary embodiment, as illustrated in FIG. 6C, the filter frame 82 can include a top opening 86 and a bottom opening 88. The top opening 86 can be configured to allow for a mist 118 to contact top portions 112 of the filters 58. The bottom opening 88 can be configured to allow for the mist 118 and/or liquid, such as water, to contact bottom portions 114 of the filters 58. For example, if liquid has collected in the water tray 54, the liquid can contact bottom portions 114 of the filters 58. The sponge material 60 of the filters 58 may soak up the liquid. The sponge material 60 may also soak up the mist 118 as it contacts the filters 58. The filter holders 84 can define a plurality of holes, or filter openings 90. Each filter opening 90 can be configured for one filter 58 to be positioned within it. The filter holders 84 can be positioned substantially parallel to each other within the filter structure 56. The filter holders 84 can be configured to hold the filters 58 in place. The filters 58 can be positioned substantially parallel to each other and to opposing sides of the filter structure 56. The filter holders 84 can be configured with space, such as air gaps 92, between each filter holder 84 to allow for the mist 118 and/or liquid to contact the filters 58. The air and/or the mist 118 may also flow through the air gaps 92 and out of the evaporative air cooler 10. The filter structure 56 can be formed from plastic, metal, or any other desirable material.

As shown in FIGS. 4-6, the filter structure 56 can include a plurality of filters 58 mounted vertically. The filters 58 can be positioned parallel to the direction of airflow. The filters 58 can be formed from a sponge material 60. The filters 58 can be soaked prior to use. For example, the user can pull the filter drawer tab 120 on the outlet vent 52 to pull out the internal assembly 74, including the drawer 50, water tray 54, and the filter structure 56. The internal assembly 74 can slide out from within the evaporative air cooler 10. The filter structure 56 can be removed from drawer 50. The filter structure 56 can be placed in liquid, such as water, placed under running water, or any other desirable method to soak the filters 58. After the filters 58 are wet, the filter structure 56 can be placed in the freezer, or any other desirable cooling device. If the wet filters 58 are frozen, the cooling effect of the evaporative air cooler 10 can be enhanced. When complete, the user can put the filter structure 56 on the drawer 50 and slide the internal assembly 74 back into the evaporative air cooler 10. If the filters 58 are pre-moistened, the initial cooling effect can increase because air travels through the wet filters 58 when the evaporative air cooler 10 first starts running. If the filters 58 are not presoaked, the evaporative air cooler 10 can produce cool air, but it may not be at capacity.

The filter structure 56, including the plurality of filters 58, can be constructed of sponge material 60, plastic and sponge material 60, or any other desirable material. The filter structure 56, together with the filters 58, can be configured for cleaning. For example, the plastic and sponge material 60 can be cleaned using various methods, such as hand-washing, soaking, dishwasher, or any other desirable method. The filter structure 56, including the filters 58, can be sanitized. For example, the filter structure 56, including the filters 58, can be sanitized in a microwave or any other desirable method. The filters 58 can be handled, washed, and used more vigorously than filters formed from paper material. The filters 58 can be reusable, used longer while wet, re-moistened and re-dried, and have an overall longer lifetime and usability than paper filters. The filter structure 56 can be replaced, for example, after three to six months of use.

The evaporative air cooler 10 can also be powered ON without water in the water tank 40 to dry out the filters 58 and the interior of the evaporative air cooler 10. For example, if a user plans to not use the evaporative air cooler 10 for an extended period of time, the user can empty the water tank 40, press the power button 34 to turn the evaporative air cooler 10 ON to the high mode for a period of time, such as for four hours.

The back face 28 can include the upper portion 68 and the framed portion 64. The back face 28 can include a power port for the power adapter. The power adapter includes a cord with a first power adapter plug on one end that is configured to plug into the power port and a second power adapter plug on the opposite end of the cord that is configured to plug into an outlet, such as a wall outlet or a power strip. The power port can be located in the upper portion 68 of the back face 28 or any other desirable location on the evaporative air cooler 10. In another embodiment, the evaporative air cooler 10 can be powered using batteries or another power source.

The back face 28 can also include a grate 94. The grate 94 can be positioned within the framed portion 64. The grate 94 can include a plurality of ribs positioned horizontally or vertically along the back face 28. As shown in FIGS. 5 and 6, the grate 94 includes both horizontal ribs 96 and vertical ribs 98 that define a plurality of grate openings 100. The plurality of grate openings 100 are configured to allow air to flow from outside the evaporative air cooler 10 to inside the evaporative air cooler 10. The grate 94 may also have a cord guide for securing the cord of the power adapter in place. The cord guide may be located along one side of the grate 94 and adjacent to the framed portion 64, or any other desirable location. The grate 94 may have one or more cord guides tabs. Additionally, some of the horizontal ribs 96 may be shorter to allow for the cord to be positioned flush with the horizontal ribs 96.

Figure 7:
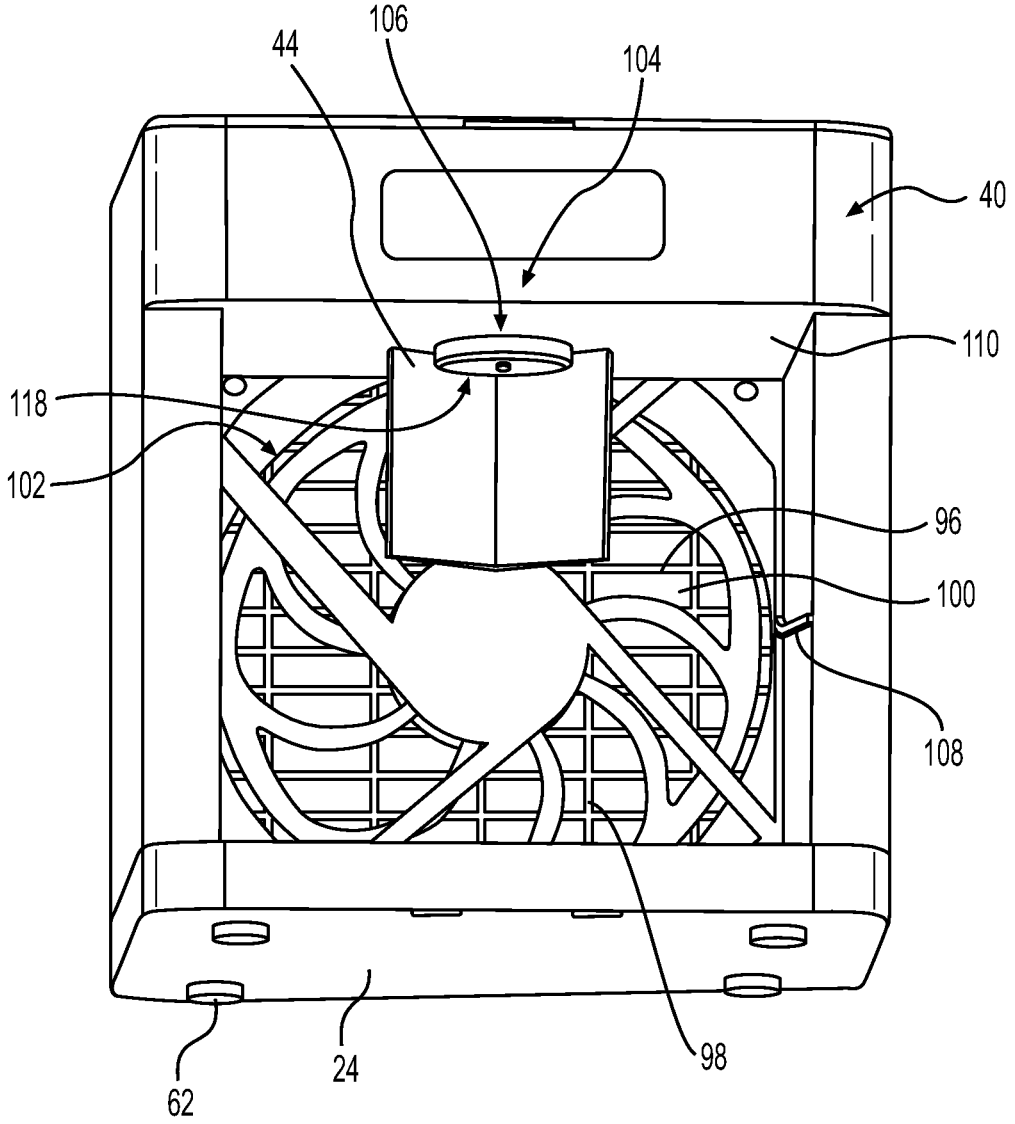
FIG. 7 generally illustrates a front perspective view of the evaporative personal air cooler after the internal assembly is removed in accordance with aspects of the present disclosure.
Figure 8:
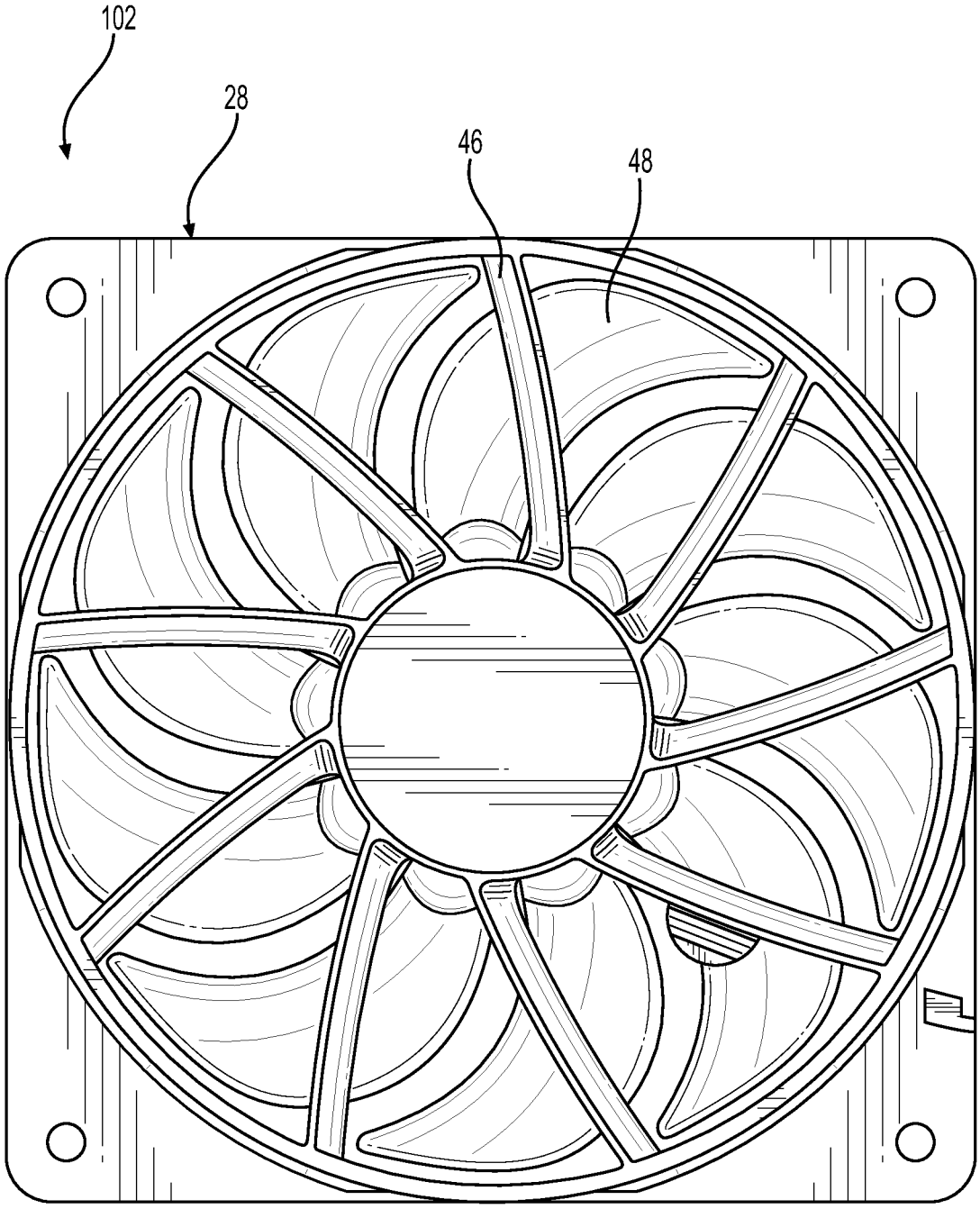
FIG. 8 generally illustrates a front view of a fan cover assembly of the evaporative personal air cooler in accordance with aspects of the present disclosure.

As illustrated in in FIGS. 7 and 8, the fan cover assembly 102 can include the grate 94, the fan 48, and a fan cover 46. The fan cover assembly 102 can be configured to reduce vibration and other movement within the evaporative air cooler 10. By doing so, the fan cover assembly 102 can reduce the noise of operation of the evaporative air cooler 10. The fan cover assembly 102 can also efficiently direct airflow. For example, the fan cover assembly 102 can effectively direct air outward from the evaporative air cooler 10.

For example, the fan 48 can direct airflow from the back face 28 toward the front face 26. The fan 48 can be positioned inside the housing 20 between the grate 94 and the fan cover 46. The fan cover 46 can be configured to further direct the airflow. For example, the fan cover 46 can provide an optimal volume of air flow for the size and type of the evaporative air cooler 10. The fan cover 46 can be configured to maximize the technical and electrical specifications of the fan 48.

The user can control the speed of the fan 48. For example, the user can press the power button 34 to toggle the fan speed between three different speeds (e.g., high, medium, and low speeds). Changing the fan speed can change the water flow rate through the aperture 42. The change in the water flow rate can be proportional to the change in the fan speed. At the high speed, the water flow rate can be at a high rate. At the medium speed, the water flow rate can be at a medium rate. At the low speed, the water flow rate can be at a low rate.

Thus, the misting structure 104 can be configured to produce a variable volume of the mist 118. The volume of the mist 118 produced can be based on the fan speed. For example, as the fan speed increases, the volume of the mist 118 can increase. The increase in the volume of the mist 118 may allow for an optimal amount of moisture to enter into the air, which can result in a better cooling effect. As the fans speed decreases, so may the mist volume.

For example, when the power button 34 is pressed, the evaporative air cooler 10 can turn on. The fan 48 can begin spinning, and the mist 118 can begin to spray from a misting structure 104. The default fan speed can be the high speed when the evaporative air cooler 10 is first powered ON, or any other desirable fan speed. The user can adjust the cooling effect of the evaporative air cooler 10, including the amount of the mist 118 and/or the airflow speed using the power button 34. The user can adjust the airflow direction (e.g., from top to bottom) using the air direction tab 72 on the outlet vent 52. The power button 34 can be pressed again to turn off the evaporative air cooler 10.

As illustrated in FIG. 7, the v-shaped shroud 44 can be positioned on an underside of the top internal panel 110 to allow liquid to transform into the mist 118. The top internal panel 110 can be a wall between the evaporative air cooler 10 and the water tank 40, the bottom of the water tank 40, or any other desirable structure. The v-shaped shroud 44 can be configured to distribute the mist 118 evenly toward the filters 58. An even distribution of liquid on the filters 58 provides an effective cooling effect for the user. The v-shaped shroud 44 can be configured to maximize airflow to the user.

For example, the v-shaped shroud 44 can extend from the bottom of the water tank 40 into the evaporative air cooler 10. The fan 48 used with the v-shaped shroud 44 can turn the liquid into the mist 118 and direct the mist 118 toward the filter structure 56 and filters 58. Some of the mist 118 may evaporate, and some of the mist 118 may travel between the sponge material 60 and through outlet vent 52 to cool the air outside of the housing 20. Some of the mist 118 can soak into the sponge material 60, allowing for later evaporative cooling. Some of the mist 118 can fall into the water tray 54, where it can collect and turn into liquid. The liquid can be absorbed into the filters 58 via capillary action, to allow for additional evaporative cooling. The water tray 54 can be constructed with a slight angle. The slight angle can cause excess or unabsorbed liquid to flow toward the filters 58. The excess liquid can be absorbed by the filters 58 and wicked up, allowing for a longer cooling effect. Also, wicking up the excess water can result in a reduction of water spills if the evaporative air cooler 10 is moved or the drawer 50 is removed from the evaporative air cooler 10.

Figure 9:
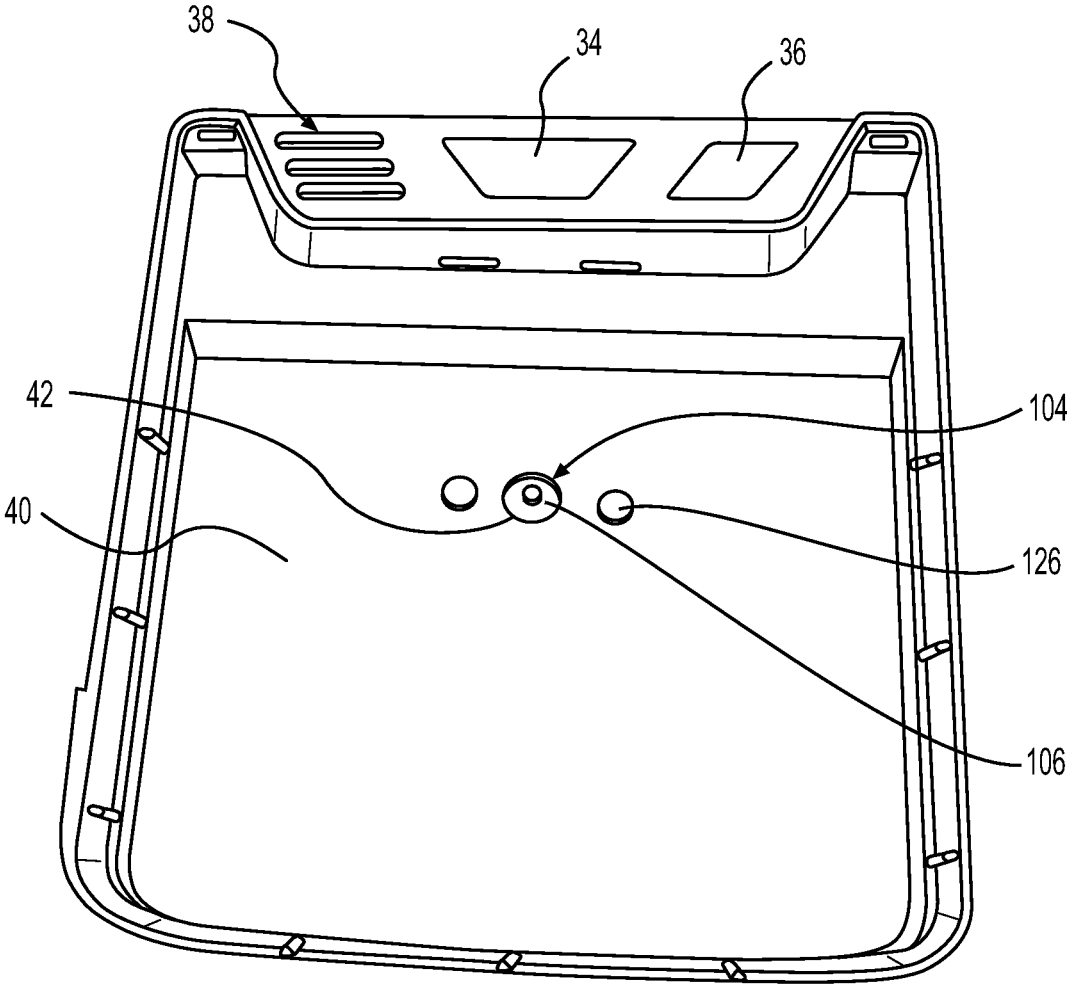
FIG. 9 generally illustrates a top view of a water tank of the evaporative personal air cooler in accordance with aspects of the present disclosure.
Figure 10:
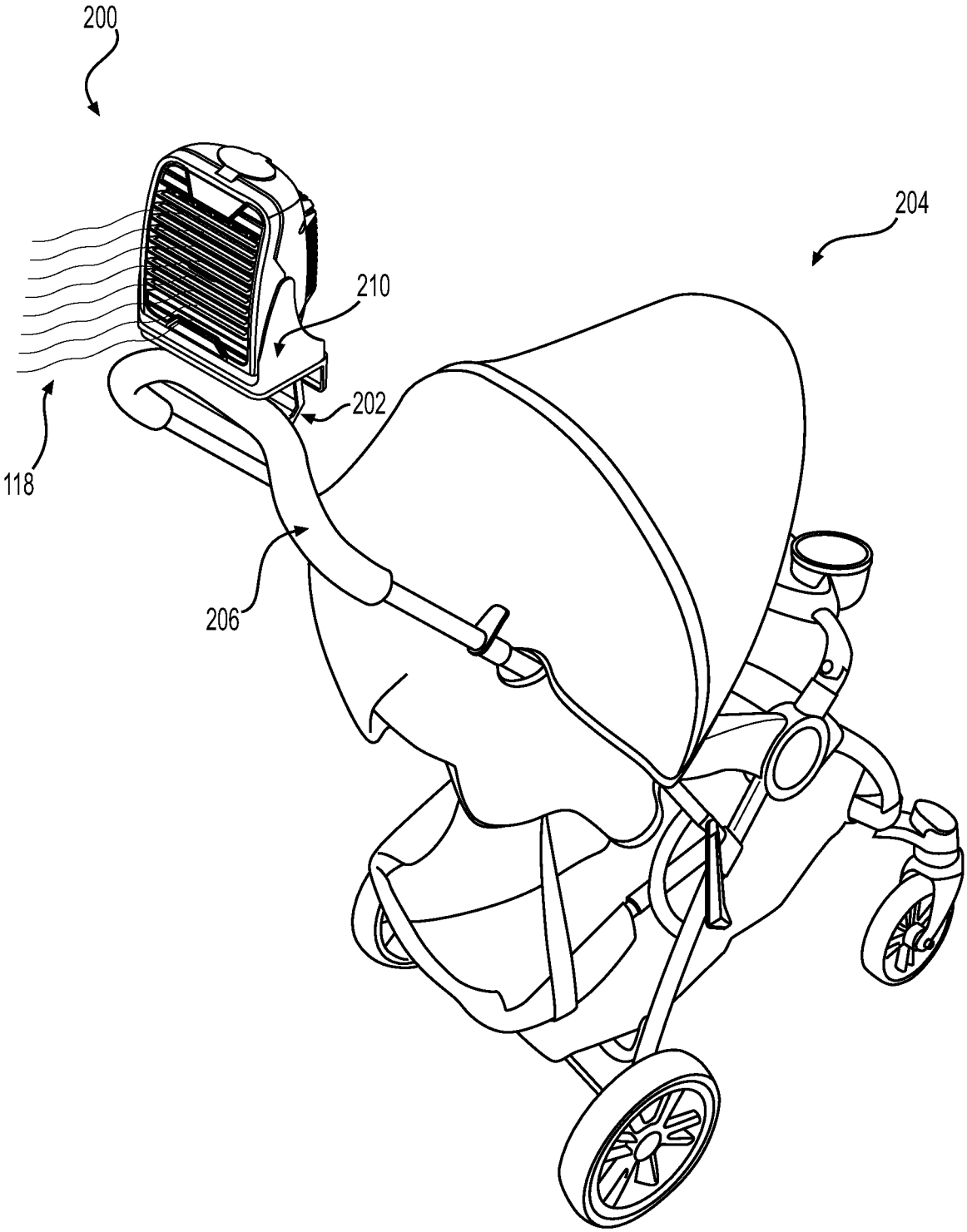
FIG. 10 generally illustrates a perspective view of an exemplary embodiment of an evaporative personal air cooler attached to an exemplary stroller in accordance with aspects of the present disclosure.
Figure 11:
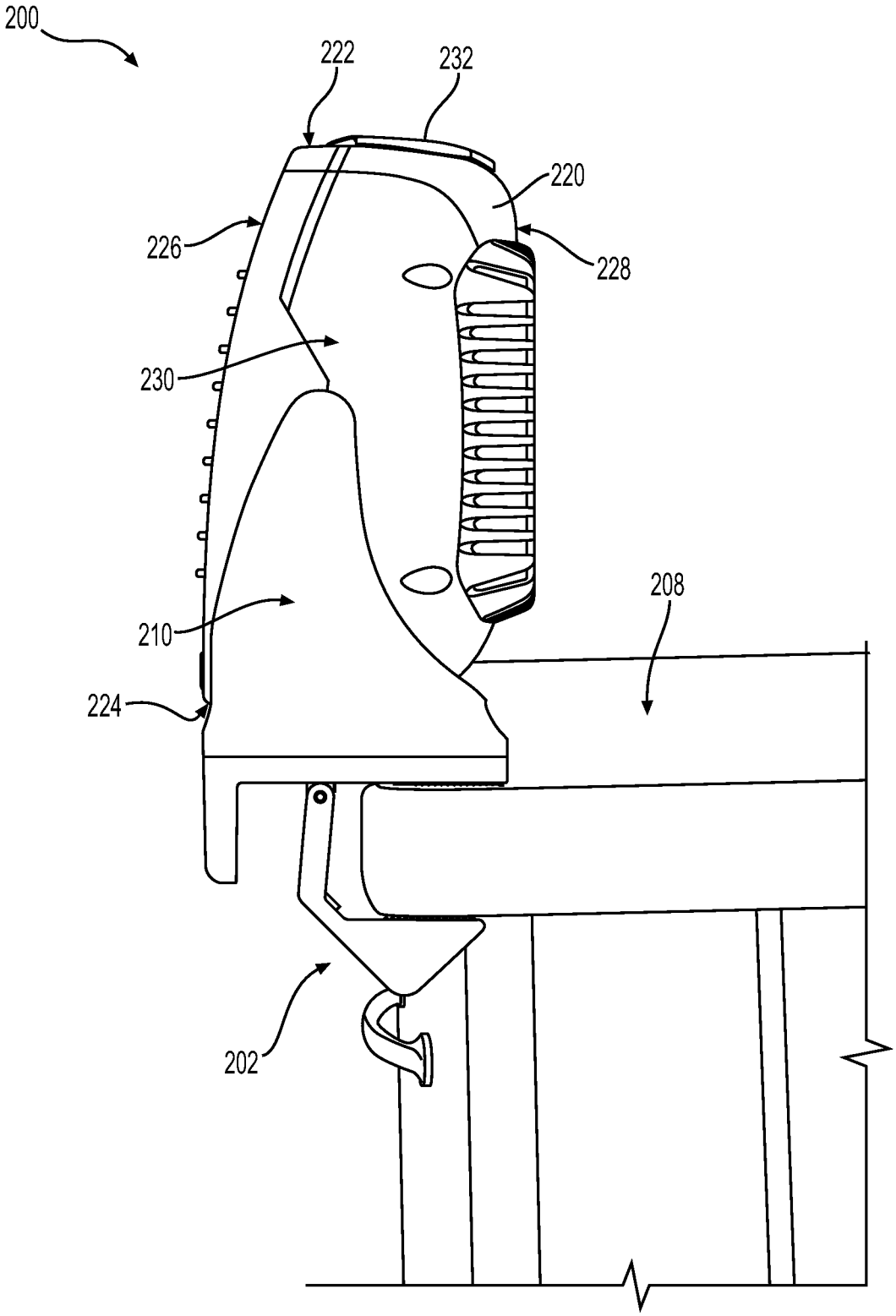
FIG. 11 generally illustrates a side view of the evaporative personal air cooler in accordance with aspects of the present disclosure.

As illustrated in FIGS. 4 and 9, the housing 20 can include a container or a tank, such as the water tank 40 positioned beneath the top face 22. Liquid, such as water, can be placed into the water tank 40. For example, when the hinged lid 32 is open, liquid can be poured into the water tank 40 using a pitcher or any other desirable means. The water tank 40 can have an opening, such as the aperture 42, to release liquid from the water tank 40 into the evaporative air cooler 10. The aperture 42 can be positioned in the bottom of the water tank 40. The aperture 42 can be positioned between the v-shaped shroud 44 and the front face 26. More specifically, the aperture 42 can be positioned between the v-shaped shroud 44 and the filter structure 56.

The evaporative air cooler 10 can use a two-stage cooling for its cooling process. The first stage can incorporate a misting structure 104. The misting structure 104 can include a microporous mister, such as a mister 106. The second stage can incorporate a filter structure 56 having an evaporative sponge filter, such as filters 58 made from sponge material 60. The combination of both stages can produce an instant cooling effect and a prolonged cooling effect.

The mister 106 can provide the instant cooling effect. For example, when the evaporative air cooler 10 is powered ON, the mist 118 begins spraying from a mister 106. The power of the fan 48 can be positioned behind the mist 118 to distribute the mist 118 into the ambient air, or air, and onto the filters 58. As the mister 106 runs for a continued period of time, the filters 58 may become more wet (e.g., damp filters). The air that encounters the mist 118 can feel cooler to the user due to the evaporative cooling process. As air continually travels through the damp filter 58, the cooling effect can be prolonged. When the liquid is depleted from the water tank 40, the mist 118 may cease but the filters 58 can remain wet for a time period, allowing at least some evaporative cooling to continue.

The misting structure 104 can be located or partially located within the water tank 40. For example, the mister 106 can be assembled through the aperture 42 of the water tank 40. The misting structure 104 can be coupled to the bottom of the water tank 40, the top internal panel 110, or any other desirable location using a misting structure coupling 126. The misting structure coupling 126 can include a screw inserted through a screw hole, or any other desirable attachment. The mister 106 can be positioned upside down within the top-filled water tank 40. The mister 106 can release the liquid downward into the interior of the evaporative air cooler 10. Liquid can be fed directly into the mister 106. The mister 106 can distribute mist 118 (e.g., moisture) to the sponge filter. By misting the filters 58 from an upper portion of the evaporative air cooler 10, the mist 118 can more effectively soak into the filters 58. The mister 106 can create an even distribution of the mist 118 to the filters 58, including to a top portion 112 of the filters 58. Walls of the water tank 40 can have angles configured to allow for an increased volume of liquid to reach the mister 106.

The mister 106 can be configured to restrict water flow from the aperture 42 when the evaporative air cooler 10 is turned OFF.

The misting structure 104 can be wired to the evaporative air cooler 10. The wires can be soldered to electrically connect the misting structure 104 to the evaporative air cooler 10, or attached in any other desirable way. The wires can be hidden in the wire compartment or any other desirable compartment within the evaporative air cooler 10.

The evaporative air cooler 10 can operate for a period of time. The period of time may depend on various factors, such as the amount of water in the water tank 40, whether the filter 58 are presoaked, whether the filters 58 were initially frozen, and a cooling mode selected based on the fan speed. In one embodiment, the evaporative air cooler 10 can operate for eight hours on the high mode, ten hours on the medium mode, and twelve hours on the low mode without refilling the water tank 40.

The evaporative air cooler 10 can include additional and/or fewer components and is not limited to those illustrated in the figures.

In an example embodiment, the evaporative air cooler 10 includes the water tank 40, the misting structure 104, the filter structure 56, and the fan 48. The water tank 40 can include the liquid inlet (e.g., via the hinged lid 32) and the liquid outlet (e.g., via the aperture 42). Liquid can enter the water tank 40 through the liquid inlet and exit the water tank through the liquid outlet. The misting structure 104 can be in liquid communication with the water tank 40. The misting structure 104 can be configured to produce mist 118 as the liquid flows through the liquid outlet. The filter structure 56 can include the plurality of filters 58 positioned substantially parallel to each other and defining air gaps 92 between the plurality of filters 58. The fan 48 can be configured to draw ambient air into the evaporative air cooler 10 and direct the ambient air through the filter structure and out of the evaporative air cooler 10. Thus, the ambient air can be cooled before exiting the evaporative air cooler 10.

The misting structure 104 can distribute the mist 118 into the ambient air and onto the plurality of filters 58. The misting structure 104 can include a mister 106. The mister 106 can be positioned adjacent the water tank 40. The mister 106 can also be positioned within the water tank 40. Liquid can flow through a top portion of the mister 106 from the water tank 40 toward a bottom portion of the mister 106. The mister 106 can project the mist 118 from the misting structure 104 into the ambient air within the evaporative air cooler 10. The mist 118 can cool the ambient air.

The misting structure 104 can produce a first volume of mist 118 when the fan 48 is at a first speed. The misting structure 104 can produce a second volume of mist 118 when the fan is at a second speed. The first volume can be larger than the second volume and the first speed can be faster than the second speed. In other words, when the fan is on high, more mist 118 can spray from the mister 106.

The evaporative air cooler 10 can include an internal assembly 74 configured to form a seal 116 with the fan 48. The seal 116 can cause the ambient air to exit the evaporative air cooler 10 with a greater force than when entering the evaporative air cooler 10. The internal assembly 74 can include at least one of the filter structure 56, and a drawer 50. The internal assembly 74 can be removably attached to the evaporative air cooler 10. The internal assembly 74 can comprises a drawer 50 attached to the outlet vent 52. The drawer 50 can include a water tray 54 angled toward the outlet vent 52. The filter structure 56 can be positioned on the water tray 54 adjacent the outlet vent 52. Any condensation or liquid in the drawer 50 can flow toward the outlet vent 52. The plurality of filters 58 can be formed from sponge-like material, such as sponge material 60. Thus, if the filter structure 56 is positioned adjacent the outlet vent 52, the plurality of filters 58 can soak up the liquid as it flows toward the outlet vent 52. If the plurality of filters 58 are at a liquid capacity, the sponge material 60 may not soak up additional liquid. The liquid in the filters 58 can be used to cool the ambient air. When the liquid in the filters 58 cools the ambient air, the liquid may evaporate from the filters 58. The filters 58 may not be at the liquid capacity after evaporation occurs and thus, can soak up more liquid.

The filter structure 56 can be configured for removal from the evaporative air cooler 10. The filter structure 56 and the plurality of filters 58 can be washable and reusable. The plurality of filters 58 can be presoaked with liquid and inserted into the evaporative air cooler 10. Presoaking the filters 58 can prolong the cooling of the evaporative air cooler 10.

The evaporative air cooler 10 can include a shroud, such as the v-shaped shroud 44, adjacent to the underside of the water tank 40. The shroud can be v-shaped or any other desirable shape.

In an example embodiment, the portable evaporative air cooler 10 for cooling ambient air includes the misting structure 104, the filter structure 56, and the fan 48. The misting structure 104 can be configured to evaporate liquid within the portable evaporative air cooler 10. The filter structure 56 can include the plurality of filters 58 configured to absorb liquid. The fan 48 can be configured to draw the ambient air into the portable evaporative air cooler 10. The ambient air can be cooled by at least one of the mist 118 and the filter structure 56. The fan 48 can direct the ambient air thorough the filter structure 56 and out of the portable evaporative air cooler 10.

The plurality of filters 58 can be formed from a sponge material 60 and positioned to define gaps, such as air gaps 92, between the plurality of filters 58. The plurality of filters 58 can be removable from the portable evaporative air cooler 10. The plurality of filters 58 can be soaked with liquid prior to entering the portable evaporative air cooler 10.

The filter structure 56 can be positioned in a drawer 50. The drawer 50 can be removable from the portable evaporative air cooler 10. The portable evaporative air cooler 10 can include a front grill, such as the outlet vent 52, with the air direction tab 72 for directing air flow and the filter drawer tab 120 for pulling the drawer 50 from the portable evaporative air cooler 10.

In an example embodiment, the personal air cooler 10 comprises the housing 20, the tank, such as the water tank 40, the misting structure 104, the filter structure 56, and the v-shaped shroud 44. The housing includes a top panel (e.g., the top face 22), a bottom panel (e.g., the bottom face 24), and side panels (e.g., the front face 26, the back face 28, and the side faces 30) that can define an interior of the personal air cooler 10. The tank can be positioned adjacent the top panel and at least one of the side panels and configured to receive, store, and release liquid. The misting structure 104 can be in fluid communication with the tank and configured to create the mist 118. The filter structure 56 can be adjacent the bottom panel and at least one of the side panels. The v-shaped shroud 44 can be positioned underneath the tank and configured to direct the mist 118 toward the filter structure 56.

The personal air cooler 10 can include the fan 48 positioned adjacent one of the side panels. The personal air cooler 10 can also include a fan cover 46 adjacent the fan 48 and configured to direct air from outside the personal air cooler 10 toward the v-shaped shroud 44. The v-shaped shroud 44 can direct mist 118 toward a top portion of the filter structure 56 and through the filter structure 56.

The filter structure 56 can include a plurality of filters 58 positioned substantially parallel to each other. Each of the plurality of filters 58 can be spaced apart a specific distance, such as 1 cm, or any other desirable distance. Thus, the plurality of filters 58 can define a plurality of air gaps 92. The plurality of filters 58 can store the mist 118. The air can be cooled by the mist 118. The cooled air can travels through the air gaps 92 and exit the personal air cooler through one of the side panels. The side panel can be the side panel adjacent the filter structure 56 and include the outlet vent 52.

FIGS. 10-19 illustrate an evaporative air cooler 200 for cooling air. The evaporative air cooler 200 can include the housing 220 with a top face 222, a bottom face 224, and four lateral faces, such as a front face 226, a back face 228, and side faces 230. The housing 220 may be formed in the shape of a cube, a cuboid, a half sphere, or any other suitable shape. The housing 220 may be formed from plastic or any other desirable material.

Figure 12:
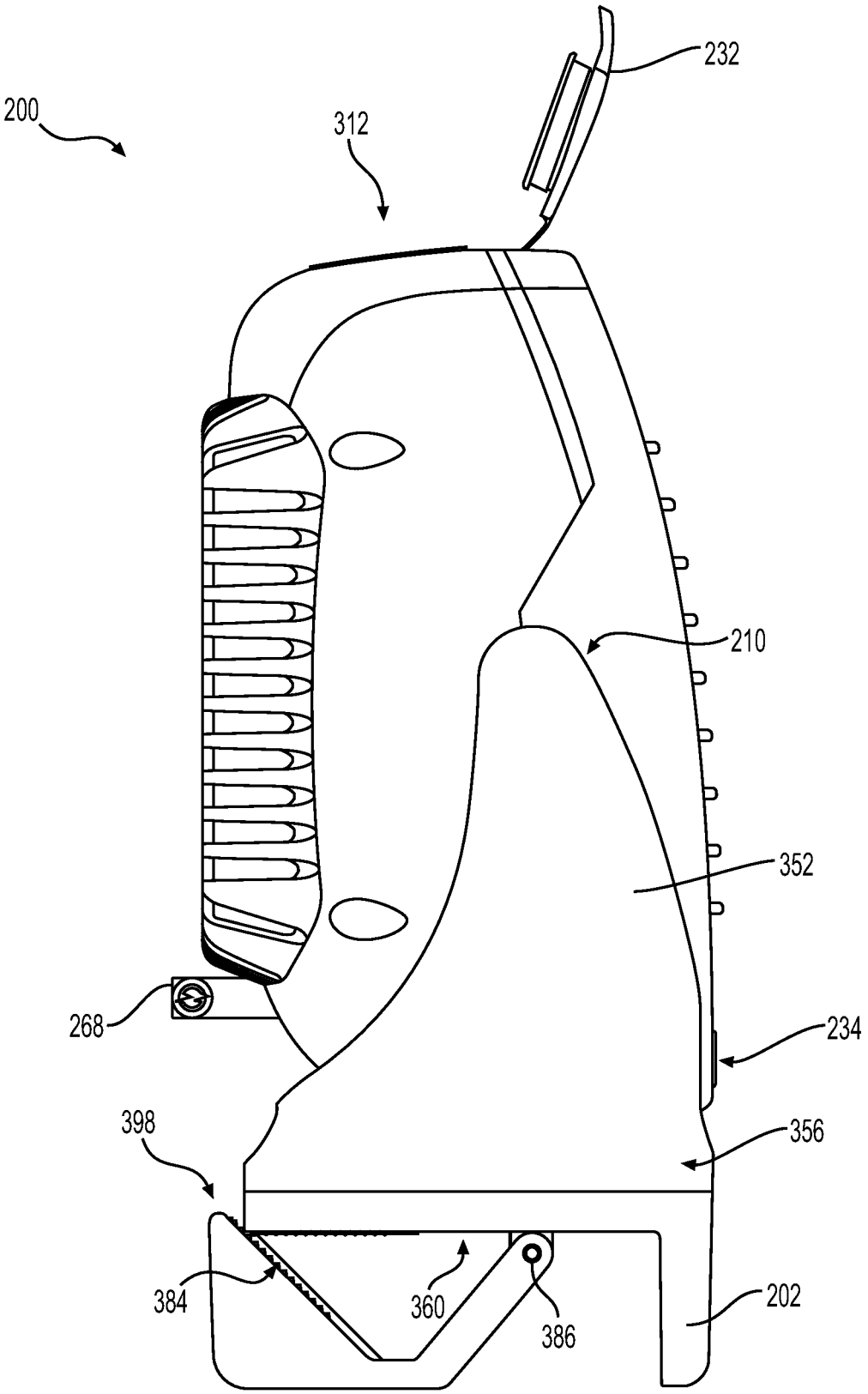
FIG. 12 generally illustrates a side view of the evaporative air cooler with a lid open in accordance with aspects of the present disclosure.
Figure 13:
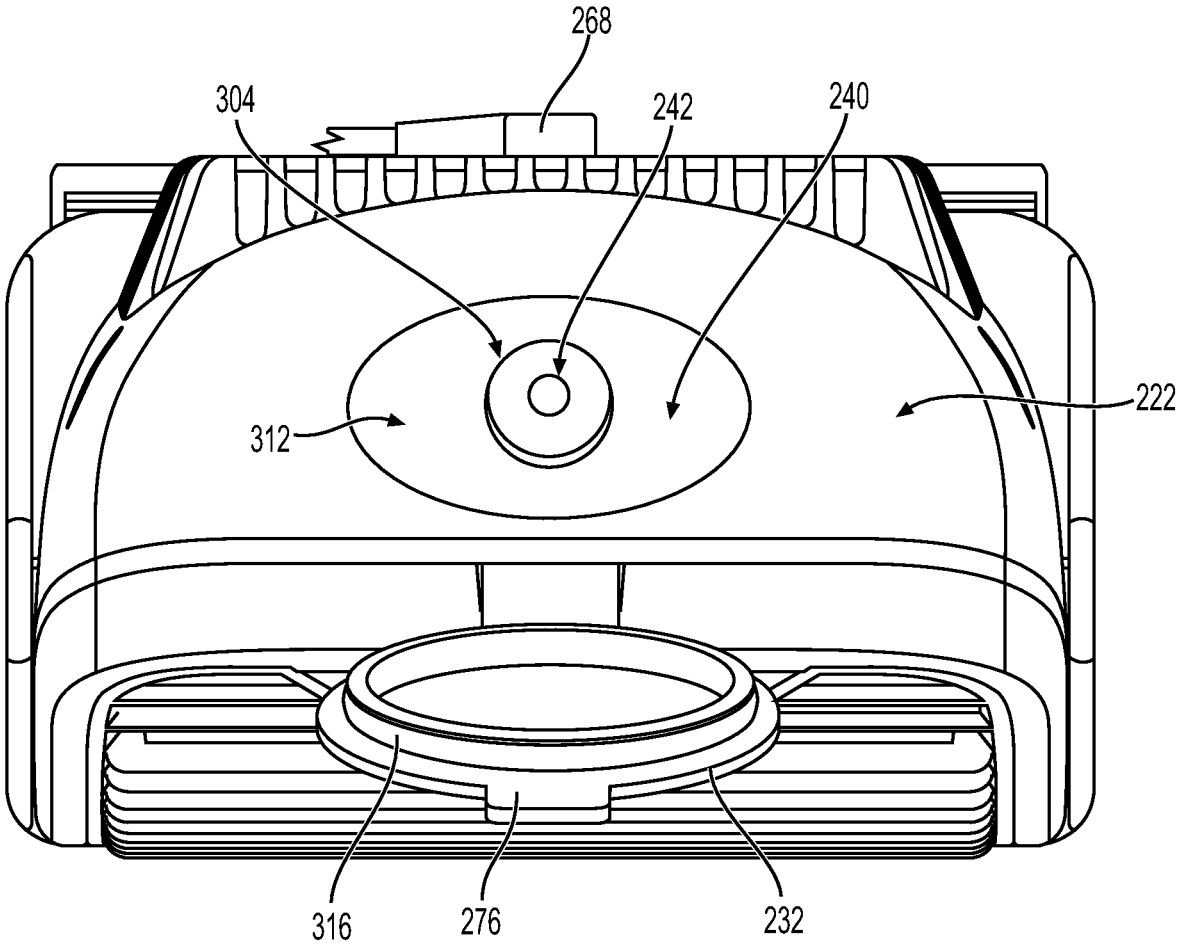
FIG. 13 generally illustrates a top view of the evaporative air cooler with the lid open in accordance with aspects of the present disclosure.

The top face 222 can include a lid, such as a lid 232. FIGS. 12 and 13 illustrate the evaporative air cooler 200 with the lid 232 opened for access to the tank 240. The lid 232 can be located along a front portion of the top face 222. The lid 232 can include a lid tab 276 formed as a back portion of the lid 232 or any other desirable location. The lid 232 can be opened to allow for water to fill the tank 240. For example, a user can pull the lid tab 276 upward to open the lid 232. The lid 232 can be formed from plastic or any other desirable material. A tank opening 244 to the tank 240 can be any desirable opening. When in a closed position, the lid 232 can be configured to form a seal over the tank opening 244. The lid 232 and the tank opening 244 may be ovular or any other suitable shape or configuration.

The front face 226 can also include buttons, such as a power button 234 or any other desirable button. The power button 234 can be configured to activate (e.g., power ON), change the fan speed of the fan 248, and deactivate (e.g., power OFF) the evaporative air cooler 200. For example, when the power button 234 is first activated, an indicator light 238 can turn ON, the fan 248 can turn ON (e.g., to a high speed), and an aperture 242 positioned in the tank 240 can allow water to flow out of the tank 240 to begin the evaporative air cooling process. When the power button 234 is activated a second time, the fan speed can decrease (e.g., to a medium speed) and the aperture 242 can allow less water to flow out of the tank 240. When the power button 234 is activated a third time the fan speed can decrease (e.g., to a low speed) and the aperture 242 can allow less water to flow out of the tank 240. When the power button 234 is activated a fourth time, the indicator light 238 can turn OFF (e.g., no indicator lights 238 remain ON), the fan 248 can turn OFF, and the aperture 242 can stop the water from flowing out of the tank 240. In other words, the power button 234 can be activated to deactivate, or power OFF the evaporative air cooler 200. In one embodiment, when the power button 234 is activated (e.g. depressed) for three or more seconds, it can turn OFF the indicator light 238 and the evaporative air cooler 200.

The front face 226 can be configured to emit one or more lights, such as an indicator light 238 or any other desirable light or indicator. The front face 226 may include a semi-transparent section, such as a window 250. The indicator light 238 may comprise one or more lights, such as a blue LED light, positioned within the tank 240, or any other desirable area for illuminating the tank 240 and/or the window 250. The light can be used for ambiance, such as for a nightlight, to indicate fan speed, to indicate that the evaporative air cooler 200 is ON, or any other desirable purpose. The light may be on by default when the evaporative air cooler 200 is powered ON. The brightness of the indicator light 238 may be configured to change. For example, after the power button 234 is pressed, the light may be on a high brightness mode. When the user presses the power button 234 for a second time, the light can reduce its brightness (e.g., to a medium brightness mode). When the user presses the light button for a third time, the light can reduce its brightness (e.g., to a low brightness mode). When the user presses the power button 234 for a fourth time, the indicator light 238 can turn OFF. In one embodiment, if the power button 234 is activated for a minimum amount of time (e.g., three seconds), an illumination setting can be selected and/or locked.

The power indicator light 236 may be used to indicate a that the evaporative air cooler 200 is low on battery, charging, or fully charged; whether the filter 258 should be replaced; or any other desirable indication. The power indicator light 236 may display a blinking light or a solid light. The power indicator light 236 may display different light colors, such as green, red, amber, or any other desirable color.

Figure 15:
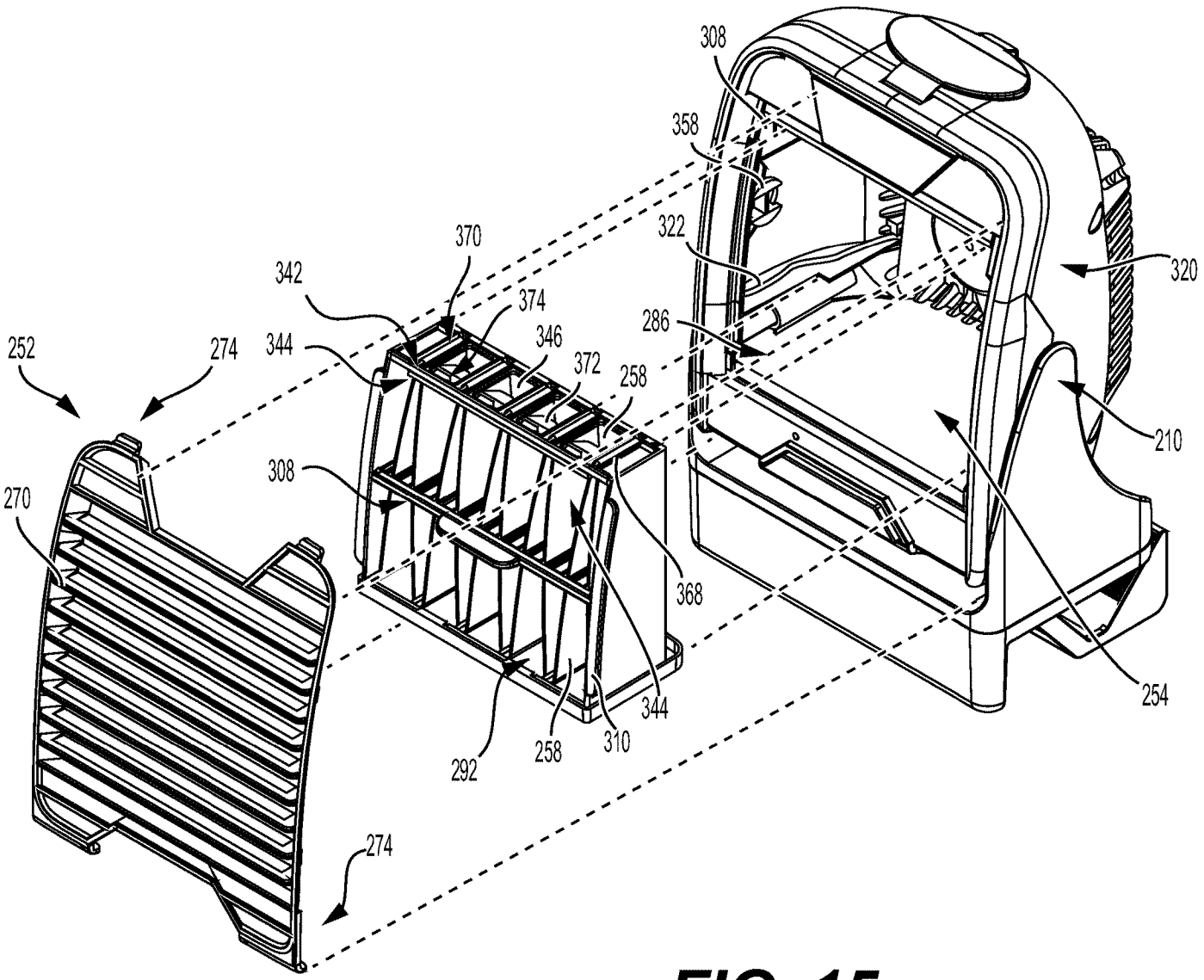
FIG. 15 generally illustrates an exploded view of the evaporative air cooler in accordance with aspects of the present disclosure.
Figure 16A:
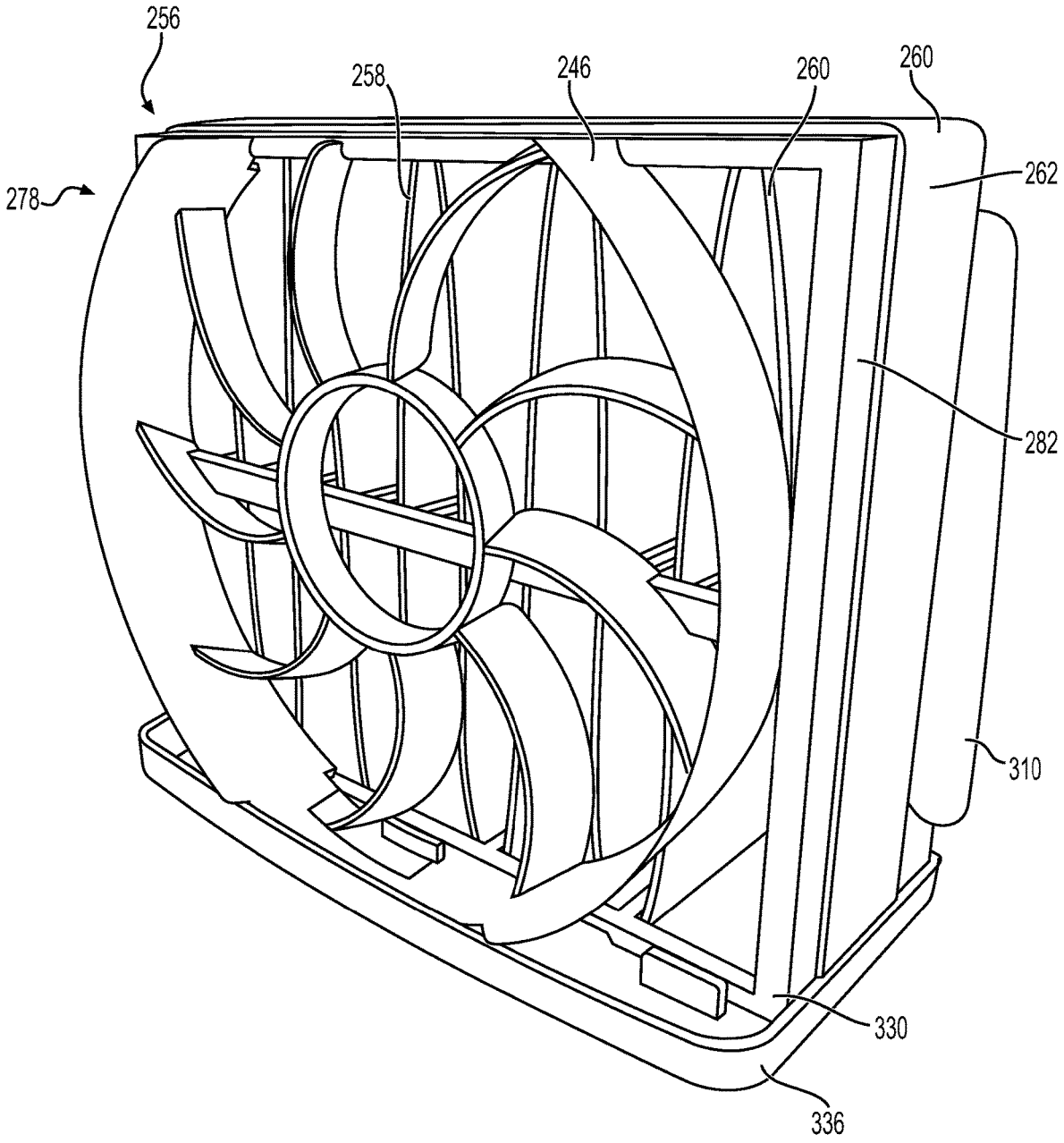
FIGS. 16A-C generally illustrate views of a filter structure of the evaporative air cooler in accordance with aspects of the present disclosure.
Figure 16B:
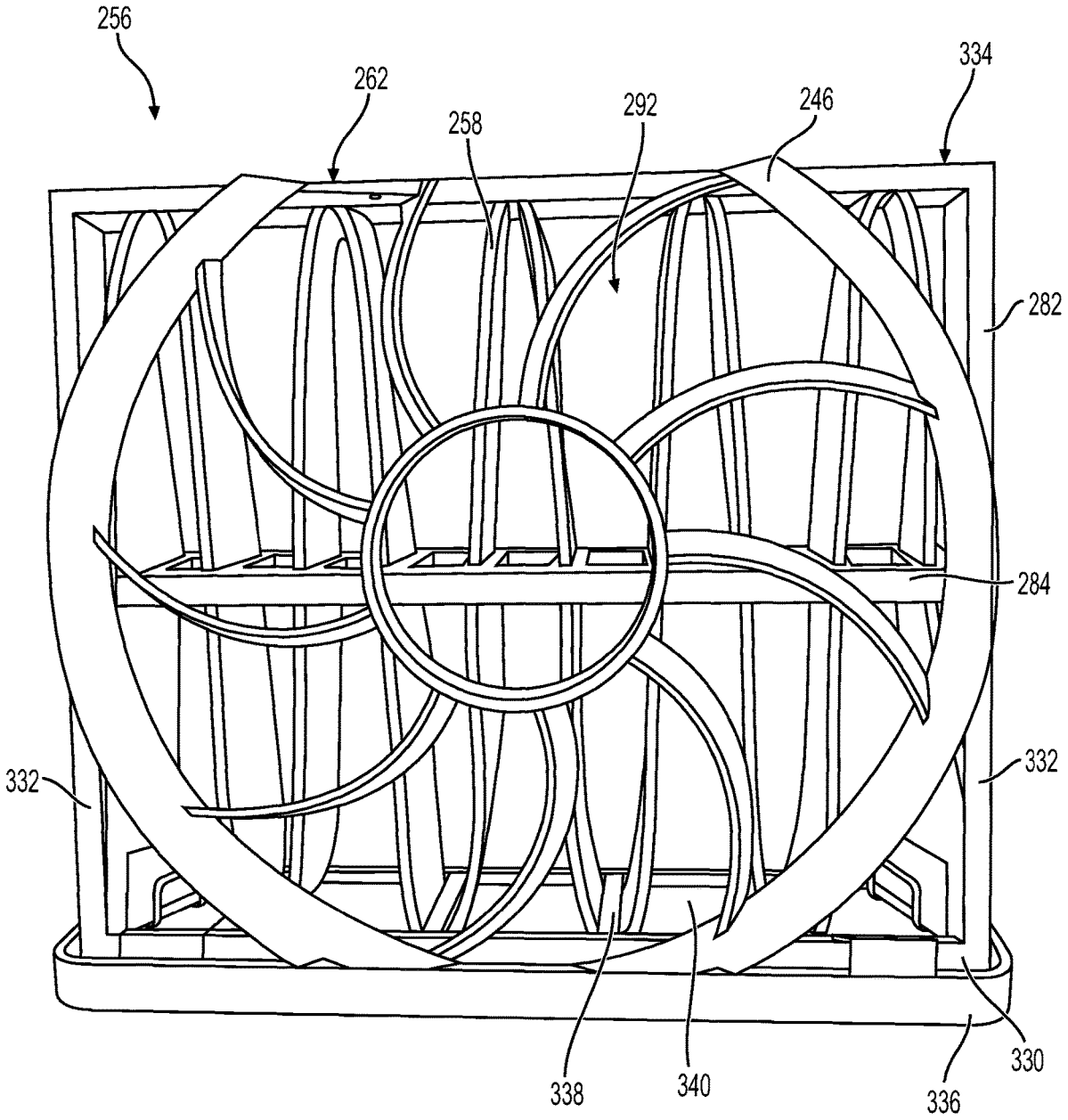
Figure 16C:
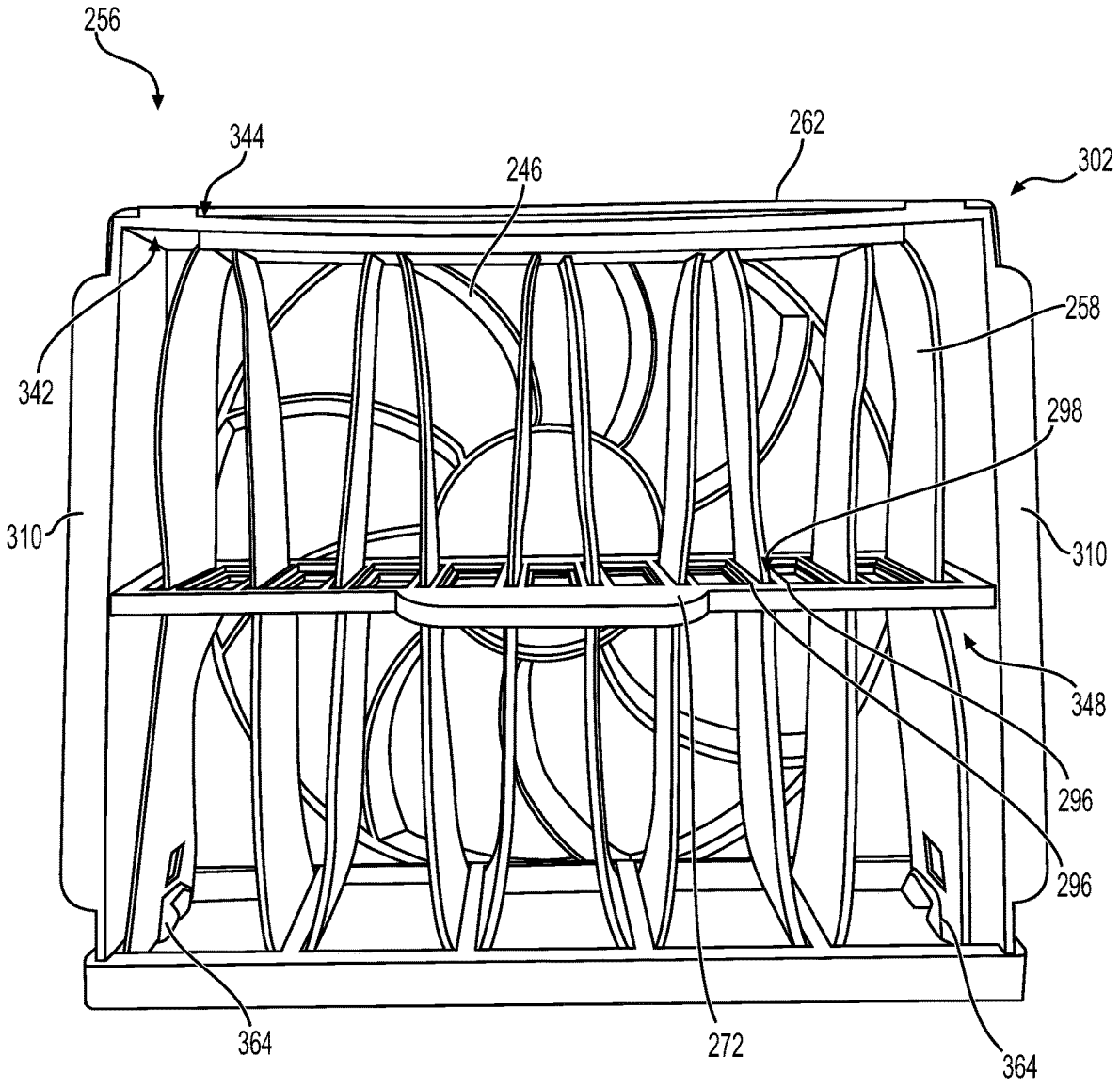

The evaporative air cooler 200 can include the housing 220. The housing 220 can define an interior 254 of the evaporative air cooler 200. The interior 254 can be configured to receive a filter structure 256. The filter structure 256 can include a filter frame 282. The filter frame 282 can be formed from plastic or any other desired material. The filter structure 256 may be square, rectangular, or any other desired shape. The filter frame 282 can include a bottom wall 330, two side walls 332, and a top wall 334. As shown in FIGS. 15 and 16A-C, the bottom wall 330 can be coupled to a base 336. The bottom wall 330 can be configured to lock into the base 336. The bottom wall 330 can include bottom bars 338 that define bottom openings 340. FIG. 15 illustrates the filter structure 256 with the second filter 262 removed. The top wall 334 can include an upper top wall 342 and a lower top wall 344. The upper top wall 342 and the lower top wall 344 can be configured to lock together. The upper and lower top walls 342, 344 can define top openings 346. The upper top wall 342 can comprise one or more slits 370 between the top openings 346. The lower top wall 344 can comprise one or more bars 368. Each of the one or more bars 368 can be positioned within one of the one or more slits 370. The lower top wall 344 can comprise one or more tabs 372. Each of the one or more tabs 372 can be positioned within one of the top openings 346. Each of the one or more tabs 372 can comprise a snap 374. The snap 374 can be configured to overlap the edge of the top opening 346. The snap 374 can be configured to secure the upper and lower top walls 342, 344 into a locked position. The upper and lower top walls 342, 344 can couple together via snaps or any other suitable means. The tabs 372 can be configured to angle downward toward a center portion of the filter structure 256. The tabs 372 can be configured to direct the mist 118, water, and the like toward the back of the filter structure 256. When the filter structure 256 is within the interior 254 of the evaporative air cooler 200, the tabs 372 can direct the water, the mist 118, and the like toward the fan 248.

The filter structure 256 can comprise one or more filters, such as filters 258, 262. The filter 258 can be positioned through one of the bottom openings 340 from one side of one of the bottom bars 338 to other side of that bottom bar 338. The filter 258 can be positioned around the top portion of one of one of the top bars 368. When the upper and lower top walls 342, 344 are in a locked position, the filter 258 and the top bars 368 are positioned within the slits 370. The filter 258 can include this configuration for each of the bars 338, 368 to form a zig-zag configuration of the filter 258. Each of the ends of the filter 258 can couple to one of the side walls 332, the bottom wall 330, or any other suitable component. For example, the side walls 332 can include hooks 364 and each of the ends of the filter 258 can include an opening configured for insertion of one of the hooks 364.

The filter structure 256 can include a filter holder 284. The filter holder 284 can be coupled to the filter frame 282. For example, the filter holder 284 can be snapped to each of the side walls 332 of the filter frame 282. The filter holder 284 can be coupled to the filter frame 282 at a middle portion of each of the side walls 332. The filter structure 256 can be configured for removal from the interior 254. The filter holder 284 can include a pull tab 272. The pull tab 272 can be positioned on a front side 348 of the filter structure 256. The pull tab 272 can be configured for a user to pull the pull tab 272 to remove the filter structure 256 from the interior 254 of the housing 220 and/or to insert the filter structure 256 into the interior 254. In this example, the user can remove a grill 252 from the housing 220 and pull the pull tab 272 to remove the filter structure 256. The filter structure 256, including the filters 258, 262 can be reusable. The filter structure 256 and the filters 258, 262 can be washed. The filter structure 256 and the filters 258, 262 can be replaced.

The interior 254 can include filter structure stoppers 308. The filters structure stoppers 308 can be coupled or formed into interior portions of the side faces 230 and/or the back face 228. The filter structure stoppers 308 can be formed from plastic or any other desired material. The filter structure stoppers 308 can be configured to position the filter structure 256 into a desired position within the interior 254. In other words, the filter structure stoppers 308 stop and/or generally hold the filter structure stoppers 308 into place adjacent to, but not touching the fan 248. As illustrated in FIGS. 15 and 16A-C, the filter structure 256 can comprise filter structure stopper tabs 310 coupled to or formed into the front side portions of the filter structure 256. The filter structure stopper tabs 310 can be formed from plastic or any other desired material. The filter structure stopper tabs 310 can be configured to position the filter structure 256 into a desired position within the interior 254. In other words, the filter structure stopper tabs 310 stop and/or generally hold the filter structure stoppers 308 into place adjacent to, but not touching the fan 248.

The filter holders 284 can include bars 296 that define openings, such as slits 298. The bars 296 of the filter holders 284 extend from one side of the filter holder 284 to the opposing side of the filter holder 284. The filter 258 can be positioned through each of the filter holders 284. The filter holder 284 can provide additional support for securing the filter 258 to the filter frame 282. The filter holder 284 can further assist in maintaining the configuration of the filter 258 in the zig-zag formation when the filter 258 is dry, damp, wet, or a combination thereof.

A second filter 262 can be coupled to at least a portion of a perimeter 302 of the filter structure 256. In one embodiment, the second filter 262 is positioned adjacent the outer perimeter 302 of the top wall 334 and the side walls 332. Each of the ends of the second filter 262 can be coupled to the a bottom portion of each of the side walls 332. For example, the side walls 332 can include hooks 364 and each of the ends of the second filter 262 can include an opening configured for insertion of one of the hooks 364. The second filter 262 can be configured to absorb the mist 118. The second filter 262 can be formed from the same material as the filter 258, such as the sponge material 260, or any other suitable material. The second filter 262 can be in fluid communication with the filter 258. The filter 258 can absorb the liquid and/or mist 118 absorbed by the second filter 262. For example, portions of the filter 258 can be positioned through the top wall 334 of the filter structure 256 and are adjacent to the second filter 262 positioned adjacent to the top wall 334 (e.g., along the perimeter 302 of a portion of the filter frame 282). The filters 258, 262 may be touching or in close proximity to each other. The second filter 262 can be coupled to the two side walls 332, the bottom wall 330, any other suitable wall, or combination thereof. In one embodiment, the filters 258, 262 are the same filter. In another embodiment, the second filter 262 is not included in the filter structure 256.

The filter 258 can be configured in a zig-zag formation and define air gaps 292. The filter 258 can be configured to store liquid, such as mist 118, water, any other suitable liquid, or combination thereof. The filter is configured to absorb the mist 118 from the mister, absorb liquid from being pre-soaked, store liquid via being frozen, or any other suitable means to absorb or store liquid. The air gaps 292 are configured to allow for air to flow through the filter structure 256, contact the filters 258, 262 to cool the air, and exit the interior 254.

The filter structure 256 can include a fan cover 246. The fan cover 246 can be coupled to a back side 278 of the filter structure 256. The fan cover 246 can be positioned adjacent the fan. The fan cover 246 can be configured to direct air from the fan toward the filter structure 256. The fan cover 246 can be configured to form a suction with the fan, such as to provide additional force in directing the air from outside of the housing 220 through the fan cover 246, the filter structure 256, and the grill 252. In this way, the fan cover 246 can be configured to direct air flow through the interior 254 of the evaporative air cooler 200.

The fan 248 can be positioned adjacent one of the sides of the housing 220, such as the back face 228. The fan 248 can be configured to draw the air into the evaporative air cooler 200, such as through grate openings 300 in the back face 228 of the housing 220. The air can be cooled by at least one of the mist 118 and the filters 258, 262. The fan 248 can include blades 264. The fan 248 may include four blades 264 or any other suitable number of blades. The fan 248 may include a motor 266. The motor 266 can be used to control the fan 248 to rotate the blades 264. The motor 266 can rotate the blades 264 at various speeds. The speed of rotation of the blades 264 can change the amount (e.g., volume) of air and the speed for which the air flows through the filter structure 256 and out of the interior 254 of the evaporative air cooler 200. The evaporative air cooler 200 can include different levels of speed, each of which can be configured to direct air. A higher level may direct a larger amount of air at a first speed. A mid-range level may direct a mid-range amount of air at a second speed. A lower level may direct a lower amount of air at a third speed. The first speed may be greater than the second speed. The second speed may be greater than the third speed. The evaporative air cooler 200 can be configured to have predefined speeds, a variable speed, or any combination thereof.

The fan 248 can be wired to the evaporative air cooler 200. The wire 322 can be soldered to electrically connect the fan 248 to the evaporative air cooler 200, or attached in any other desirable way. The wire 322 can be hidden in a wire compartment or any other desirable compartment within the evaporative air cooler 200.

Figure 18:
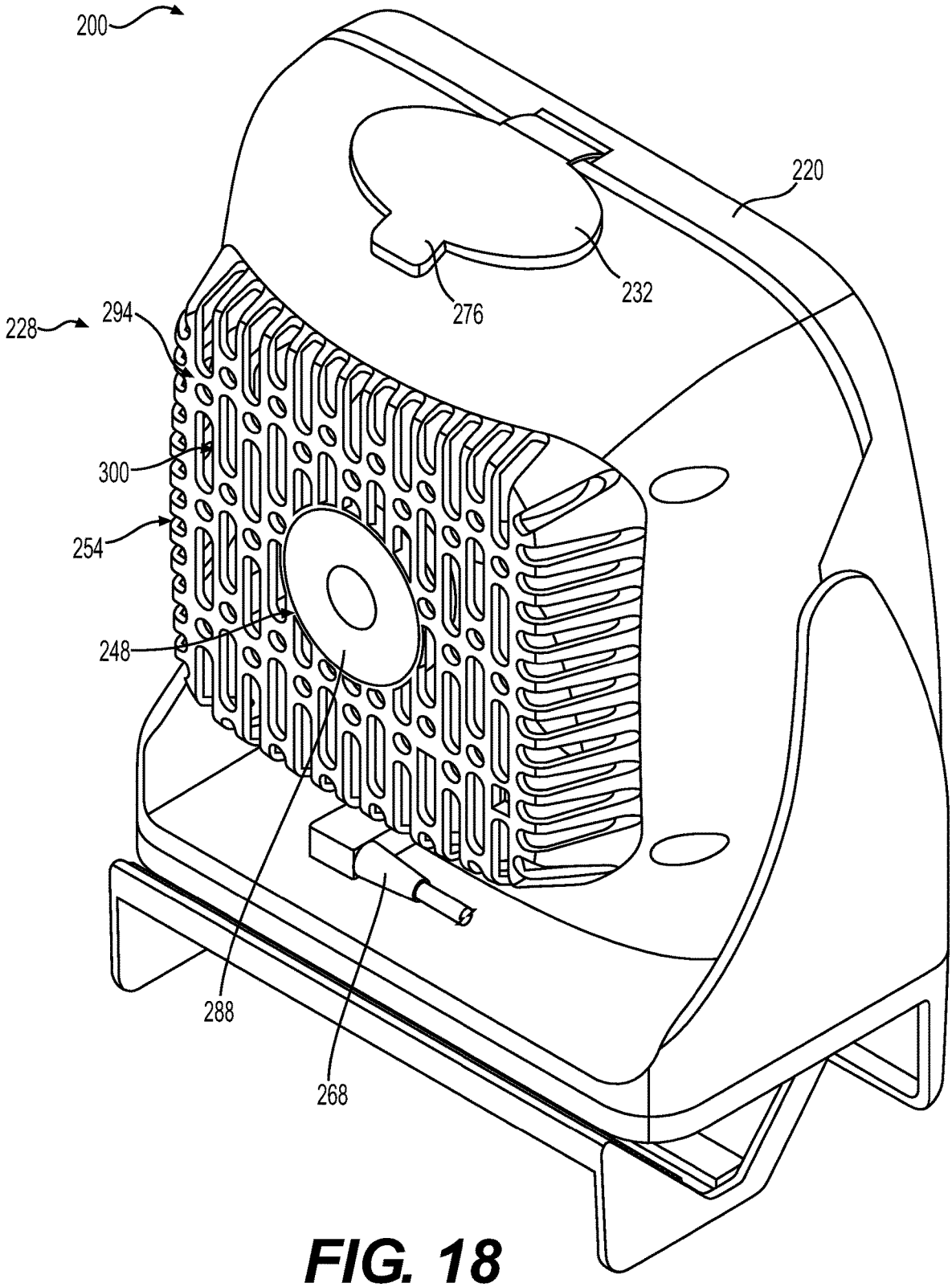
FIG. 18 generally illustrates a back perspective view of an evaporative air cooler in accordance with aspects of the present disclosure.
Figure 19:
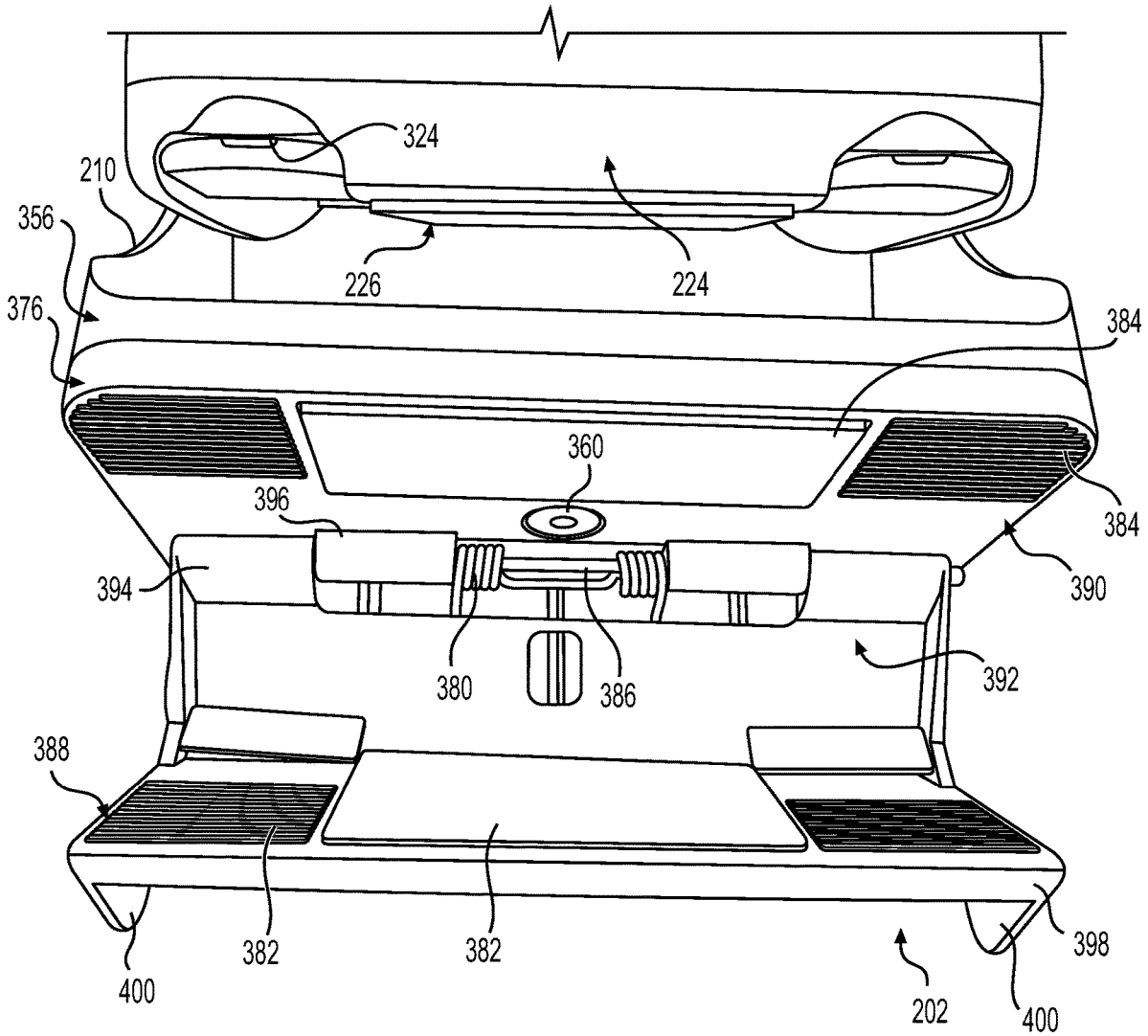
FIG. 19 generally illustrates a perspective view of a clip of an evaporative air cooler in accordance with aspects of the present disclosure.
Figure 20:
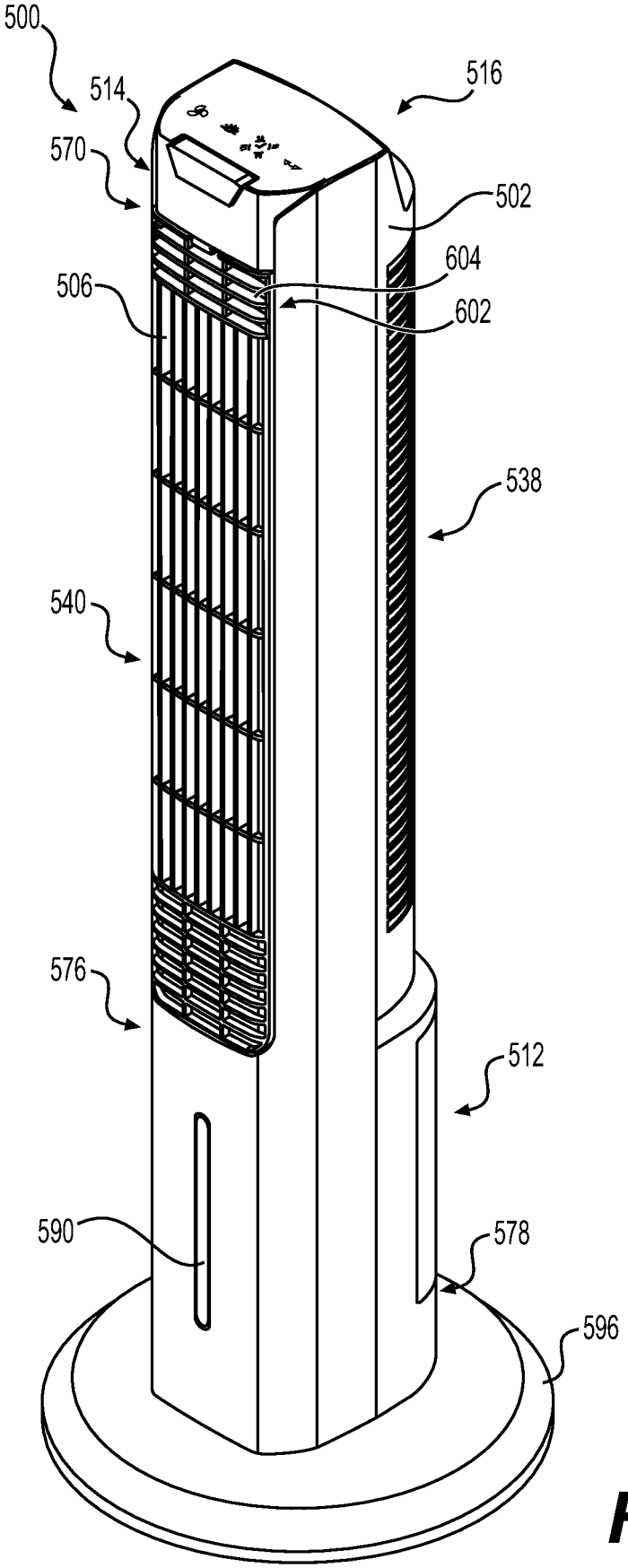
FIG. 20 generally illustrates a perspective view of an exemplary embodiment of an evaporative air cooling tower attached to an exemplary stroller in accordance with aspects of the present disclosure.

As illustrated in FIG. 18, the back face 228 can include a grate 294 defining grate openings 300. The grate openings 300 can be configured throughout the grate 294. The grate 294 can be a portion of the back face 228, such as a central portion of the back face 228. The grate 294 can be a rectangle, a square, a circle, an oval, or any other suitable shape. The grate openings 300 can include one or more shapes (e.g., circular, rectangular, ovular, any other suitable shape, or combination thereof). Air, such as ambient air, can enter from outside of the housing 220 through the grate openings 300 of the grate 294 and into the interior 254 of the evaporative air cooler 200. The grate 294 may be configured to protrude from the back face 228. The fan 248 can be coupled to the back face 228. More specifically, the grate 294 may include a fan coupling 288 to couple to the fan 248. The protrusion of the grate 294 from the back face 228 can be configured for housing the fan 248.

The evaporative air cooler 200 can be powered by a power source, such as a battery or any other suitable power source. The battery can be a rechargeable battery, such as a Lithium-ion battery (LIB) or any other rechargeable power source. The evaporative air cooler 200 can include a charging port (not shown) to charge the rechargeable battery. The charging port can be disposed on the back face 228 or any other desirable location on the evaporative air cooler 200. The charging port (not shown) can be configured to receive the charger 268. The evaporative air cooler 200 can operate using a rechargeable battery and/or when plugged into an electrical outlet.

Figure 14:
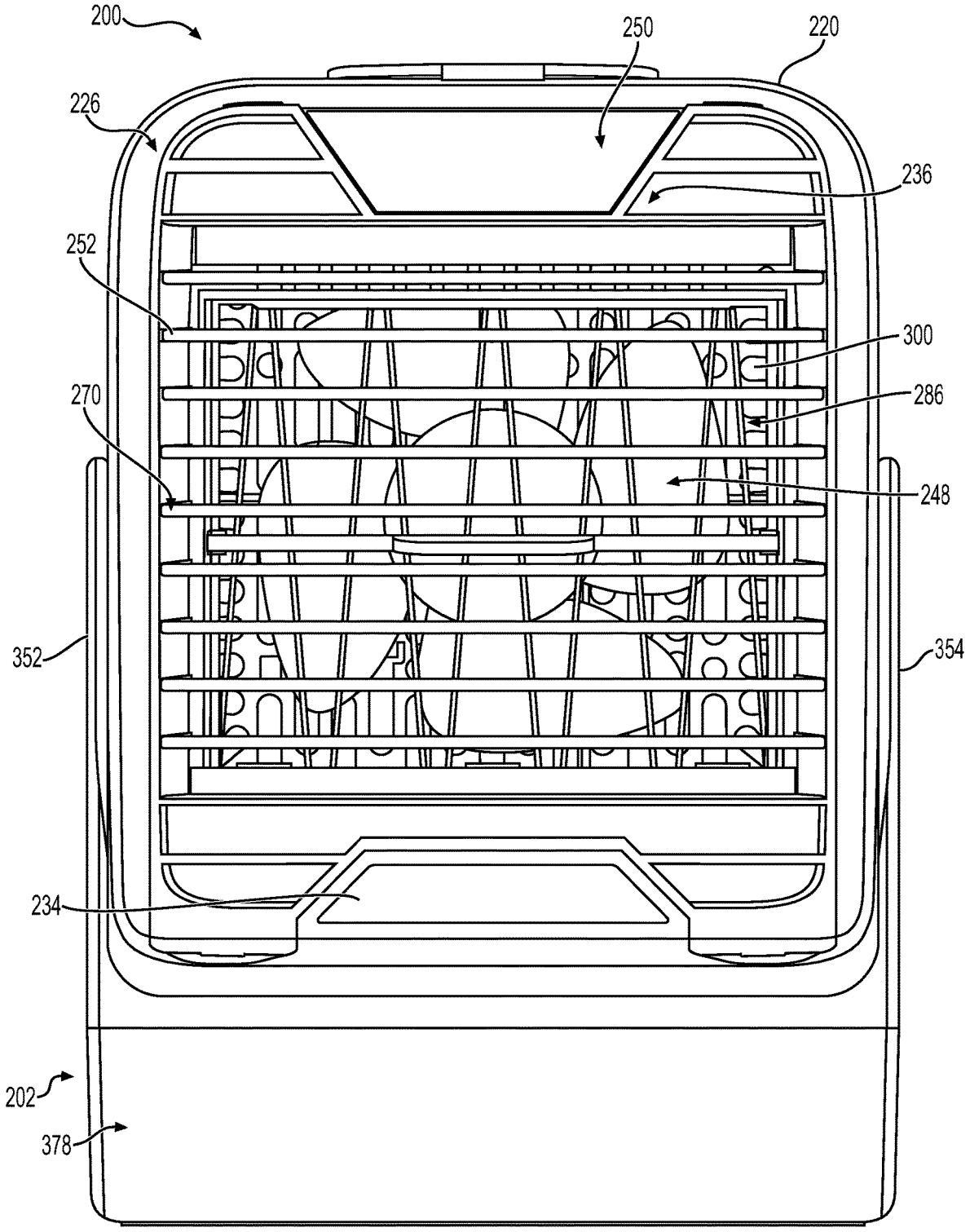
FIG. 14 generally illustrates a front view of the evaporative air cooler in accordance with aspects of the present disclosure.
Figure 17:
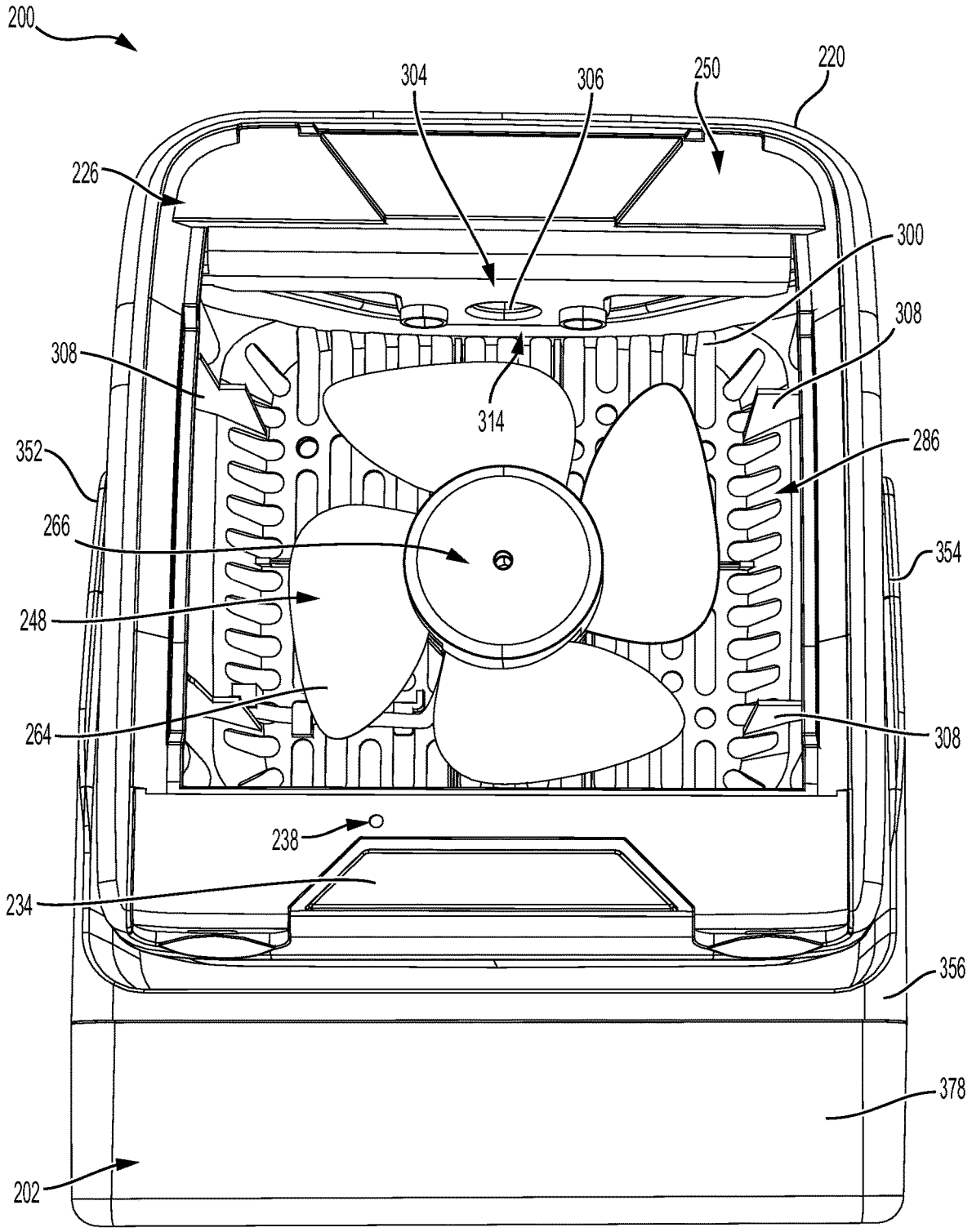
FIG. 17 generally illustrates a front perspective view of the evaporative personal air cooler after the internal assembly is removed in accordance with aspects of the present disclosure.

As illustrated in FIGS. 14 and 17, the front face 226 of the housing 220 may define an opening, such as a front opening 286. The grill 252 can be coupled to the front face 226 to cover the front opening 286. The grill 252 may include grill tabs 274 configured to secure the grill 252 to the housing 220. The grill tabs 274 may be couple to or formed into the grill 252. The grill tabs 274 may be positioned in each of the corners of the grill 252. The grill 252 can be configured to removably couple to the front face 226 of the housing 220. Each of the grill tabs 274 can be inserted into one of the openings 324 in the housing 220. The openings 324 can be located in the bottom face 224, the front face 226, or any other desired location in the housing 220. When coupled to the housing 220, the grill 252 can provide a front side to the housing 220. The grill 252 can include vents 270 (e.g., bars). The vents 270 may be configured in a horizontal configuration, an angled configuration, any other suitable configuration, or combination thereof. The vents 270 may be stationary. The vents 270 can be configured to rotate. Each of the vents 270 may be aligned parallel to one another such that the vents 270 are configured to allow for air to pass through the vents 270.

The evaporative air cooler 200 can include an angling member 210. The angling member can be coupled to the housing 220. The angling member can include arms 352, 354 and a base 356. A first arm can be rotatably coupled to one of the side faces 230 of the housing 220. A second arm 354 can be rotatably coupled to the opposing side face 230. In one embodiment, the first and second arms 352, 354 couple to a center portion of the side faces 230. The arms may be coupled to the sides via a coupling 358, such as a ratchet system or any other desired rotatable attachment. The angling member can be configured to rotate the housing 220. The angling member can rotate the housing 220 to position the housing 220 in an angle that a user desires. The angling member can be configured to rotate the housing 220 in a vertical direction. The angling member 210 can be configured to rotate the housing 220 360 degrees. The angling member 210 can maintain a position, or angle, of the housing 220 relative to the angling member 210. For example, if a user would like the evaporative air cooler 200 to blow cool air toward the user's face, the user may rotate the housing 220 upward to direct the cooled air upward. Similarly, the user can rotate the housing 220 downward to direct the cooled air downward. The arms 352, 354 can be coupled to the sides such that the housing 220 is stationary and cannot be rotated about the arms.

The first and second arms 352, 354 can protrude from either side of the base 356. The first and second arms 352, 354 can be formed with the base 356 or coupled to the base 356. The base 356 can be formed from plastic or any other suitable material. The base 356 can be coupled to a clip 202 via a coupling 360, such as a ratchet system or any other desired rotatable attachment. The coupling 360 can be configured to rotate housing 220 via the base 356 in either direction (e.g., to the right or to the left) 360 degrees or any other desirable degree rotation.

The evaporative air cooler 200 can include a fastener, such as the clip 202. The clip 202 can be a device that is rotatable or worked by a spring 380 for holding an object or objects together or in place. For example, the clip 202 can be configured to removably couple the evaporative air cooler 200 to the handle 206 of the stroller 204, the countertop 208, a desk, a table, or any other suitable object. The clip 202 may include grips 382, 384 on one or more components of the clip 202. For example, the grip 382 may be configured on a grip side 388 of the clip 202 and the grip 384 may be configured on a grip side 390 of a clip base 376. The grips 382, 384 can be configured to more securely attach the evaporative air cooler 200 to the object. The grips 382, 384 can be formed from rubber, plastic, or any other desired material. The grips 382, 384 may be formed as ridges and/or a smooth surface. The smooth surface may be configured to protect the object to which the clip 202 attaches to, such that the clip 202 does not damage (e.g., scrape, scratch, etc.) the object.

The clip 202 can be coupled to the clip base 376 via a coupling 392. The coupling 392 can comprise a rod 386 configured for insertion into rod holders 394, 396. The rod holders 394 can be coupled to or formed at the end of one of the sides of the clip. The rod holders 396 can be coupled to or formed on the grip side 390 of the base. Each of the rod holders 394, 394 can define an opening for the rod 386 to insert through. A spring 380 can define an opening be configured for the rod 386 to insert through. The spring 380 can provide tension to the clip 202 relative to the clip base 376. In a closed position, the clip 202 may be configured such that one end of the clip 202 (e.g., a grip end 398) extends further than the clip base 376. The grip end 398 is configured for a user to rotate the clip 202 by exerting force on the grip end 398 to rotate the clip 202 about the coupling 392. The user can open the clip 202 for an object to be inserted into the clip 202. When the user releases the clip 202, the tension provided by the spring 380 couples the clip 202 to the object and secures the evaporative air cooler 200 into the desired place.

The clip 202 can include one or more support members 400. The one or more support members 400 can be configured on opposing sides of the clip 202, along the clip 202, or any other desired position. The one or more support members 400 can be configured to support the evaporative air cooler 200 in an upright position when the clip 202 is in a closed position. In other words, the one or more support members 400 support the evaporative air cooler 200 so that the evaporative air cooler 200 does not easily tip over when it is placed on a surface. Similarly, the clip base 376 may comprise a front face 378 configured to provide support for the evaporative air cooler 200 when the evaporative air cooler 200 is placed on a surface (e.g., with the clip in the closed position). The front face 378 may protect components of the coupling 392 from being damaged. For example, the front face 378 can stop the clip 202 from being rotated too far such that the spring 380 is overextended.

The clip 202 can be coupled to the angling member 210. Specifically, the clip base 376 can be coupled to the base 356 of the angling member. 210 The clip base 376 can be rotatably coupled to the base 356, such as to a bottom portion of the base 356. The clip base 376 may be coupled to the base 356 via the coupling 360, such as a ratchet system or any other desired rotatable attachment. The base 356 can be configured to rotate the housing 220 about the clip base 376 in a horizontal direction. The base 356 can rotate about the clip base 376 in either direction horizontally 0-360 degrees. For example, a user can attach the evaporative air cooler 200, via the clip 202, to the countertop 208. The user can rotate the housing 220 of the evaporative air cooler 200 horizontally, via the base 356, toward the user. The user can further rotate the housing 220 vertically, via the angling member 210, toward the user. In this way, when the evaporative air cooler 200 is turned on, the cooled air can be directed toward the user. In another embodiment, the housing 220 can be coupled to the angling member 210 and the base 356 can be coupled to the clip base 376 such that the housing 220 is stationary and cannot be rotated in horizontal and/or vertical directions.

As illustrated in FIGS. 13 and 14, the evaporative air cooler 200 can include a tank 240. The tank 240 can be positioned adjacent to a top face 222 of the housing 220. Portions of the interior of the top face 222, the front face 226, the back face 228, and the side faces 230 of the housing 220 may form portions of the tank 240. For example, the tank 240 can be configured within the housing 220 such that the top portion of the tank 240 is an underside of the top face 222 of the housing 220. The tank 240 can include a front side and a bottom side coupled to the housing 220. The front side and the bottom side of the tank 240 may comprise the window 250. A light, such as the power indicator 236 can be disposed adjacent to the bottom side of the tank 240, or any other desired location. The bottom side of the tank 240 and the front portion of the tank 240 may comprise the window 250 and be configured to emit light produced by the power indicator 236 throughout the tank 240. The power indicator 236 may also be configured to emit light into the interior 254 and toward the outside of the evaporative air cooler 200.

The tank 240 can include a liquid inlet 312 and a liquid outlet 314. The top portion of the housing 220 can define an opening, such as liquid inlet 312. The liquid inlet 312 can be ovular, circular, or any other desirable shape. The bottom portion of the tank 240 can define an opening, such as the liquid outlet 314. The liquid outlet can be ovular, circular, or any other desirable shape. The liquid outlet 314 can be positioned in the bottom of the tank 240. The liquid outlet 314 can be positioned in a central location in the bottom of the tank 240. The liquid outlet can be positioned adjacent a filter structure 256. The liquid outlet 314 can be configured to receive a misting structure 304 comprising a mister 306. Liquid, such as water, can enter the tank 240 through the liquid inlet 312 and exit the tank 240 through the liquid outlet 312. In response to the liquid flowing through the liquid outlet 314, the mister 306 can be configured to create, from the liquid, a mist in the interior 254 of the evaporative air cooler 200.

As illustrated in FIGS. 12 and 13, a lid 232 can be coupled to the top face 222, or any other suitable portion of the housing 220. The lid 232 can be coupled to the top face 222 via a hinge, a cord, or any other suitable attachment. A portion of the lid 232 can be configured to fit within the liquid inlet 312. For example, if the liquid inlet 312 is an oval shape, the lid 232 can be a slightly smaller oval shape so as to fit within the liquid inlet 312 and form a seal 316 when the lid 232 is in a closed position. The lid 232 may include an ovular seal 316 to form a seal with the liquid inlet 312 such that liquid remains in the tank 240. The lid 232 may be formed from plastic or any other desirable material. The seal 316 may be formed from rubber or any other desirable material. The tank 240 can be configured to receive, store, and release liquid. For example, when the lid 232 is open (see FIG. 13), liquid can be poured into the tank 240 using a pitcher, a faucet, a water bottle, or any other desirable filling means.

The mister 306 can be positioned adjacent the tank 240. The mister 306 can be coupled to the liquid outlet 314. The mister 306 can be in fluid communication with the tank 240. Liquid can flow through a top portion of the mister 306 from the tank 240 toward a bottom portion of the mister 306. The mister 306 can be configured to create the mist 118 from the liquid stored in the tank 240. The mister 306 can distribute the mist 118 into the air into the interior 254 of the evaporative air cooler 200 and onto a filter, such as the second filter 262. The mist 118 can cool the air within the interior 254.

When the evaporative air cooler 200 is operating, the mister 306 can produce mist 118. For example, the mister 306 can be configured to create a first volume of mist 118 when a fan 248 is at a first speed. The mister 306 can be configured to create a second volume of mist 118 when the fan 248 is at a second speed (the aperture 242 of the misting structure 304 can allow less water to flow out of the tank 240). The mister 306 can be configured to create a third volume of mist 118 when the fan 248 is at a third speed. The first volume can be greater than the second volume and the first speed can be faster than the second speed. In other words, when the fan 248 is on high, a higher volume of mist 118 can spray from the mister 306. Similarly, the first and second volumes can be greater than the third volume and the first and second speeds can be faster than the third speed. The evaporative air cooler 200 can have a button, such as the power button 234, for controlling the speed of the fan 248. For example, when the power button 234 is engaged a first time, the fan 248 can operate at the first speed. When the power button 234 is engaged for a second time, the fan 248 can operate at the second speed. When the power button 234 is engaged for a third time, the fan 248 can operate at the third speed. When the power button 234 is engaged for a fourth time, the fan 248 can turn off (i.e., to end operation of the fan 248). The evaporative air cooler 200 may have any number of speeds and is not limited to those described in this disclosure. The evaporative air cooler 200 can have a light (e.g., the power indicator 236), such as an LED light or any other desired light, to indicate that the evaporative air cooler 200 is operating. The power indicator 236 can be configured to indicate the speed of operation.

The evaporative air cooler 200 can include a safety interlock 320. The safety interlock 320 can be configured to prevent operation of the evaporative air cooler 200. For example, if at least one of the grill 252 and the filter structure 256 is removed from the housing 220, the safety interlock 320 can shut off operation of the evaporative air cooler 200. The safety interlock 320 can function as a safety feature such that a user does not touch the blades of the fan while the fan is spinning in operation.

In one embodiment, the evaporative air cooler 200 for cooling air comprises the housing 220, the tank 240, the mister, the filter structure 256, the fan, and a clip 202. The housing 220 defines the interior of the evaporative air cooler 200. The tank 240 is positioned adjacent to the top portion of the housing 220. The tank 240 is configured to receive, store, and release liquid. The mister is configured to be in fluid communication with the tank 240. The mister is configured to create a mist 118 from the liquid. The mist 118 can be created in the interior. The filter structure 256 includes a filter. The filter is configured to absorb the mist. The fan is configured to draw the air into the interior. The air is cooled by at least one of the mist 118 and the filter. The fan directs the air through the filter structure 256 and out of the evaporative air cooler 200. The clip 202 coupled to the housing 220. The angling member coupled to the housing 220. The angling member is configured to rotate the housing 220. The angling member is configured to rotate the housing 220 in at least one of a vertical direction and a horizontal direction. The angling member is configured to rotate the housing 220 0-360 degrees in a vertical direction. The angling member is configured to rotate the housing 220 0-360 degrees in a horizontal direction. The clip 202 is configured to removably couple the evaporative air cooler 200 to an object. This embodiment may have fewer or additional features and is not limited to this configuration.

In some embodiments, the evaporative air cooler 200 for cooling air comprises the housing 220, the tank 240, the mister, the filter structure 256, the fan, and a clip 202. The housing 220 defines the interior of the evaporative air cooler 200. The tank 240 is positioned adjacent to the top portion of the housing 220. The tank 240 is configured to receive, store, and release liquid. The mister is configured to be in fluid communication with the tank 240. The mister is configured to create a mist 118 from the liquid. The mist 118 can be created in the interior. The filter structure 256 includes a filter and a second filter. The filter and the second filter are configured to absorb the mist. The filter is configured in a zig-zag formation and defines air gaps. The second filter is coupled to at least a portion of a perimeter 302 of the filter structure 256. The second filter is in fluid communication with the filter. The fan is configured to draw the air into the interior. The air is cooled by at least one of the mist, the filter, and the second filter. The fan directs the air through the filter structure 256 and from the interior. The clip 202 coupled to the housing 220. This embodiment may have fewer or additional features and is not limited to this configuration.

FIGS. 20-26 generally illustrate an evaporative air cooling tower 500 in accordance with aspects of the present disclosure. The evaporative air cooling tower 500 can include a housing 502 defining an interior 504 of the evaporative air cooling tower 500. The housing 502 may be formed of plastic or any other desired material. The evaporative air cooling tower 500 can be formed in a tower shape or any other desired shape. The housing 502 may be configured to couple to a base 596. The housing 502 may comprise a handle 600. The handle 600 may be configured for a user to hold onto a portion of the housing 502 to transport the evaporative air cooling tower 500 to another location. The evaporative air cooling tower 500 can include a grill 506 coupled to the housing 502 and defining openings 508. The evaporative air cooling tower 500 can include a tank 510 positioned adjacent to a bottom portion 512 of the housing 502. The tank can be configured to receive and store liquid. The evaporative air cooling tower 500 can include a tray 514 positioned adjacent to a top portion 516 of the housing 502. The tray 514 may be formed from plastic or any other desired material. The tray 514 may be removably coupled to the housing 502. One or more portions of the tray 514 may be formed from one or more portions of the housing 502 (e.g., at top portions 516 of front, rear, and side walls of the housing 502). The tray 514 can be configured to receive and release the liquid. The tray 514 can comprise an outlet 594. The outlet 594 may be configured to release liquid from the tray 514 to the filter tray 570. The evaporative air cooling tower 500 can include a hose 518 in fluid communication with the tank 510 and the tray 514. The evaporative air cooling tower 500 can include a pump 520 configured to pump the liquid from the tank 510 to the tray 514 through the hose 518. The evaporative air cooling tower 500 can include a filter structure 522 comprising a filter 524 configured to receive the liquid from the tray 514. The evaporative air cooling tower 500 can include a fan 528 configured to draw air into the interior 504. The air can be cooled by the filter 524 and directed out of the interior 504 through the openings 508. In some embodiments, the tray 514 is a filter tray 570 and the hose 518 is in fluid communication with the filter tray 570.

Figure 23:
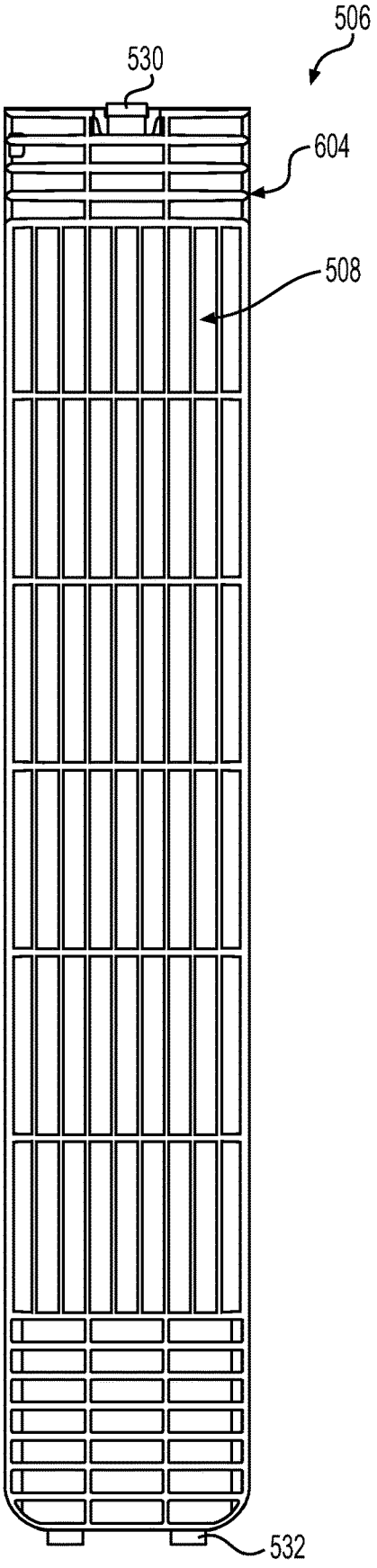
FIG. 23 generally illustrates a grill of the evaporative air cooling tower in accordance with aspects of the present disclosure.

As generally illustrated in FIG. 23, the grill 506 may be substantially rectangular in shape, or any other desired shape. The grill 506 may be formed of plastic or any other suitable material. The grill 506 may include a plurality of openings positioned adjacent to one or more openings. The openings 508 may be rectangular in shape, any other shape, or combination thereof. The grill 506 may define one or more sets of openings 508. The sets of openings 508 may include a plurality of openings 508 that are substantially rectangular openings of about the same size, each of which are positioned adjacent to one or two openings 508 of the set of openings 508. The set of openings 508 can be positioned between two sides of the grill 506. Each of the plurality of the sets of openings 508 may be positioned adjacent to one or two of the sets of openings 508. In some embodiments, the grill 506 may include six sets of openings 508, each of which includes seven openings 508. The quantity of sets of openings 508 and the opening 508, may include additional and/or fewer sets of openings 508 and/or openings 508 and are not limited to the examples in this disclosure. The openings 508 may comprise different sizes and shapes from other openings 508. The grill 506 may be configured to removably couple to the housing 502. The openings 508 can be configured for air to flow through. For example, when the evaporative air cooling tower 500 is turned on, the fan 528 can direct air from the interior 504 out of the evaporative air cooling tower 500 through one or more of the openings 508. The grill 506 may include fixed vent or a directional vent. The positions of the openings 508 defined by the grill 506 can be configured to direct the flow of the air expelled from the interior 504.

The grill 506 may include a pull tab 530 and one or more grill tabs 532 configured to couple the grill to the housing 502. The grill 506 may couple to the housing at a front portion 540 of the housing. The grill 506 may be configured to cover an interior opening 542. When the grill 506 is removed from the housing 502, the filter structure 522 can be accessed and removed from the interior 504. The housing 502 can be configured to receive the pull tab 530 and the one or more grill tabs 532. The pull tab 530 may be configured to depress for removal of a portion of the grill 506 from the housing 502. The grill 506 can be configured to rotate relative to the housing 502. The one or more grill tabs 532 can be removed from the housing 502, such as by sliding the grill tabs 532 from the housing 502. For example, the housing 502 may define openings configured for receiving the grill tabs 532. The grill tabs 532 may couple to the housing 502 by sliding into the openings, snapping into the openings, or by any other fastening device.

Figure 21:
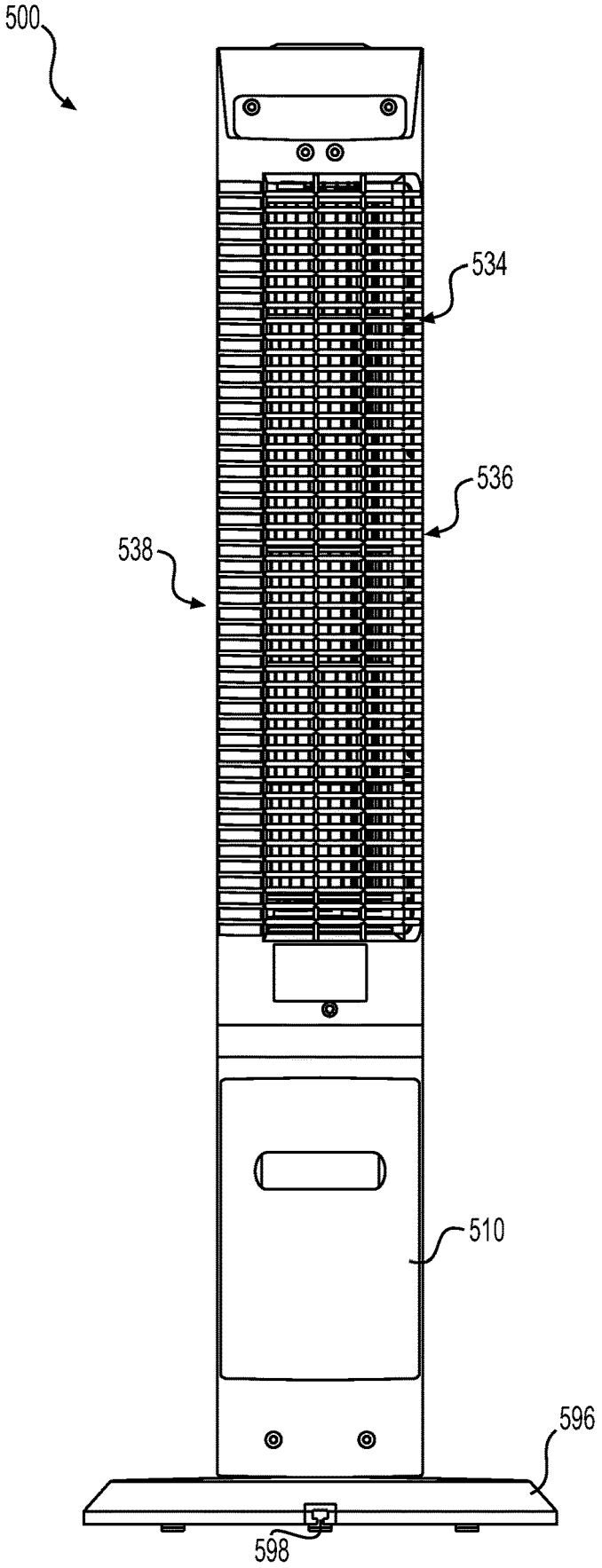
FIG. 21 generally illustrates a back view of the evaporative air cooling tower in accordance with aspects of the present disclosure.

As generally illustrated in FIG. 21, the evaporative air cooling tower 500 may include a fixed grill 534. In some embodiments, the fixed grill 534 may be formed into the housing 502. In some embodiments, the fixed grill 534 may be coupled to the housing 502 and may be fixed to or removable from the housing 502. The fixed grill 534 may be positioned at a back portion 538 of the housing. The back portion 538 may be a curved portion of the housing 502. The fixed grill 534 may be curved to form a curve of the housing 502. The fixed grill 534 may be formed of plastic or any other suitable material. The fixed grill 534 may include a plurality of openings positioned adjacent to one or more openings. The fixed grill openings 536 may be rectangular in shape, any other shape, or combination thereof. The fixed grill openings 536 may be curved. The fixed grill 534 may define one or more sets of fixed grill openings 536. The sets of fixed grill openings 536 may include a plurality of fixed grill openings 536 that are substantially rectangular openings of about the same size, each of which are positioned adjacent to one or two fixed grill openings 536 of the set of fixed grill openings 536. The set of fixed grill openings 536 can be positioned between two sides of the fixed grill 534. Each of the plurality of the sets of fixed grill openings 536 may be positioned adjacent to one or two of the sets of fixed grill openings 536. In some embodiments, the fixed grill 534 may include forty-eight sets of fixed grill openings 536, each of which includes three fixed grill openings 536. The quantity of sets of fixed grill openings 536 and the opening 508, may include additional and/or fewer sets of fixed grill openings 536 and/or fixed grill openings 536 and are not limited to the examples in this disclosure. The fixed grill openings 536 may comprise different sizes and shapes from other fixed grill openings 536. The fixed grill openings 536 can be configured for air to flow through. For example, when the evaporative air cooling tower 500 is turned on, the fan 528 can direct air from outside of the housing 502 into the interior 504 of the evaporative air cooling tower 500 through one or more of the fixed grill openings 536.

Figure 24:
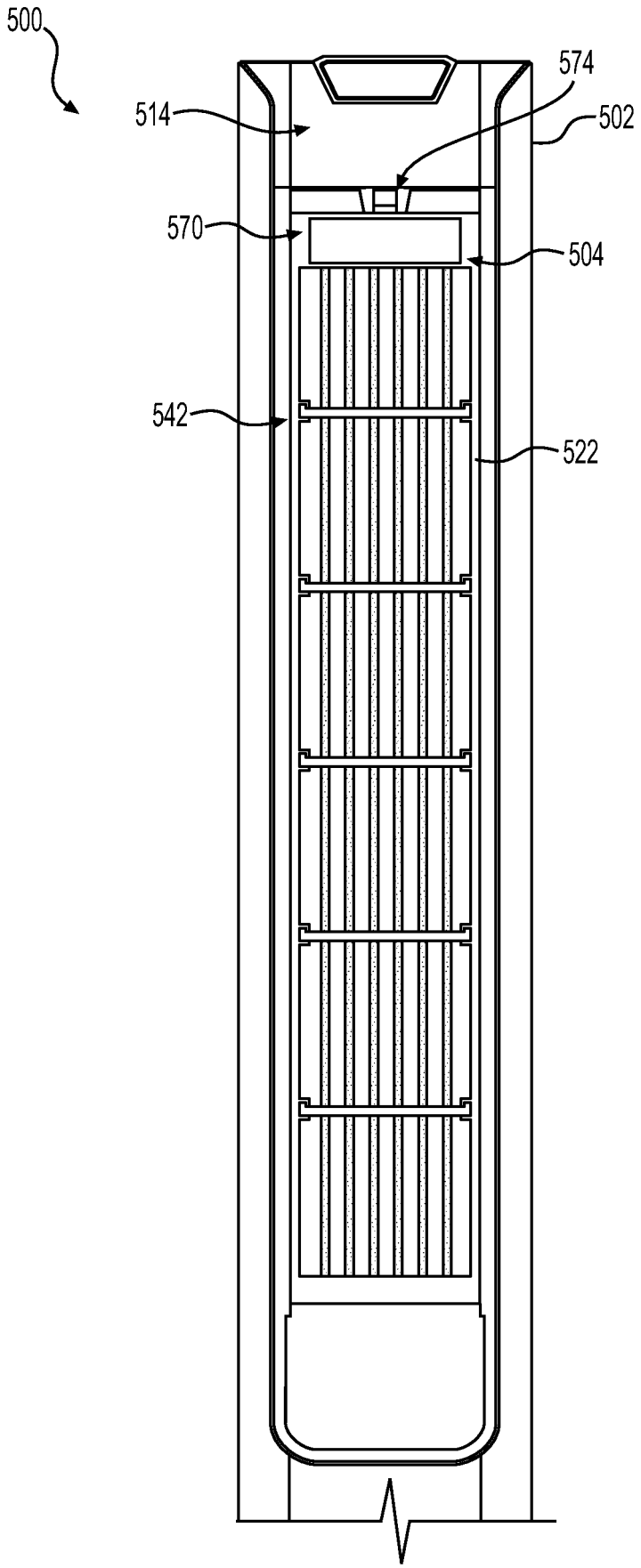
FIG. 24 generally illustrates a partial front view of the evaporative air cooling tower with the grill removed in accordance with aspects of the present disclosure.
Figure 25A:
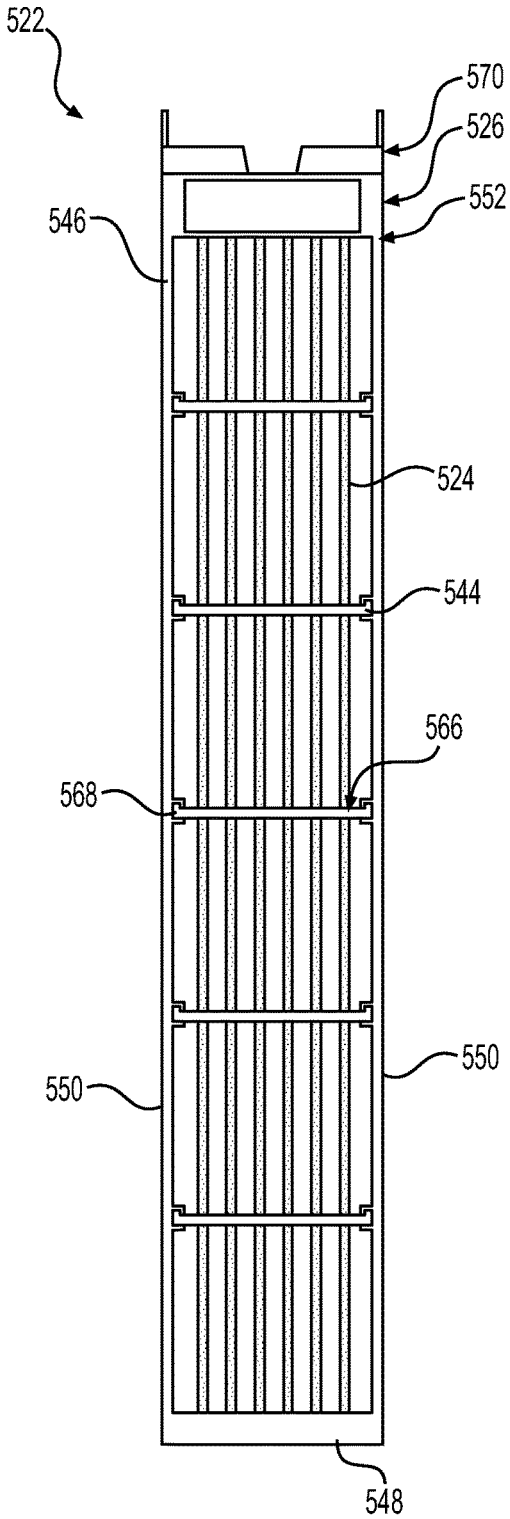
FIGS. 25A-E generally illustrate views of a filter structure of the evaporative air cooling tower in accordance with aspects of the present disclosure.
Figure 25B:
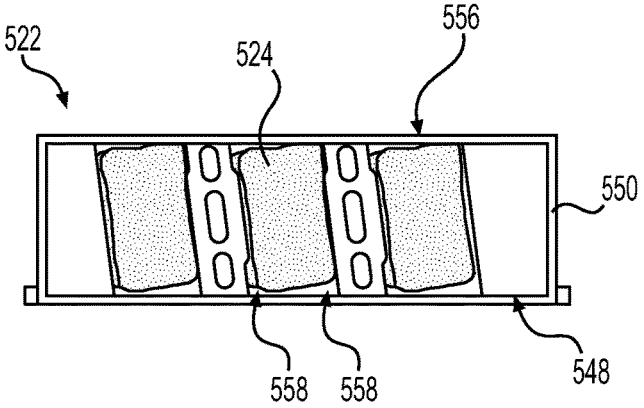
Figure 25C:
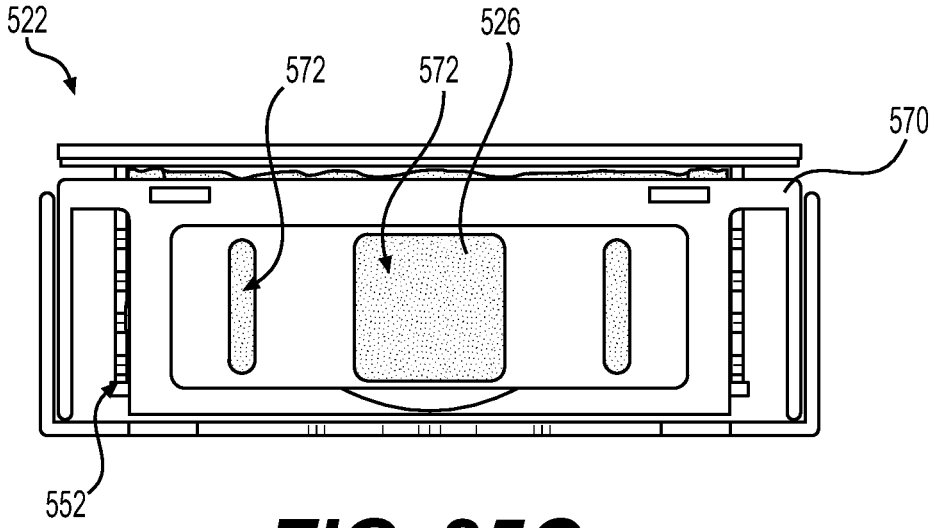

The evaporative air cooling tower 500 can include the housing 220. The housing 220 can define an interior 504 of the evaporative air cooling tower 500. As generally illustrated in FIG. 24, the interior 504 can be configured to receive the filter structure 522. As generally illustrated in FIG. 25A, the filter structure 522 can comprise a filter frame 546. The filter frame 546 may be formed from plastic or any other suitable material. The filter frame 546 may be formed in a rectangular shape or any other suitable shape. The filter structure 522 via the filter frame 546 may comprise a bottom wall 548, two side walls 550, and a top wall 552. As generally illustrated in FIG. 25B, the bottom wall 548 can define openings and include bottom bars 556 positioned within the openings to define bottom slits 558. The bottom wall 548 can be configured for the filter 524 to be received through one of the bottom slits 558, around side and bottom portions of an adjacent bottom bar 556 and through an adjacent bottom slit 558. As generally illustrated in FIG. 25E, the top wall 552 can define openings and include top bars 560 positioned within the openings to define top slits 562. The top wall 552 can be configured for the filter 524 to be received through one of the top slits 562, around side and bottom portions of an adjacent top bar 560 and through an adjacent top slit 562. The bottom wall 548 and the top wall 552 can be configured such that a first bottom slit 558 substantially aligns with a first top slit 562, a second bottom slit 558 substantially aligns with a second top slit 562, and so forth such that the filter 524 can be received by each of the bottom and top slits 558, 562. The filter 524 may be a single filter that loops around the bottom and top bars 556, 560. Each of the ends of the filter 524 can couple to the filter structure 522. For example, each of the ends of the filter 524 can couple to the side walls 550, the top wall 552, the bottom wall 548, any other suitable portion of the filter structure 522, or combination thereof. The filter 524 may be configured within the filter structure 522 in a coil shape, an "s" shape, or any other desired shape or configuration. In some embodiments, the filter 524 comprises more than one filter configured to couple to and/or be secured by bottom and top walls 548, 552. The filter 524 can be coupled to the filter structure 522 using an adhesive, such as glue, tabs, snaps, or any other desired coupling.

As generally illustrated in FIGS. 25A and 25E, the filter structure 522 can comprise one or more filter holders 544. The filter holders 544 can be positioned between the two sides (e.g., side walls 550) of the filter structure 522. The filter holders 544 may be coupled to the side walls 550 via filter holder couplings 568. For example, one end of the filter holder 544 may be coupled to one of the side walls 550 at a first filter holder coupling 568. An opposing end of the filter holder 544 may be coupled to an opposing side wall 550 at a second filter holder coupling 568. The filter holders 544 may define filter holder slits 566. The filter holder slits 566 can define a rectangular opening adjacent to two circular openings. The filter holder slits 566 may define openings in any desired shape or combination of shapes. The filter holder slits 566 can be configured to receive the filter 524. The filter holder slits 566 can be configured to secure a portion of the filter 524 in a place. The filter holder 544 may include a plurality of filter holder slits 566. The filter holder slits 566 may align substantially vertically with filter holder slits 566 defined by other filter holders 544 coupled to the filter frame 546. In some embodiments, the filter structure 522 comprises five filter holders 544, each comprising six filter holder slits 566. The filter 524 can be received through each of the filter holder slits 566, such that the filter 524 is received through substantially aligned filter holder slits 566 in a first direction through the first filter holder slits 566 of each of the filter holders 544, received through substantially aligned filter holder slits 566 in a second direction through the second filter holder slits 566 of each of the filter holders 544, received through substantially aligned filter holder slits 566 in the first direction through the third filter holder slits 566 of each of the filter holders 544, and so forth until the filter is received through each of the filter holder slits 566. In this configuration, the filter 524 is positioned in columns between the two side walls 550 of the filter structure 522. The filter holders 544 may define slits (e.g., filter holder slits 566) for receiving the filter 524, such that the filter holder slits 566 are positioned between 5-85 degrees relative to at least one of the two sides (e.g., the two side walls 550). The angle of the filter holder slits 566 can configure the filter 524 to be positioned at an angle relative to the two side walls 550. When the filter 524 is not substantially parallel to one or more of the side walls 550, air that flows through the filter structure 522 may be directed by the fan 528 to come in contact with a greater area of the filter 524. The more contact the air has with the filter 524, the more efficient the evaporative air cooling tower 500 can function. If the angle of the filter 524 relative to the side walls 550 is 90 degrees (e.g., substantially perpendicular to the side walls 550), the filter may restrict the air flow through the filter structure 522 and decrease the force of the air exiting the evaporative air cooling tower 500. In this configuration, the air exiting the evaporative air cooling tower 500 may be colder but less air may exit at any given time. In some embodiments, the angle of the filter holder slits 566 is configured to be adjustable (e.g., the angle can be adjusted to a greater or a smaller angle). In some embodiments, the angle of the filter holder slits 566 is fixed (e.g., a predetermined angle).

The filter holders 544 can be configured to secure the filter 524. As the filter 524 absorbs and stores the liquid, the filter 524 may increase in volume and weight. The filter holders 544 can be configured to secure the filter 524 such that the filter 524 substantially maintains its configuration (e.g., does not substantially sag or become deformed). The filter 524 can be configured to store the liquid, and as the fan 528 directs air toward and through the filter structure 522, the absorbed liquid can cool the air and form a mist that is directed through the grill 506.

Figure 25D:
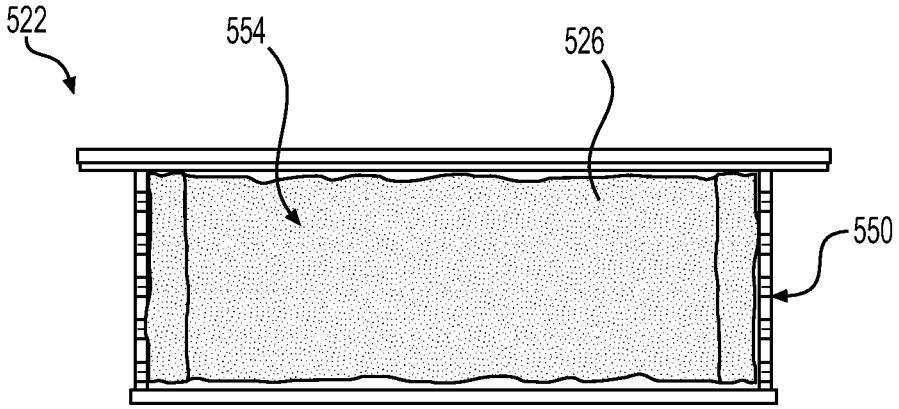
Figure 25E:
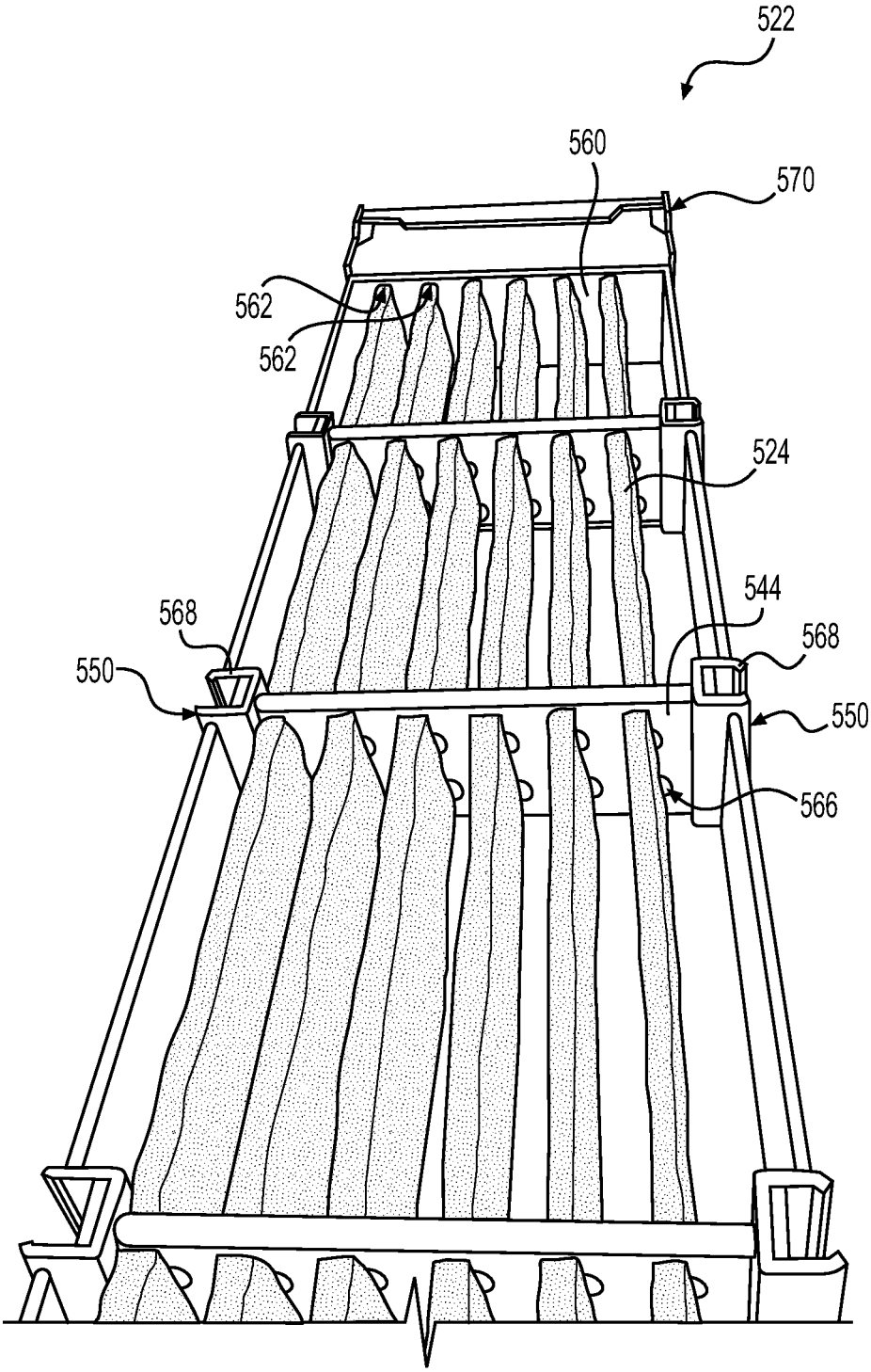

As generally illustrated in FIG. 25D, the filter structure 522 can comprise a top cavity 554. The top cavity 554 can be positioned adjacent to the top wall 552. The top cavity 554 can comprise an opening defined by portions of the side walls 550 and front and back walls of the filter structure 522. As generally illustrated in FIG. 25C, the top cavity 554 can be configured to receive a filter tray 570. The filter tray 570 can be coupled to the top cavity 554. The filter tray 570 can be coupled to the filter structure 522, such as to the side walls 550, or to any other portion of the filter structure 522. The filter tray 570 can be removably coupled to the filter structure 522. The filter tray 570 may comprise tabs that are configured to snap into compartments of the side walls 550. The filter tray 570 may be configured for a user to remove or insert the filter structure 522, via the filter tray 570, out of or into the interior 504 of the housing 502, respectively. The filter tray 570 may include a depression configured for removing the filter structure 522 from the interior 504 of the housing 502 and/or to insert the filter structure 522 into the interior 504. In this example, the user can insert a finger into a portion of the filter tray 570 to remove the filter structure 522 from the housing 502.

As generally illustrated in FIG. 25D, the filter structure 522 can comprise a second filter 526. The second filter 526 may include one or more filters. The second filter 526 can be positioned within the top cavity 554. The second filter 526 can be coupled to the filter structure 522. For example, the second filter 526 may be coupled using an adhesive to the side walls 550, or any other desired coupling. The second filter 526 can be removably coupled to the filter structure 522. For example, the second filter 526 may be inserted into the top cavity 554. The second filter 526 can be positioned adjacent to the top wall 552 and portions of the filter 524 (e.g., portions of the filter 524 that loop around the top bars 560. The second filter 526 can be configured to receive and absorb liquid from the tray 514 (e.g., from the tray 514, through the outlet 594, to the filter tray 570, and through the filter tray openings 572 to the second filter 526). The second filter 526 can transfer the liquid to the filter 524. Excess liquid not absorbed by the filters 524, 526 can flow through the interior 504 of the housing 502 and into the tank 510 for re-circulation within the evaporative air cooling tower 500. The filter structure 522, including the filters 524, 526 can be reusable. The filter structure 522 and the filters 524, 526 can be washed. The filter structure 522 and the filters 524, 526 can be replaced. The filters 524, 526 can be soaked in liquid and frozen prior to the filter structure 522 being inserted into the evaporative air cooling tower 500. When the liquid is frozen onto one or more of the filters 524, 526, the evaporative air cooling tower 500 can be configured to provide additional cooling (e.g., can cool air more quickly, can cool the air to a lower temperature, can cool air for a longer period of time, etc.).

The second filter 526 can be in fluid communication with the filter 524 and the filter tray 570. The filter tray 570 can be configured to receive the liquid from the tray 514. For example, the tray 514 may comprise an outlet, such as a tray outlet 574. The tray outlet 574 may be configured to release the liquid from the tray 514 toward the filter tray 570. The filter tray 570 can define one or more openings, such as filter tray openings 572. The filter tray openings 572 can be configured for the liquid to flow through and onto the filter, such as the second filter 526. The filter tray openings 572 can be configured to receive liquid from the tray 514. The filter tray 570 can be configured to distribute the liquid through an interior of the filter structure 522. For example, the filter tray 570 can receive the liquid, store the liquid for a period of time, and distribute the liquid through one or more of the filter tray openings 572. The liquid can be distributed to one or more filters. The second filter 526 can distribute the liquid to the filter 524. The second filter 526 may distribute liquid more quickly to the filter 524 if the filter 524 has the capacity to absorb more liquid. At least one of the filter 524 and the second filter 526 can be formed from a sponge material. The sponge material may comprise a microbacterial material. The microbacterial material may contain an antimicrobial agent that inhibits the ability of microorganisms to grow on the surface of the sponge material. The evaporative air cooling tower 500 may comprise a filtration system, such as to filter dirt, dust, hair, small insets, smells, other pollutants, or combinations thereof from polluted air flowing into the interior 504. The filter structure 522 may function as the filtration system. At least one of the filter 524 and the second filter 526 may be formed from material for filtration. For example, the filters 524, 526 may comprise filtration material, such as carbon charcoal, silk, any other desired filtration material, or combination thereof. The filtration system can be configured to purify the air and expel purified air from the interior 504.

Figure 22:
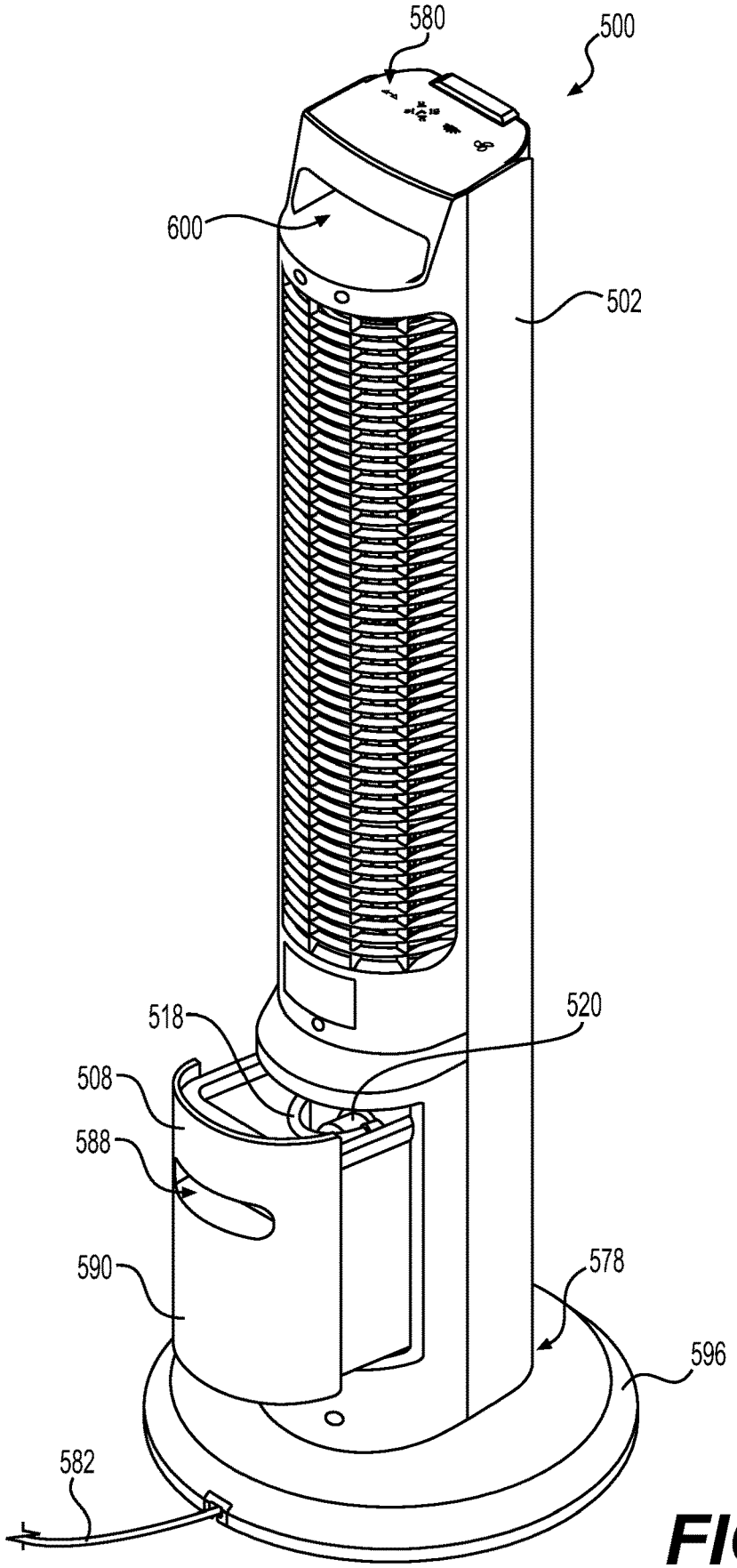
FIG. 22 generally illustrates a back perspective view of the evaporative air cooling tower with a tank open in accordance with aspects of the present disclosure.

The evaporative air cooling tower 500 can comprise a tank 510. The tank 510 can be positioned adjacent to a bottom portion 512 of the housing 502. As generally illustrated in FIG. 22, the tank 510 can be configured to open. The tank 510 can be removably coupled to the housing 502. The tank 510 can be configured to open by entirely and/or partially sliding the tank 510 from the housing 502, by rotating a front face of the tank 510 via a hinge, or by any other suitable opener. The tank 510 may comprise an indentation 588 in a face 592 of the tank 510. The indentation 588 can be configured for a user to pull the tank 510 from the housing 502. The tank 510 can receive liquid, such as water. The tank 510 can store the liquid. The liquid may include a scent to provide a desired smell into the room. For example, a scented oil may be added to the liquid. The scent from the scented oil may be diffused into the air expelled from the evaporative air cooling tower 500.

The tank 510 may be operatively coupled to a hose 518 and a pump 220. The hose 518 may be a cylindrical elongated hose. The hose 518 can be in fluid communication with the tank 510 and the tray 514. The pump 520 can be configured to pump fluid through the hose 518. A first end of the hose 518 can be disposed in the tank 510. A second end of the hose 518 can be disposed in the tray 514 or above the tray 514. The pump 520 can pump the liquid through the hose 518 from the tank 510 to the tray 514. The liquid can flow through the outlet 594 of the tray 514 to the filter tray 570. The pump may be configured to pump water at different speeds. For example, if the evaporative air cooling tower 500 is turned on to a high mode, the pump 520 may pump water at a first speed. If the evaporative air cooling tower 500 is turned on to a low mode, the pump 520 may pump water at a second speed, such that the first speed pumps the water at a greater flow rate than at the second speed. The evaporative air cooling tower 500 may have one or more sensors that detect liquid levels in the tank 510, the tray 514, any other suitable compartment, or combination thereof. The evaporative air cooling tower 500 may be configured to adjust the rate at which the pump 520 operates so that the tray 514 does not overflow with liquid. The evaporative air cooling tower 500 may include one or more windows, such as a tank window 590, configured to show a liquid level in the tank 510 (e.g., to show that the liquid level is full, partially full, nearly empty, etc.). The tank window 590 may be coupled to a front side of the bottom portion 512 of the housing 502. The evaporative air cooling tower 500 may include one or more lights configured to emit light into the tank 510. The light can be emitted, such as through the tank window 590, to indicate to the user, a liquid level in the tank 510. The evaporative air cooling tower 500 may be configured to provide an alert if the liquid level of the tank 510 is low or empty. The pump 520 may be disposed in and/or coupled to the tank 510. The pump 520 may be disposed within a compartment within the tank 510.

Figure 26:
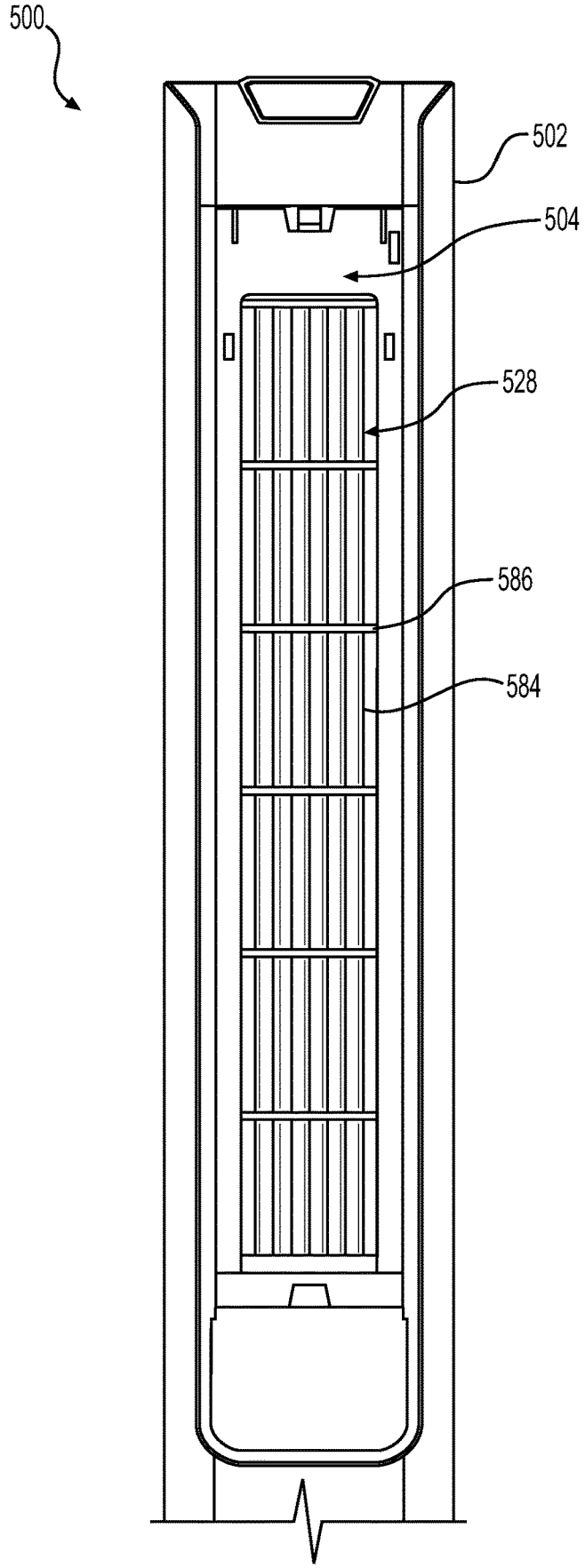
FIG. 26 generally illustrates a partial front view of the evaporative air cooling tower with the grill and vent removed in accordance with aspects of the present disclosure.

As generally illustrated in FIG. 26, the fan 528 can be disposed within the housing 502. The fan 528 can be configured to spin to generate airflow. The fan 528 may be cylindrical, circular, or any other desired shape. The fan 528 may comprise a plurality of blades 584. The plurality of blades 584 may be formed in a generally curved rectangular shape or any other desired shape. The fan 528 may comprise blade holders 586. The blade holders 586 may be formed in a ring shape, any other suitable shape, or combination thereof. The plurality of blades 584 may be coupled to one or more blade holders 586. For example, the plurality of blades 584 may be coupled via adhesive, snaps, received into openings defined by the blade holders 586, formed with the blade holders 586, or any other attachment configuration. The fan 528 can be configured to rotate (e.g., spin) to generate air flow. The fan 528 may be configured to rotate 360 degrees. As the fan 528 rotates, it directs air in one or more directions. For example, one or more of the plurality of blades 584 may be aligned adjacent to one or more of the plurality of blades 584. The plurality of blades 584 may be coupled to the blade holders 586 at an angle between 5-85 degrees relative to the side walls 550 of the housing 502. As the fan 528 spins, it directs air flow toward a direction correlating with the angle of each of the blades 584. The fan 528 may comprise one or more sets of the plurality of blades 584. Each set of the plurality of blades 584 can be coupled to two blade holders 586, one at each end of the blades 584. For example, for a first set of blades 584, first ends of the plurality of blades 584 can couple to a first blade holder 586 and opposing second ends of the plurality of blades 584 can couple to a second blade holder 586. First ends of a second set of blades 584 can be configured to couple to the second blade holder 586 at an opposing side at which the first set of blades 584 couples to the second blade holder 586. Second ends of the second set of blades 584 can couple to a third blade holder 586, and so forth. The fan 528 may comprise one or more sets of the plurality of blades 584 coupled to blade holders 586. In some embodiments, the number of sets of the plurality of blades 584 aligns with corresponding sections of the filter 524. For example, the fan 528 may comprise six sets of the plurality of blades 584 (e.g., each set of the plurality of blades positioned between two blade holders 586) and the filter structure 522 may comprise six sections of the filter 524 (e.g., each section of the filter 524 can be defined between two filter holders 268). The number of sets of the plurality of blades 584 and the number of sections of the filter 524 described in this disclosure are exemplary and the numbers may be greater or fewer. The plurality of blades 584 and the blade holders 586 may be formed from plastic, metal, or any other desired material.

The evaporative air cooling tower 500 can operate as a humidifier. The evaporative air cooling tower 500 can be configured to receive air with low levels of moisture and output air with higher levels of moisture. In other words, the evaporative air cooling tower 500 can add moisture to the air, such as the air in a room. The evaporative air cooling tower 500 can output a cooling mist into the ambient air. The water particles that are expelled into the air can raise the level of moisture in the air.

The evaporative air cooling tower 500 can comprise one or more motors 578. The motor 578 can be operatively coupled to the housing 502. The motor 578 may be configured to rotate the housing 502. For example, the motor 578 may be configured to oscillate the housing 502. The motor 578 may rotate the housing 502 on a horizontal axis. For example, the motor 578 may rotate the housing 502 in a first horizontal direction and in a second horizontal direction. The motor 578 may rotate the housing 502 between 5 and 180 degrees, or any other desired angle of rotation. The one or more motors 578 may be configured to rotate the fan 528. The evaporative air cooling tower 500 may include a timer configured to monitor the amount of time that the motor 578 oscillates the housing 502. When the time period has elapsed, the motor 578 may end the oscillation and/or turn off the evaporative air cooling tower 500. The evaporative air cooling tower 500 may include one or more buttons 580, as described below, that allow a user to control one or more operations of the evaporative air cooling tower 500.

The evaporative air cooling tower 500 can include a safety interlock 576. The safety interlock 576 can be configured to prevent operation of the evaporative air cooling tower 500. For example, if at least one of the grill 506 and the filter structure 522 is removed from the housing 502, the safety interlock 576 can shut off operation of the evaporative air cooling tower 500. The safety interlock 576 can function as a safety feature such that a user does not touch the fan 528 while the fan 528 is spinning in operation.

As generally illustrated in FIG. 22, the evaporative air cooling tower 500 may include one or more buttons 580. The one or more buttons 580 may be coupled to the housing 502, such as on a top portion of the evaporative air cooling tower 500. The one or more buttons 580 can be configured for controlling operations of the evaporative air cooling tower 500. For example, the one or more buttons 580 may include: (a) a fan-shaped button configured to control one or more speeds of the fan 528 (e.g., high, medium, and low speeds) and when depressed can circulate through the speed options; (b) a timer, which can be configured to manually set the fan 528 to operate for a period of time (e.g., two hours, six hours, eight hours, or twelve hours, etc.); (c) an LED light button configured to display one or more levels of brightness for lights 602 (e.g., full power, 50% power, off); (d) an oscillation button configured control the oscillation of the housing 502; or any other desired button to control features of the evaporative air cooling tower 500. The evaporative air cooling tower 500 may comprise one or more lights configured to function as a nightlight, for ambiance, to provide the user with an indication of an operation, or any other desired purpose. For example, each time the user presses the timer button, a corresponding time slot may light up and remain lit until the chosen time period expires. Similarly, if the user chooses to turn the evaporative air cooling tower 500 on a high speed, three lights may be turned on, if a middle speed is activated, then two lights may turn on, and if a low speed is activated, then one light may turn on. The lights 602 may be located at the top portion 516 of the housing 502, such as behind the first three rows vents 604 of the grill 506, behind the a window located at the top portion 516, in the interior 504 of the housing 502, in the tank 510, or any other desired location. The lights may be one or more colors. The lights 602 may configured to display a single color, cycle through two or more colors, or any other desired display.

As generally illustrated in FIG. 22, the evaporative air cooling tower 500 may comprise an electrical cord 582. The electrical cord 582 can be used to power the evaporative air cooling tower 500. The evaporative air cooling tower 500 may comprise a rechargeable battery and a charging port. The evaporative air cooling tower 500 can use the power to operate the fan 528, the motor 578, one or more lights, any other desired function, or combination thereof. The base 596 may comprise an electrical cord holder 598. The electrical cord holder 598 may be configured to receive a portion of the electrical cord 582.

In some embodiments, the evaporative air cooling tower 500 is configured for the user to pull out the removable tank 510 located on the bottom portion 512. The pump 520 can be generally concealed within the tank 510. The user can remove the tank 510, fill the tank 510 with liquid, such as water, and close the tank 510 (e.g., insert the tank 510 into the bottom portion 512 of the housing 502. The user can turn on the evaporative air cooling tower 500 by selecting one of the buttons 580 (e.g., an "on" button). After the button 580 is depressed, the hose 518 that is disposed at the bottom portion 512 of the housing 502 (e.g., within the tank 510), runs vertically up within the housing 502 to the top portion 516 of the housing 502. The hose 518 can be configured to slowly drip liquid into a horizontal tray, such as the filter tray 570 attached to the top of the filter structure 522. The liquid will saturate the filters 524, 526 and/or flow through the interior 504 back into the tank 510 for re-circulation. When the user turns on the fan 528, the user can select one of the buttons 580 (e.g., a fan speed button). The button 580 may be configured to turn on one or more lights. The lights may be configured to emit light behind the top grill rows. For example, when the button 580 is selected for a first time to operate the fan 528 at a slow speed, a light is emitted behind a first row of vents of the grill 506 for approximately five seconds, or any other desired amount of time. When the button 580 is selected for a second time to operate the fan 528 at a medium speed, one or more lights are emitted behind the first row and a second row of vents of the grill 506 for approximately five seconds, or any other desired amount of time. When the button 580 is selected for a third time to operate the fan 528 at a fast speed, one or more lights are emitted behind first, second, and third rows of vents of the grill 506 for approximately five seconds, or any other desired amount of time. The button 580 may be selected to oscillate the evaporative air cooling tower 500 (e.g., to horizontally rotate the housing 502). To clean and/or replace the filter structure 522, the grill 506 and the filter structure 522 can be removed from the housing 502. The grill 506 can be removed by the user depressing the pull tab 530 located at a top portion of the grill 506, or any other desired location. After the grill 506 is removed from the housing, the user can access and remove the filter structure 522. The filter structure 522, including the filters 524, 526 may be hand washed, washed in a dishwasher, or any other washing treatment. The filters 524, 526 may be formed from a sponge material. The sponge material may be microbial. The filters 524, 526 may be the same filter or separate filters. The filter 524 may be coiled and/or looped throughout the filter structure 522. The filters 524, 526 can be in fluid communication, such that liquid from one filter can be transferred to the other filter. The filter structure 522 can be discarded and replaced. The evaporative air cooling tower 500 may include safety features, such as a built-in safety mechanism (e.g., the safety interlock 576) that is configured to stop the fan 528 from rotating. For example, when the grill 506 is removed from the housing 502, the safety interlock 576 prevents the fan 528 from rotating.

The evaporative air cooling tower 500 can include additional and/or fewer components and is not limited to those illustrated in the figures.

Figure 27:
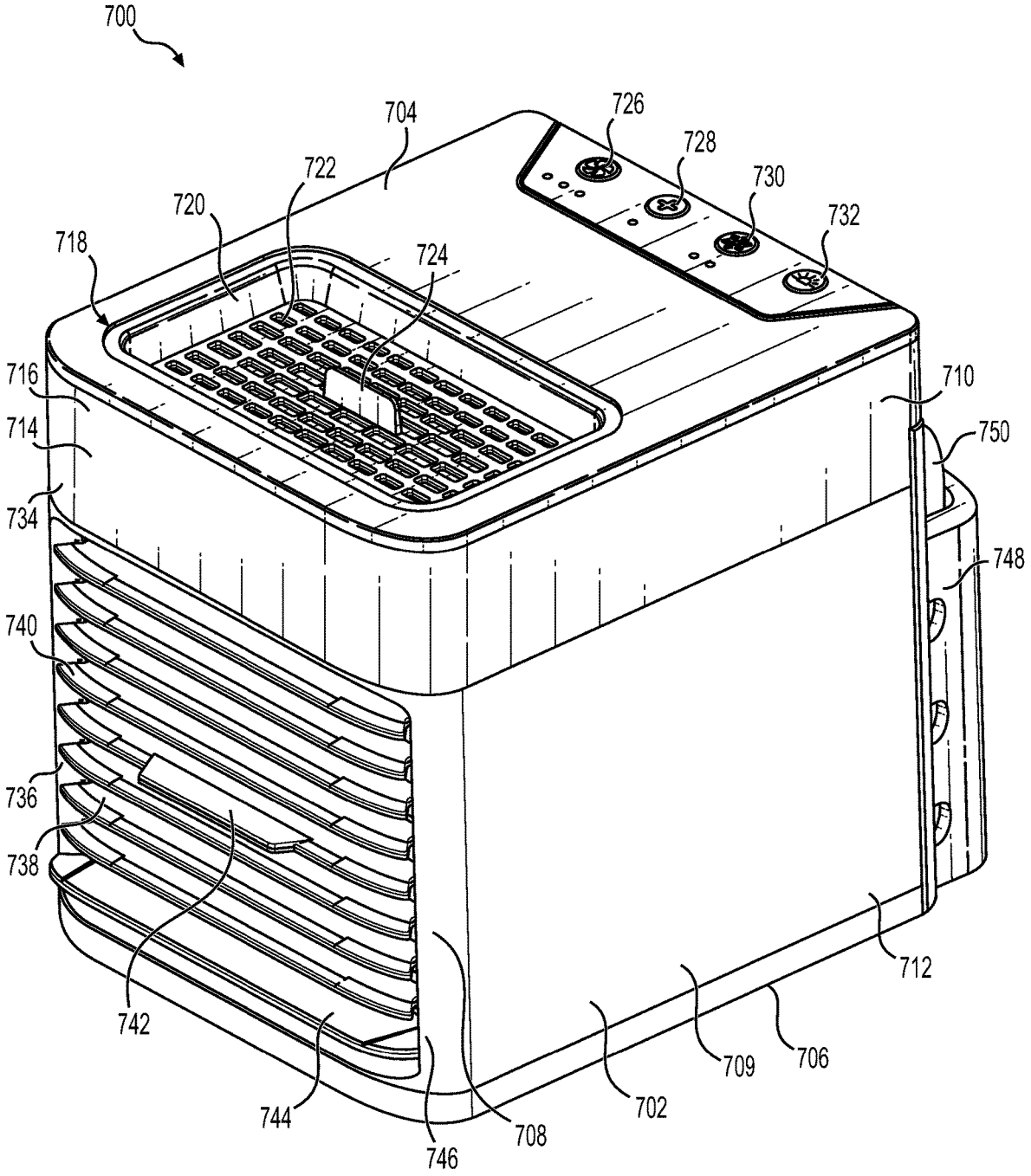
FIG. 27 generally illustrates a perspective front view of an evaporative personal air cooler in accordance with aspects of the present disclosure.

FIG. 27 generally illustrates a perspective front view of an evaporative personal air cooler 700 in accordance with aspects of the present disclosure. As shown in FIG. 27, the air cooler 700 may include a housing 702 with a top face 704, a bottom face 706, and four lateral faces, such as a front face 708, a back face 752 (see FIG. 28), and two side faces 709 and 711 (see FIG. 28). The housing 702 may be formed as a cube housing, a rectangular housing, or any other desired configuration or shape. The housing 702 may be formed from plastic or any other desired material. The housing 702 may include a top portion 710 and a bottom portion 712 coupled to the top portion 710. The top face 704 is part of the top portion 710 of the housing 702, and the bottom face 706 is part of the bottom portion 712 of the housing 702.

The air cooler 700 may include a water tank 714 disposed in the top portion 710 thereof. The water tank 714 may include an upper portion 716 and a lower portion 772 (see FIG. 32) extending from the upper portion 716 thereof. Referring to FIG. 27, the top face 704 may include a cavity 718, through which a user may add water and/or ice into the water tank 714. The cavity 718 may include a shape and a size to removably receive a tray 720. In some embodiments, the tray 720 may be a drainage tray including one or more through holes 722. FIG. 27 shows that the tray 720 is received (e.g., positioned) in the cavity 718. A user may add water and/or ice into the water tank 714 while the tray 720 is received in the cavity 718. The tray 720 may further include a tab 724 extending therefrom. The tab 724 may be positioned in a middle area of the tray 720 or any other desired area of the tray 720. The tab 724 may be configured for a user to remove the tray 720 from the cavity 718. For example, to remove the tray 720, the user may pull the tray 720 upwardly away from the cavity 718. When the tray 720 is removed (e.g., not positioned in the cavity 718), the user may add water and/or ice into the water tank 714. The user may also clean the water tank 714 as needed. In FIG. 27, except that the tray 720 is removably receivable in the cavity 718 of the top face 704, other areas of the top face 704 may not be removable.

The air cooler 700 may include at least one buttons disposed on the housing 702 thereof. The at least one buttons may be configured to control the operation of the air cooler 700. In some embodiments, the at least one buttons may be disposed on the top face 704 of the housing 702. In some other embodiments, the at least one buttons may be disposed on the front face 708 or any other desired location on the air cooler 700. FIG. 27 shows that the air cooler 700 may include four buttons 726, 728, 730, and 732 disposed on the top face 704 of the housing 702 thereof. However, it is contemplated that the air cooler 700 may include any other desired number of buttons disposed on the housing 702 thereof.

Particularly, the air cooler 700 may include a first button 726 disposed on the housing 702 thereof. The first button 726 may be disposed on the top face 704 of the housing 702 or any other desired location on the air cooler 700. The first button 726 may be configured to control a fan speed of a fan 762 (see FIG. 32) of the air cooler 700. The user may actuate the first button 726 to start or stop the operation of the fan 762. The user may also actuate the first button 726 to change the fan speed of the fan 762 as needed. For example, when the first button 726 is activated at a first time, the fan 762 may be turned ON (e.g., to a high speed). When the first button 726 is activated at a second time, the fan speed may decrease, for example, to a medium speed. When the first button 726 is activated at a third time, the fan speed may decrease, for example, to a low speed. When the first button 726 is activated at a fourth time, the fan 762 may be turned OFF. Therefore, by actuating the first button 726, the user may adjust a fan speed of the fan 762 as needed.

The air cooler 700 may further include a second button 728 disposed on the housing 702 thereof. The second button 728 may be disposed on the top face 704 of the housing 702 or any other desired location on the air cooler 700. The second button 728 may be a turbo mode button configured to control the air cooler 700 to operate in a turbo mode. The user may actuate the second button 728 to start or stop the turbo mode of the air cooler 700.

The air cooler 700 may also include a third button 730 disposed on the housing 702 thereof. The third button 730 may be disposed on the top face 704 of the housing 702 or any other desired location on the air cooler 700. The third button 730 may be a mist mode button configured to control the air cooler 700 to operate in a mist mode. The mist mode may be a full mist mode, a half mist mode, a no mist mode, or any other desired mode for producing the mist. For example, the user may actuate the third button 730 to start or stop the mist mode of the air cooler 700. The user may also actuate the third button 730 to select a mist mode as needed.

The air cooler 700 may further include a fourth button 732 disposed on the housing 702 thereof. The fourth button 732 may be disposed on the top face 704 of the housing 702 or any other desired location on the air cooler 700. The fourth button 732 may be a light button configured to control the operation of at least one light source of the air cooler 700. The at least one light source may be positioned in the water tank 714, or any other desired location on or within the housing 702 of the air cooler 700. The at least one light source may emit light in different colors or brightness. The colors or brightness of the light may indicate one or more operating conditions of the air cooler 700. For example, the colors or brightness of the light may indicate a fan speed of the fan 762, a water level in the water tank 714, and a filter condition of a filter structure 792 (see FIG. 33A) of the air cooler 700 (e.g., whether the filter structure needs to be replaced). In some embodiments, the at least one light source may emit light in one of seven colors or any other desired hue. The user may press the fourth button 732 to change the colors of the light or set the at least one light source to automatically change the colors through the available colors. In some other embodiments, the at least one light source may emit light in fewer or more colors (i.e. fewer or more than seven colors).

Figure 28:
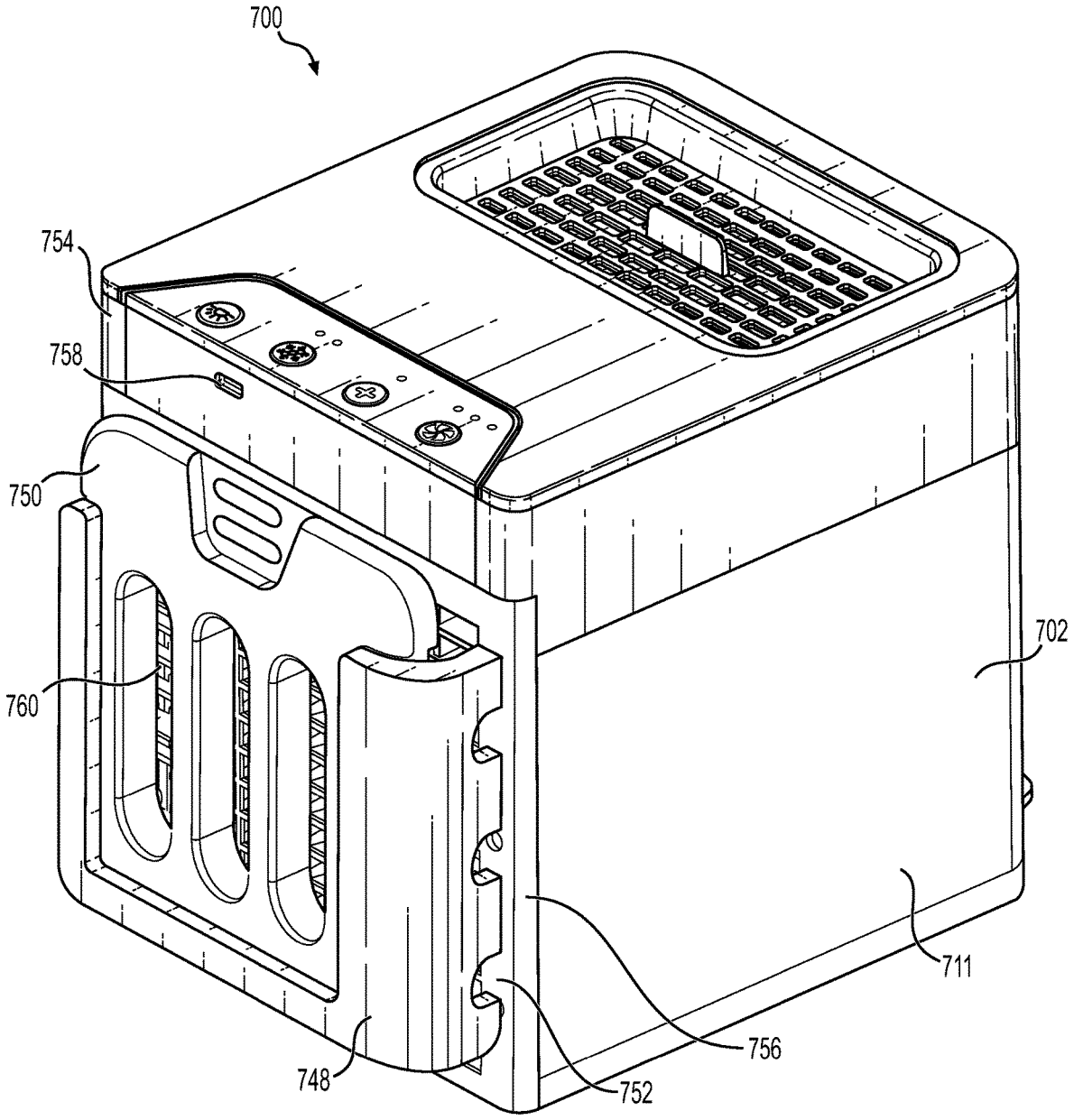
FIG. 28 generally illustrates a perspective rear view of the evaporative personal air cooler as illustrated in FIG. 27.

As shown in FIG. 27, the lateral faces of the housing 702 may include a front face 708, a back face 752 (see FIG. 28), and two side faces 709 and 711 (see FIG. 28). The lateral faces may be positioned between the top face 704 and the bottom face 706 about their outer perimeters. The lateral faces may be positioned adjacent to each other. Each lateral face may include an upper portion and a framed portion. The framed portion may be positioned about a perimeter of the lateral face.

Particularly, the front face 708 may include an upper portion 734 and a framed portion 736 positioned adjacent to the upper portion 734 and along the side and bottom edges of the top face 704. The front face 708 may also include an outlet vent 738 positioned within the framed portion 736. The outlet vent 738 may include a plurality of vents 740, an air direction tab 742, and a grill tab 744. Each of the plurality of vents 740 may be positioned horizontally in the outlet vent 738. In some embodiments, at least one of the plurality of vents 740 may be an adjustable vent moveably connected to the air direction tab 742. The air direction tab 742 may be positioned to direct air flowing from inside the air cooler 700 through the outlet vent 738. For example, if the air direction tab 742 is positioned upward, the at least one of the plurality of vents 740 may be positioned in an upward position to direct the airflow upward. Similarly, if the air direction tab 742 is positioned downward, the at least one of the plurality of vents 740 may be positioned in a downward position to direct the airflow downward. If the air direction tab 742 is positioned in a center position, the at least one of the plurality of vents 740 may be positioned in a substantially horizontal position to direct the air to flow horizontally from the air cooler 700. The air direction tab 742 may direct the air to flow at any angle between the downward and upward angles. With reference to FIG. 27, the grill tab 744 may be positioned at a bottom portion 746 of the front face 708. The grill tab 744 may be used to catch any excess water and direct the water back to a water tray 780 (see FIG. 31) disposed within the housing 702 of the air cooler 700. If the air cooler 700 includes a filter structure (e.g., 792 in FIG. 33A) disposed within the housing 702 thereof, the filter structure may absorb at least some of the excess water on the water tray 780. If the air cooler 700 does not include a filter structure, the excess water may remain on the water tray 780 until it evaporates or dries out. In some embodiments, the user may empty the excess water on the water tray 780.

The air cooler 700 may further include a drawer 778 (see FIG. 31) at least partially disposed within the housing 702 thereof. The drawer 778 may be attached to the outlet vent 738. In some embodiments, the outlet vent 738 may be removed from the air cooler 700. For example, the user may pull the outlet vent 738 to remove the outlet vent 738 from the air cooler 700. The outlet vent 738 may include one or more tabs or any other desired device configured for removing the outlet vent 738 from the air cooler 700.

The drawer 778 may include the water tray 780 as described herein. In some embodiments, the water tray 780 may be disposed in the drawer 778. In some other embodiments, the water tray 780 may be integrated with the drawer 778. The drawer 778 may be configured for supporting a structure thereupon. The structure may be a filter structure (see 792 in FIG. 33A), an ice pack (800 in FIG. 33B), or the like. The structure may be removably attached to the drawer 778. The drawer 778 may include a drawer notch 782 (see FIG. 31) to secure the structure in place. For example, the structure may be placed on a top surface of the water tray 780 and between the outlet vent 738 and the drawer notch 782.

In some embodiments, the water tray 780 may be angled such that when the structure is placed on the top surface of the water tray 780, any water on the water tray 780 may flow in a direction toward the structure. For example, the water tray 780 may be higher toward a back end of the drawer 778 than toward a front end of the drawer. The water tray 780 may be configured for cleaning. For example, when the drawer 778 is removed from the air cooler 700, the water tray 780 may be easily accessible for cleaning. The user may empty any water on the water tray 780, wipe down and dry the water tray 780, or otherwise clean the water tray 780. Cleaning the water tray 780 may prevent mold or bacteria from building up on the water tray 780 or at any other locations in the air cooler 700.

Referring to FIG. 27, the air cooler 700 may further include a holder 748 removably attached to the back face 752 of the housing 702 thereof. The holder 748 may include a shape and a size to receive and support an ice pack 750 therein. When the air cooler 700 is in operation, air from outside the air cooler 700 may be cooled down by the ice pack 750 as it enters the air cooler 700, thereby providing an enhanced cooling effect to the user.

FIG. 28 generally illustrates a perspective rear view of the evaporative personal air cooler 700 as illustrated in FIG. 27. As shown in FIG. 28, the back face 752 of the housing 702 may include an upper portion 754 and a framed portion 756. The back face 752 may include a power port 758 for a power adapter. The power adapter includes a cord with a first power adapter plug on one end that is configured to plug into the power port and a second power adapter plug on the opposite end of the cord that is configured to plug into an outlet, such as a wall outlet or a power strip. The power port 758 may be located in the upper portion 754 of the back face 752 or any other desired location on the housing 702 of the air cooler 700. In some other embodiments, the air cooler 700 may be powered using batteries or any other desired power source.

Figure 30:
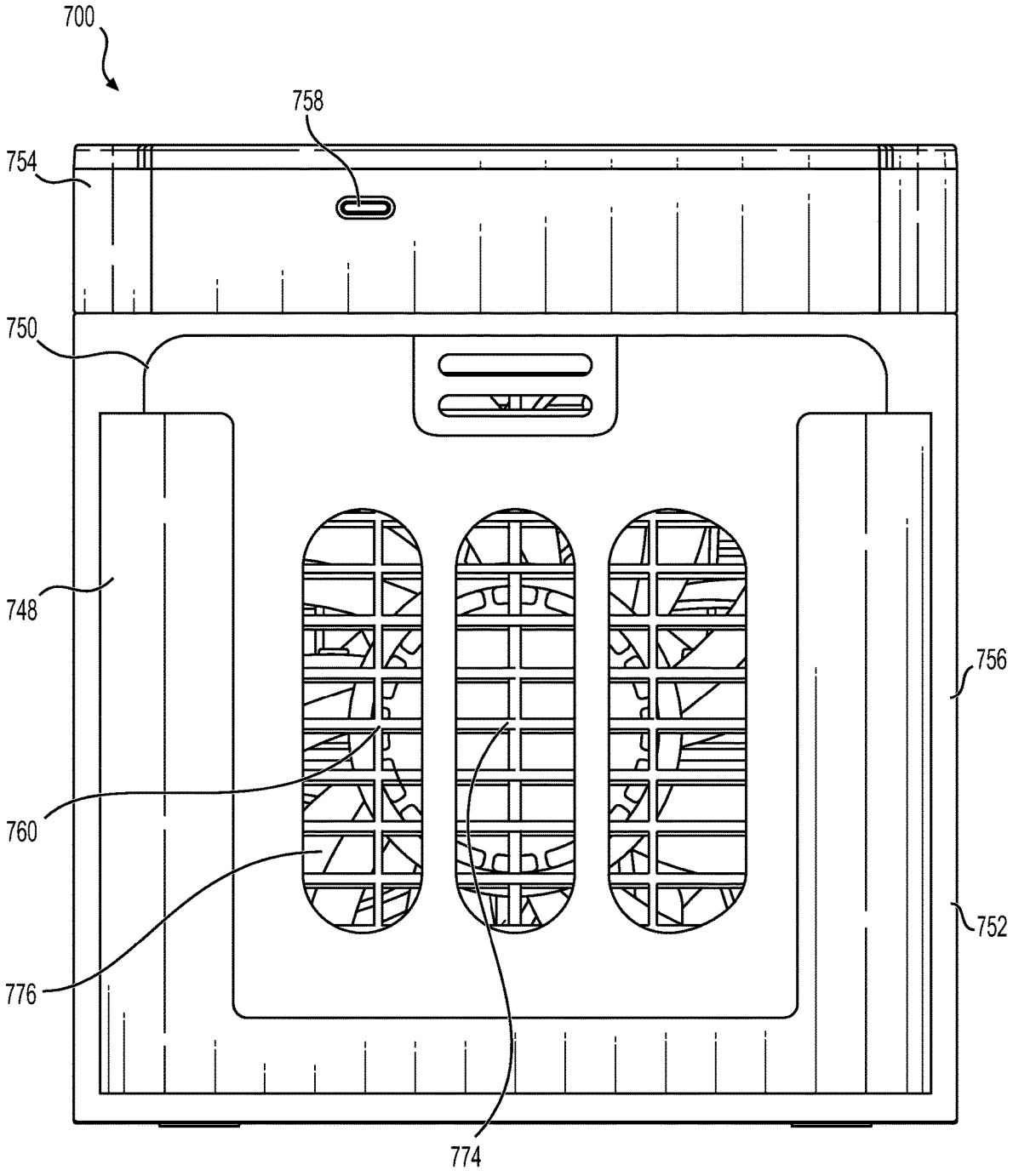
FIG. 30 generally illustrates a rear view of the evaporate air cooler as illustrated in FIG. 27.

The back face 752 of the housing 702 may also include a grate 760 (see also in FIG. 30). The grate 760 may be positioned within the framed portion 756 of the back face 752. The grate 760 may include a plurality of ribs 774 (see in FIG. 30) positioned horizontally or vertically along the back face 752. The plurality of ribs 774 may define a plurality of grate openings 776 in the grate 760. The plurality of grate openings 776 may be configured for air to flow from outside the air cooler 700 to inside the air cooler 700. The grate 760 may also have a cord guide for securing the cord of the power adapter in place. The cord guide may be located along one side of the grate 760 and adjacent to the framed portion 756 of the back face 752, or any other desired location on the back face 752. The grate 760 may have one or more cord guides tabs. Additionally, some of the horizontal ribs may be shorter to allow for the cord to be positioned flush with the horizontal ribs.

Referring to FIG. 28, the air cooler 700 may further include a holder 748 removably attached to the back face 752 of the housing 702 thereof. The holder 748 may include a shape and a size to receive and support the ice pack 750 therein. The holder 748 may include a plurality of arms 818 (see FIG. 36) extending from a body 807 (see FIG. 36) thereof. The plurality of arms 818 may be configured for attaching the holder 748 to the air cooler 700. In some embodiments, the plurality of arms 818 may be inserted into one or more grate openings 776 defined by the plurality of ribs 774 of the grate 760 on the back face 752 of the housing 702. In some other embodiments, the plurality of arms 818 may snap onto one or more ribs of the grate 760 on the back face 752 of the housing 702. It is contemplated, however, that the plurality of arms 818 may be configured for attaching the holder 748 to the air cooler 700 by any other desired attaching mechanism. It is further contemplated that the holder 748 may be in any other desired configuration. When the air cooler 700 is in operation, air from outside the air cooler 700 may be cooled down by the ice pack 750 as it enters the air cooler 700, thereby providing an enhanced cooling effect to the user.

Figure 29:
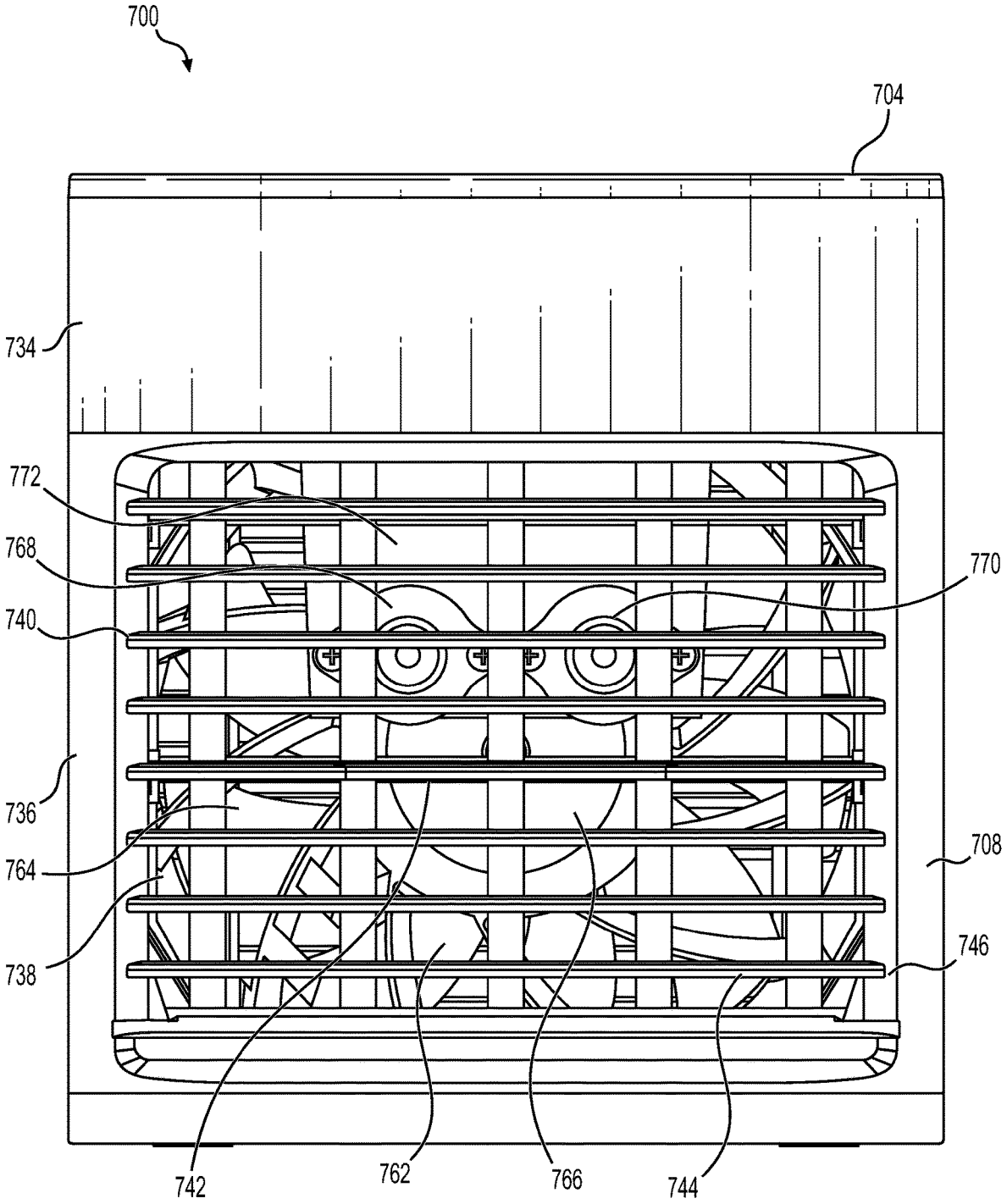
FIG. 29 generally illustrates a front view of the evaporative air cooler as illustrated in FIG. 27.

FIG. 29 generally illustrates a front view of the evaporative air cooler 700 as illustrated in FIG. 27. As shown in FIG. 29, the front face 708 may include the upper portion 734 and the framed portion 736 positioned adjacent to the upper portion 734 and along the side and bottom edges of the top face 704. The front face 708 may also include the outlet vent 738 positioned within the framed portion 736. The outlet vent 738 may include the plurality of vents 740, the air direction tab 742, and a grill tab 744. Each of the plurality of vents 740 may be positioned horizontally in the outlet vent 738. In some embodiments, at least one of the plurality of vents 740 may be an adjustable vent moveably connected to the air direction tab 742. The air direction tab 742 may be positioned to direct air flowing from inside the air cooler 700 through the outlet vent 738. For example, if the air direction tab 742 is positioned upward, the at least one of the plurality of vents 740 may be positioned in an upward position to direct the airflow upward. Similarly, if the air direction tab 742 is positioned downward, the at least one of the plurality of vents 740 may be positioned in a downward position to direct the airflow downward. If the air direction tab 742 is positioned in a center position, the at least one of the plurality of vents 740 may be positioned in a substantially horizontal position to direct the air to flow horizontally from the air cooler. The air direction tab 742 may direct the air to flow at any angle between the downward and upward angles. With reference to FIG. 29, the grill tab 744 may be positioned at the bottom portion 746 of the front face 708. The grill tab 744 may be used to catch any excess water and direct the water back to a water tray 780 (see FIG. 31) disposed within the housing 702 of the air cooler 700. If the air cooler 700 includes a filter structure (e.g., 792 in FIG. 33A) disposed within the housing 702 thereof, the filter structure may absorb at least some of the excess water on the water tray 780. If the air cooler 700 does not include a filter structure, the excess water may remain on the water tray 780 until it evaporates or dries out. In some embodiments, the user may empty the excess water on the water tray 780.

As shown in FIG. 29, the air cooler 700 may include a fan 762 disposed within the housing 702 thereof. The fan 762 may include a fan hub and a plurality of fan blades 764 centrally attached to the fan hub. The plurality of fan blades 764 may be generally straight or curved in shape or any other desired shape. The plurality of fan blades 764 may rotate around the fan hub when the air cooler 700 is in operation. The air cooler 700 may further include a fan shroud 790 (see FIG. 32) circumferentially surrounding the fan 762. The fan shroud 790 may be a plastic ring circumferentially surrounding the fan 762 so as to funnel an air flow from the fan 762 when the air cooler 700 is in operation. The fan 762 may further include a fan grill 789 (see FIG. 32) covering the fan 762.

The air cooler 700 may further include a ring plate 766 disposed within the housing 702 thereof. The ring plate 766 may be disposed between the fan 762 and the lower portion 772 (see FIG. 32) of the water tank 714. In some embodiments, the ring plate 766 may be at least partially attached to the fan grill 789 of the fan 762. The ring plate 766 may be configured for concentrating and/or directing the air flow from the fan 762 to the center of the fan 762, and thus to the center of the air cooler 700, when the air cooler 700 is in operation. The incorporation of the ring plate 766 into the air cooler 700 may enhance an air intensity of the air flow from the fan 762, thereby creating an efficient, direct, and strong stream of an air flow when the air cooler 700 is in operation.

The air cooler 700 may also include a first mister 768 at least partially attached to the lower portion 772 of the water tank 714. For example, the first mister 768 may be at least partially attached to a first location on the lower portion 772 of the water tank 714. The first mister 768 may be configured to dispense (or spray) mist using the water in the water tank 714. The air cooler 700 may further include a second mister 770 at least partially attached to the lower portion 772 of the water tank 714. For example, the second mister 770 may be at least partially attached to a second location on the lower portion 772 of the water tank 714. The first and second locations are different. In some embodiments, the first and second locations are symmetrical with respect to the lower portion 772 of the water tank 714, or in any other desired configuration. The second mister 770 may be configured to dispense (or spray) mist using the water in the water tank 714.

FIG. 30 generally illustrates a rear view of the evaporate air cooler 700 as illustrated in FIG. 27. As shown in FIG. 30, the back face 752 of the housing 702 may include the upper portion 754 and the framed portion 756. The back face 752 may include the power port 758 for a power adapter. It is contemplated that the air cooler 700 may also be powered using batteries or any other desired power source.

With reference to FIG. 30, the back face 752 of the housing 702 may include the grate 760. The grate 760 may be positioned within the framed portion 756. The grate 760 may include a plurality of ribs 774 positioned horizontally or vertically along the back face 752. The plurality of ribs 774 may define a plurality of grate openings 776 in the grate 760. The plurality of grate openings 776 may be configured for air to flow from outside the air cooler 700 to inside the air cooler 700.

The air cooler 700 may further include the holder 748 removably attached to the back face 752 of the housing 702 thereof. The holder 748 may include a shape and a size to receive and support the ice pack 750 therein. When the air cooler 700 is in operation, air from outside the air cooler 700 may be cooled down by the ice pack 750 as it enters the air cooler 700, thereby providing an enhanced cooling effect to the user.

Figure 31:
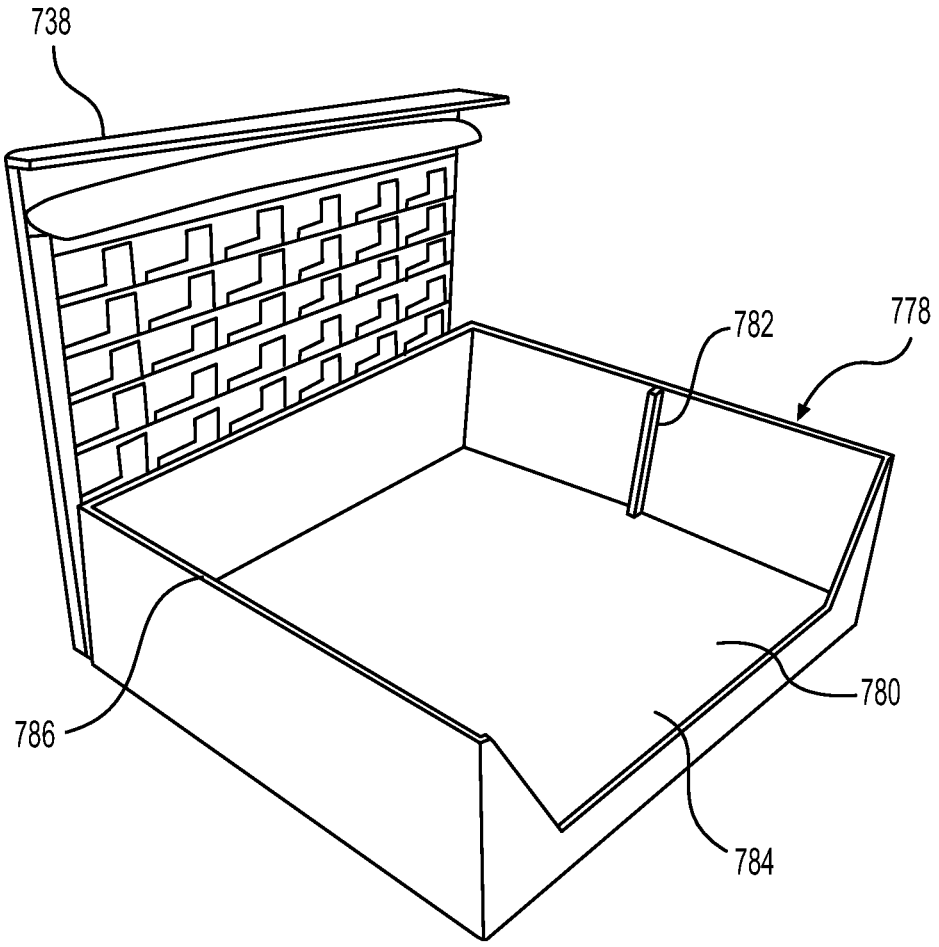
FIG. 31 generally illustrates a perspective view of the drawer of the evaporate air cooler as illustrated in FIG. 27.

FIG. 31 generally illustrates a perspective view of the drawer of the evaporate air cooler 700 as illustrated in FIG. 27. The drawer 778 may be at least partially disposed within the housing 702 of the air cooler 700. The drawer 778 may be attached to the outlet vent 738. The drawer 778 may include a water tray 780. In some embodiments, the water tray 780 may be disposed in the drawer 778. In some other embodiments, the water tray 780 may be integrated with the drawer 778. The drawer 778 may be configured for supporting a structure thereupon. The structure may be a filter structure (see 792 in FIG. 33A), an ice pack (800 in FIG. 33B), or the like. The structure may be removably attached to the drawer 778. The drawer 778 may include a drawer notch 782 to secure the structure in place. For example, the structure may be placed on a top surface of the water tray 780 and between the outlet vent 738 and the drawer notch 782. In some embodiments, the water tray 780 may be angled such that when the structure is placed on the top surface of the water tray 780, any water on the water tray 780 may flow in a direction toward the structure. For example, the water tray 780 may be higher toward a back end 784 of the drawer 778 than toward a front end 786 of the drawer 778. The water tray 780 may be configured for cleaning. When the drawer 778 is removed from the air cooler 700, the water tray 780 may be easily accessible for cleaning. The user may empty any water on the water tray 780, wipe down and dry the water tray 780, or otherwise clean the water tray 780. Cleaning the water tray 780 may prevent mold or bacteria from building up on the water tray 780 or at any other locations in the air cooler 700.

Figure 32:
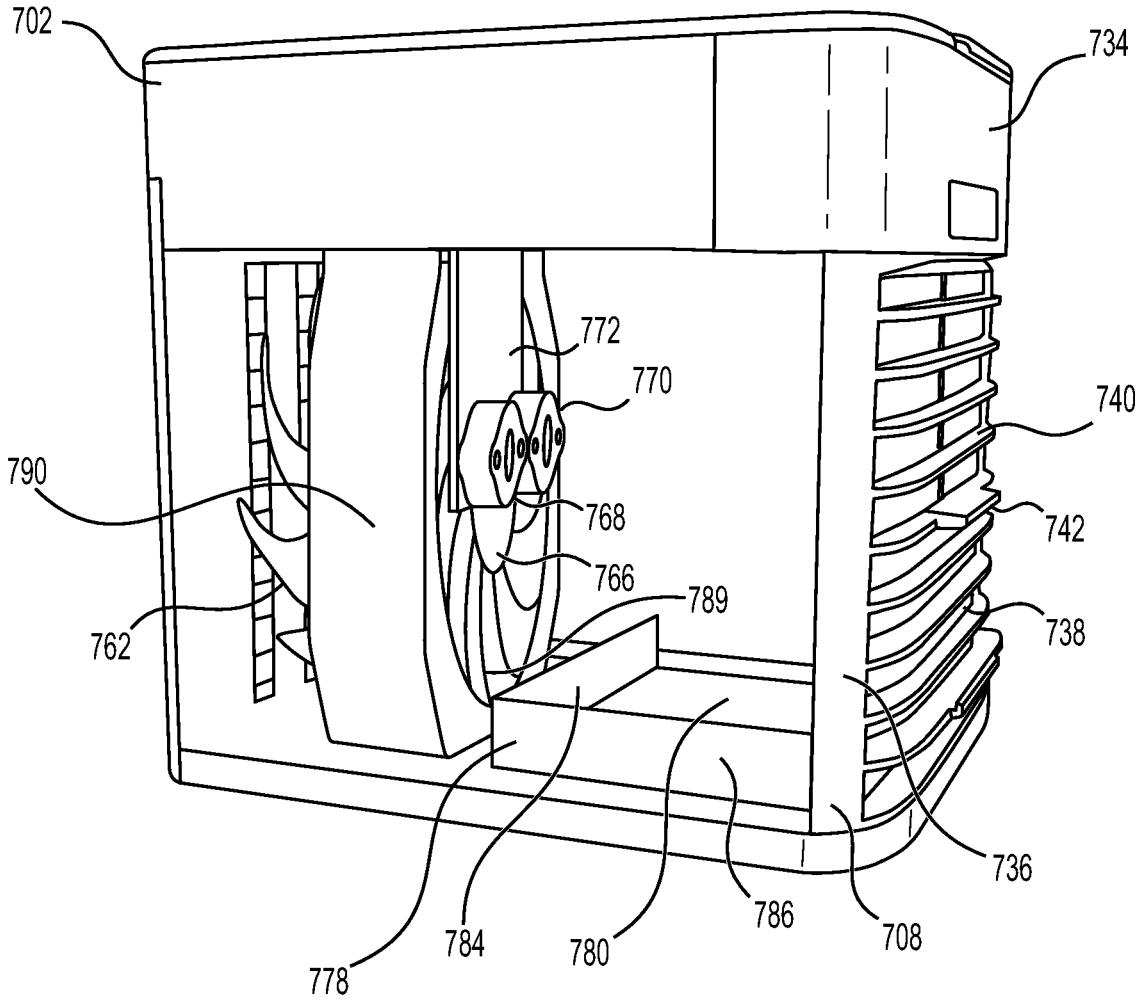
FIG. 32 generally illustrates a perspective side view of an interior of the evaporate air cooler as illustrated in FIG. 27.

FIG. 32 generally illustrates a perspective side view of an interior of the evaporate air cooler 700 as illustrated in FIG. 27. As shown in FIG. 32, the front face 708 of the housing 702 may include the upper portion 734 and the framed portion 736. The front face 708 may also include the outlet vent 738 positioned within the framed portion 736. The outlet vent 738 may include a plurality of vents 740, an air direction tab 742, and a grill tab 744, as described herein.

Referring to FIG. 32, the air cooler 700 may include a fan 762 disposed within the housing 702 thereof. The fan 762 may include a fan hub and a plurality of fan blades 764 (see FIG. 34) centrally attached to the fan hub. The plurality of fan blades 764 may be generally straight or curved in shape or any other desired shape. The plurality of fan blades 764 may rotate around the fan hub when the air cooler 700 is in operation. The air cooler 700 may further include a fan shroud 790 circumferentially surrounding the fan 762. The fan shroud 790 may be a plastic ring circumferentially surrounding the fan 762 so as to funnel an air flow from the fan 762 when the air cooler 700 is in operation. The fan 762 may further include a fan grill 789 covering the fan 762.

The air cooler 700 may further include a ring plate 766 disposed within the housing 702 thereof. The ring plate 766 may be disposed between the fan 762 and the lower portion 772 of the water tank 714. In some embodiments, the ring plate 766 may be at least partially attached to the fan grill 789 of the fan 762. The ring plate 766 may be configured to concentrate and/or direct the air flow from the fan 762 to the center of the fan 762, and thus to the center of the air cooler 700, when the air cooler 700 is in operation. The incorporation of the ring plate 766 into the air cooler 700 may enhance an air intensity of the air flow from the fan 762, thereby creating an efficient, direct, and strong stream of an air flow when the air cooler 700 is in operation.

The air cooler 700 may also include a first mister 768 at least partially attached to the lower portion 772 of the water tank 714. For example, the first mister 768 may be at least partially attached to a first location on the lower portion 772 of the water tank 714. The first mister 768 may be configured to dispense (or spray) mist using the water in the water tank 714. The air cooler 700 may further include a second mister 770 at least partially attached to the lower portion 772 of the water tank 714. For example, the second mister 770 may be at least partially attached to a second location on the lower portion 772 of the water tank 714. The first and second locations are different. In some embodiments, the first and second locations are symmetrical on the lower portion 772 of the water tank 714, or in any other desired configuration. The second mister 770 may be configured to dispense (or spray) mist using the water in the water tank 714.

As shown in FIG. 32, the air cooler 700 may include a drawer 778 at least partially disposed within the housing 702 thereof. The drawer 778 may be attached to the outlet vent 738. The drawer 778 may include a water tray 780. In some embodiments, the water tray 780 may be disposed in the drawer 778. In some other embodiments, the water tray 780 may be integrated with the drawer 778. In one or more embodiments of the present disclosure, the drawer 778 may be configured for supporting a structure thereupon. The structure may be a filter structure (see 792 in FIG. 33A), an ice pack (800 in FIG. 33B), or the like. The structure may be removably attached to the drawer 778. The drawer 778 may include a drawer notch 782 (see FIG. 31) to secure the structure in place. For example, the structure may be placed on a top surface of the water tray 780 and between the outlet vent 738 and the drawer notch 782. In some embodiments, the water tray 780 may be angled such that when the structure is placed on the top surface of the water tray 780, any water on the water tray 780 may flow in a direction toward the structure. For example, the water tray 780 may be higher toward a back end 784 of the drawer 778 than toward a front end 786 of the drawer 778. The water tray 780 may be configured for cleaning. For example, when the drawer 778 is removed from the air cooler 700, the water tray 780 may be easily accessible for cleaning. The user may empty any water on the water tray 780, wipe down and dry the water tray 780, or otherwise clean the water tray 780. Cleaning the water tray 780 may prevent mold or bacteria from building up on the water tray 780 or at any other locations of the air cooler 700.

Figure 33A:
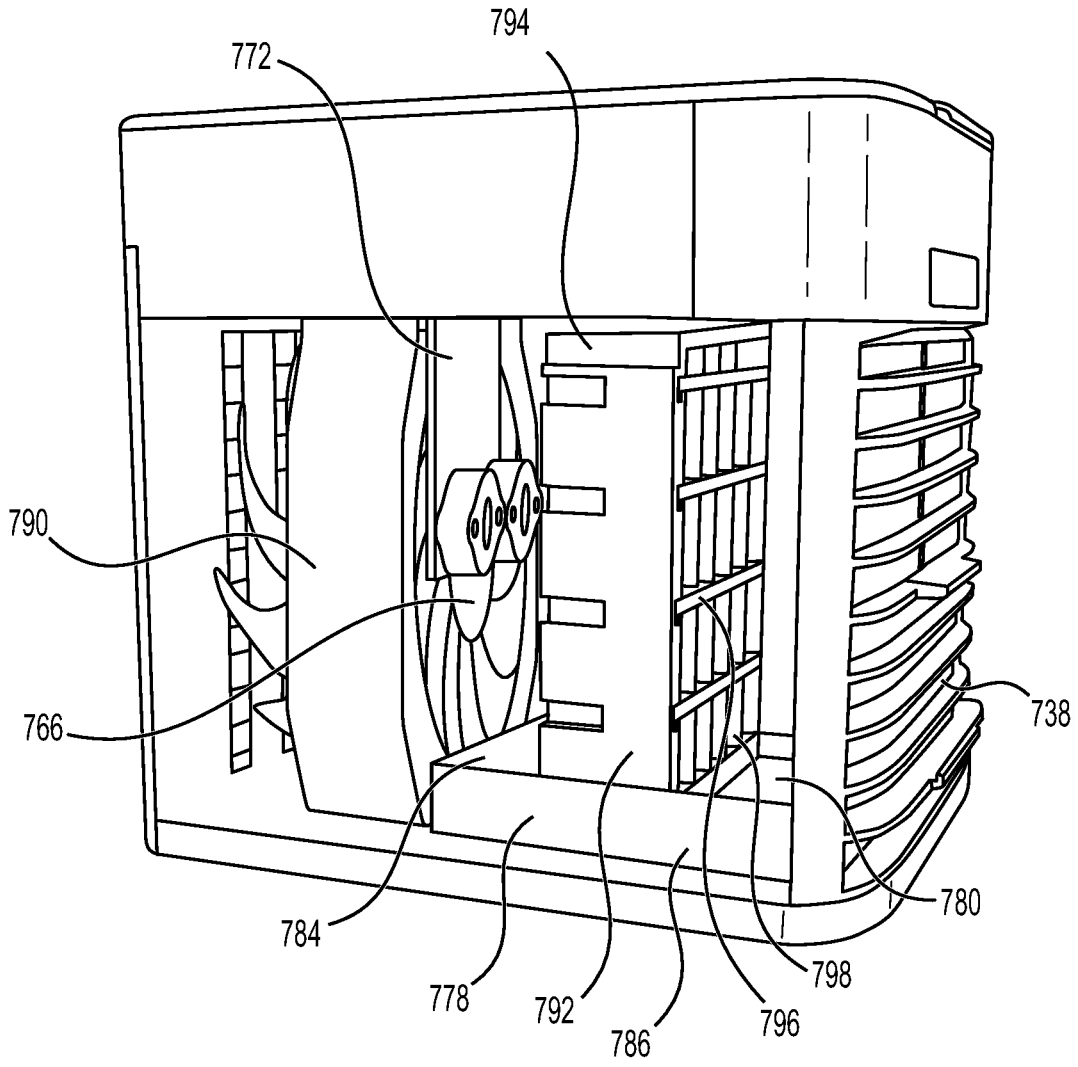
FIG. 33A generally illustrates a perspective side view of an interior of the evaporative air cooler as illustrated in FIG. 27 with a filter structure disposed within the housing of the evaporative air cooler.

FIG. 33A generally illustrates a perspective side view of an interior of the evaporative air cooler 700 as illustrated in FIG. 27 with a filter structure disposed within the housing of the evaporative air cooler. The filter structure 792 may be the filter structure 56 as illustrated in FIGS. 6A to 6C. The filter structure 792 may include a filter frame 794, a plurality of filter holders 796 attached to opposing sides of the filter frame 794, and a plurality of filters 798 mounted vertically within the filter frame 794. As described herein, the filter structure 792 may be removably attached to the drawer 778. The drawer 778 may include a drawer notch 782 (see FIG. 31) to secure the filter structure 792 in place. For example, the filter structure 792 may be placed on a top surface of the water tray 780 and between the outlet vent 738 and the drawer notch 782. The water tray 780 may be disposed in the drawer 778 or may be integrated with the drawer 778. In some embodiments, the water tray 780 may be angled such that when the filter structure 792 is placed on the top surface of the water tray 780, any water on the water tray 780 may flow in a direction toward the filter structure 792. For example, the water tray 780 may be higher toward a back end 784 of the drawer 778 than toward a front end 786 of the drawer 778. As such, the filter structure 792 may absorb at least some of the excess water on the water tray 780. Alternatively, the user may empty the excess water on the water tray 780.

In some embodiments, when the filter structure 792 is disposed within the housing 702 of the air cooler 700, a holder 748 supporting an ice pack 750 may be attached to the back face 752 of the housing 702, as illustrated in FIG. 27. When the air cooler 700 is in operation, air from outside the air cooler 700 may be cooled down by the ice pack 750 as it enters the air cooler 700, thereby providing an enhanced cooling effect to the user.

Figure 33B:
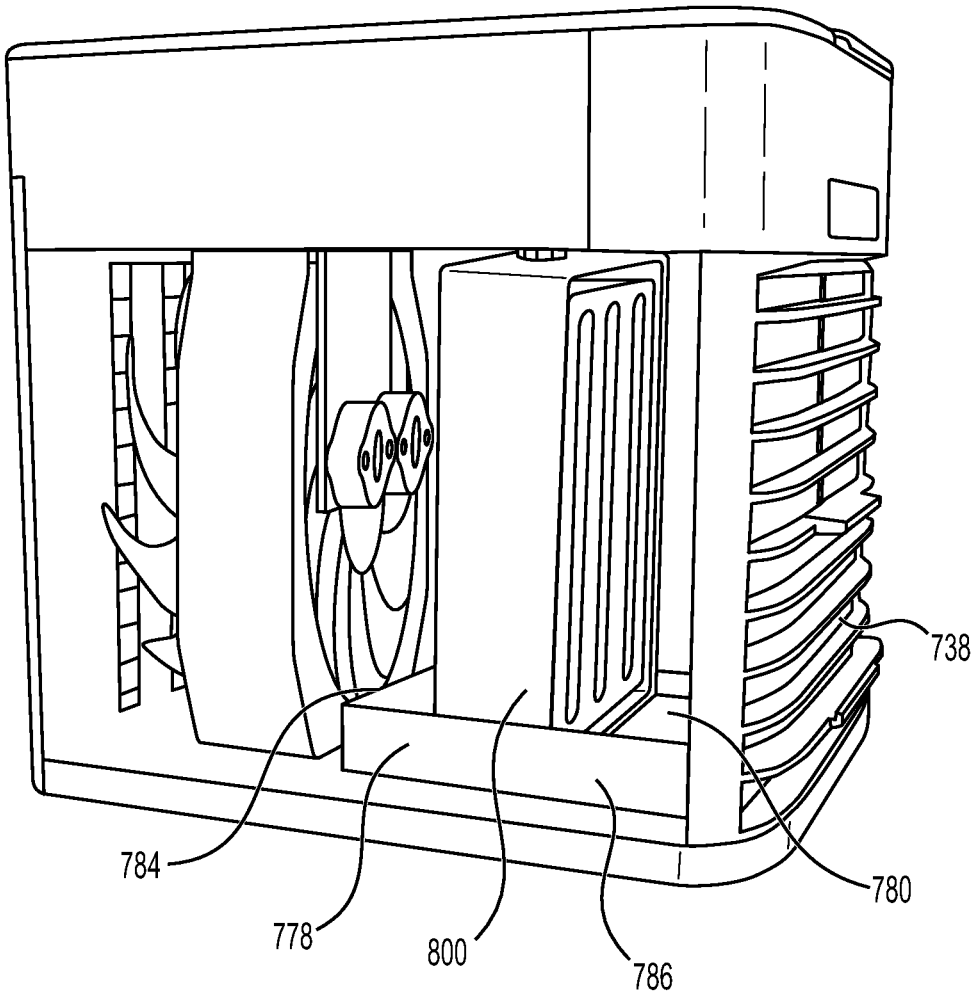
FIG. 33B generally illustrates a perspective side view of an interior of the evaporative air cooler as illustrated in FIG. 27 with an ice pack disposed within the housing of the evaporative air cooler.

FIG. 33B generally illustrates a perspective side view of an interior of the evaporative air cooler 700 as illustrated in FIG. 27 with an ice pack disposed within the housing of the evaporative air cooler. As described herein, the ice pack 800 may be removably attached to the drawer 778. The drawer 778 may include a drawer notch 782 (see FIG. 31) to secure the ice pack 800 in place. For example, the ice pack 800 may be placed on a top surface of the water tray 780 and between the outlet vent 738 and the drawer notch 782. The water tray 780 may be disposed in the drawer 778 or may be integrated with the drawer 778. In some embodiments, the water tray 780 may be angled such that when the ice pack 800 is placed on the top surface of the water tray 780, any water on the water tray 780 may flow in a direction toward the ice pack 800. For example, the water tray 780 may be higher toward a back end 784 of the drawer 778 than toward a front end 786 of the drawer 778. The excess water may remain on the water tray 780 until it evaporates or dries out. Alternatively, the user may empty the excess water on the water tray 780.

In some embodiments, when the ice pack 800 is disposed within the housing 702 of the air cooler 700, a filter structure (e.g., the filter structure 792) may not be disposed within the housing 702 of the air cooler 700. In some other embodiments, when the ice pack 800 is disposed within the housing 702 of the air cooler 700, a filer structure (e.g., the filter structure 792) may further be disposed within the housing 702 of the air cooler 700. For example, the filter structure may also be supported on the top surface of the water tray 780, and may be positioned either between the outlet vent 738 and the ice pack 800 or between the ice pack 800 and the lower portion 772 of the water tank 714 of the air cooler 700. In yet some other embodiments, when the ice pack 800 (e.g., a first ice pack) is disposed within the housing 702 of the air cooler 700, another ice pack (e.g., a second ice pack) may further be attached to the back face 752 of the housing 702 via a holder 748 receiving and supporting the another ice pack therein, as described herein.

Figure 34:
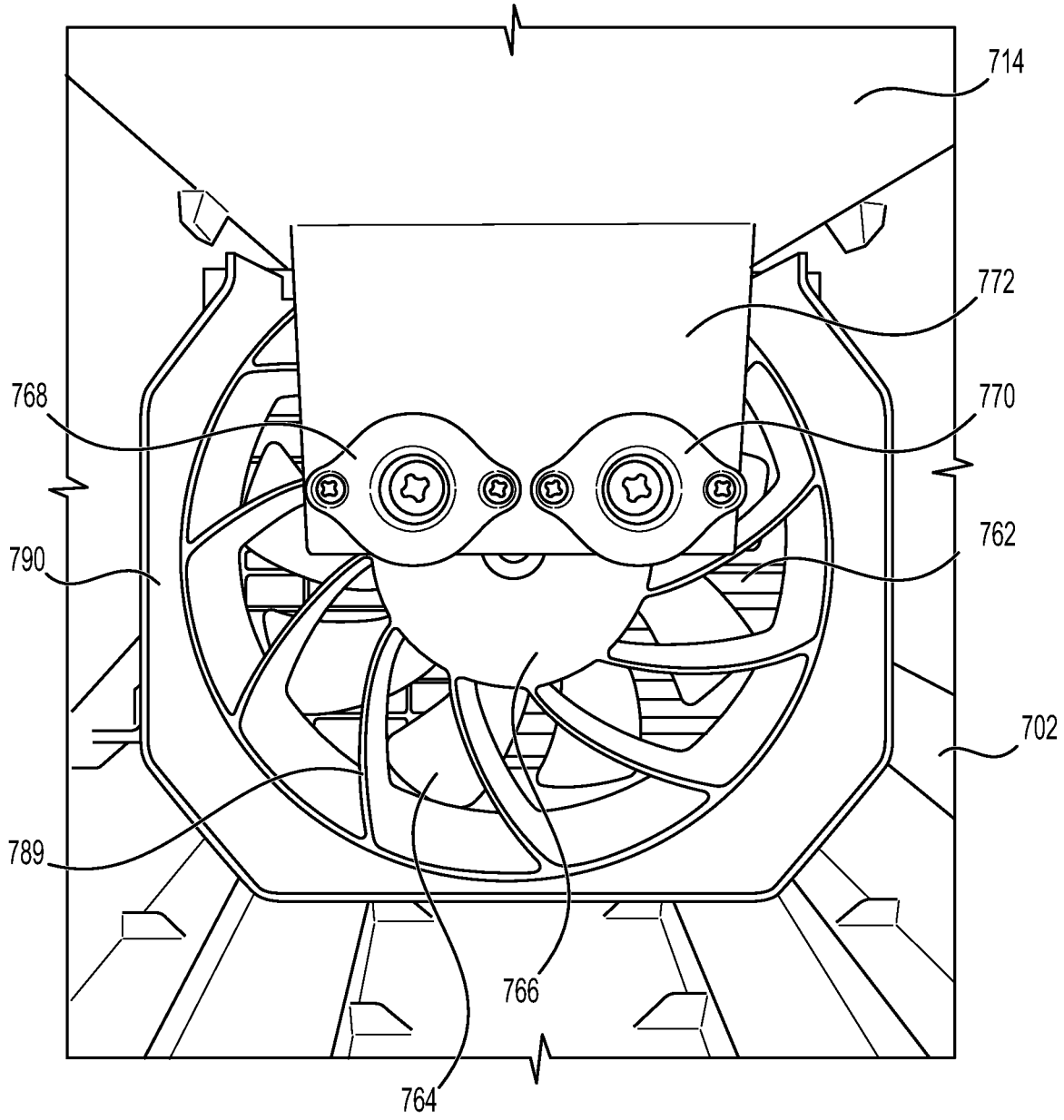
FIG. 34 generally illustrates a front view of an interior of the evaporative air cooler as illustrated in FIG. 27.

FIG. 34 generally illustrates a front view of an interior of the evaporative air cooler 700 as illustrated in FIG. 27. As shown in FIG. 34, the air cooler 700 may include a fan 762 disposed within the housing 702 thereof. The fan 762 may include a fan hub and a plurality of fan blades 764 centrally attached to the fan hub. The plurality of fan blades 764 may be generally straight or curved in shape or any other desired shape. The plurality of fan blades 764 may rotate around the fan hub when the air cooler 700 is in operation. The air cooler 700 may further include a fan shroud 790 circumferentially surrounding the fan 762. The fan shroud 790 may be a plastic ring circumferentially surrounding the fan 762 so as to funnel an air flow from the fan 762 when the air cooler 700 is in operation. The fan 762 may further include a fan grill 789 covering the fan 762.

The air cooler 700 may further include a ring plate 766 disposed within the housing 702 thereof. The ring plate 766 may be disposed between the fan 762 and the lower portion 772 of the water tank 714. In some embodiments, the ring plate 766 may be at least partially attached to the fan grill 789 of the fan 762. The ring plate 766 may be configured to concentrate and/or direct the air flow from the fan 762 to the center of the fan 762, and thus to the center of the air cooler 700, when the air cooler 700 is in operation. The incorporation of the ring plate 766 into the air cooler 700 may enhance an air intensity of the air flow from the fan 762, thereby creating an efficient, direct, and strong stream of an air flow when the air cooler 700 is in operation.

The air cooler 700 may also include a first mister 768 at least partially attached to the lower portion 772 of the water tank 714. For example, the first mister 768 may be at least partially attached to a first location on the lower portion 772 of the water tank 714. The first mister 768 may be configured to dispense (or spray) mist using the water in the water tank 714. The air cooler 700 may further include a second mister 770 at least partially attached to the lower portion 772 of the water tank 714. For example, the second mister 770 may be at least partially attached to a second location on the lower portion 772 of the water tank 714. The first and second locations are different. In some embodiments, the first and second locations are symmetrical on the lower portion 772 of the water tank 714, or in any other desired configuration. The second mister 770 may be configured to dispense (or spray) mist using the water in the water tank 714.

Figure 35:
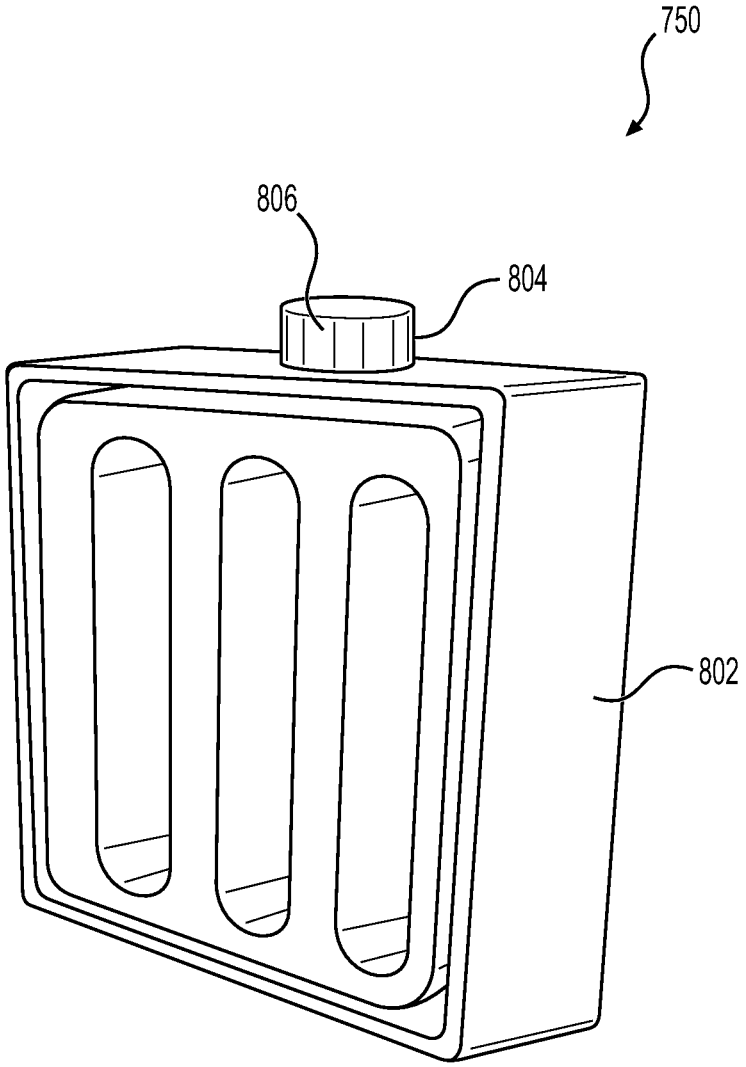
FIG. 35 generally illustrates a perspective view of the ice pack in accordance with aspects of the present disclosure.

FIG. 35 generally illustrates a perspective view of the ice pack in accordance with aspects of the present disclosure. The ice pack 750 may include a body 802 and an opening 804 positioned on a portion of the body 802. The user may add water into the body 802 through the opening 804 of the ice pack 750. The ice pack 750 may further include a cap 806 configured for sealing or unsealing the opening 804. For example, the cap 806 may be screwed on or off the opening 804, or by any other desired attaching mechanism. The ice pack 750 may include a shape and size so as to be received by the holder 748 as described herein. It is contemplated that the ice pack 750 may be in any other desired configuration.

Figure 36:
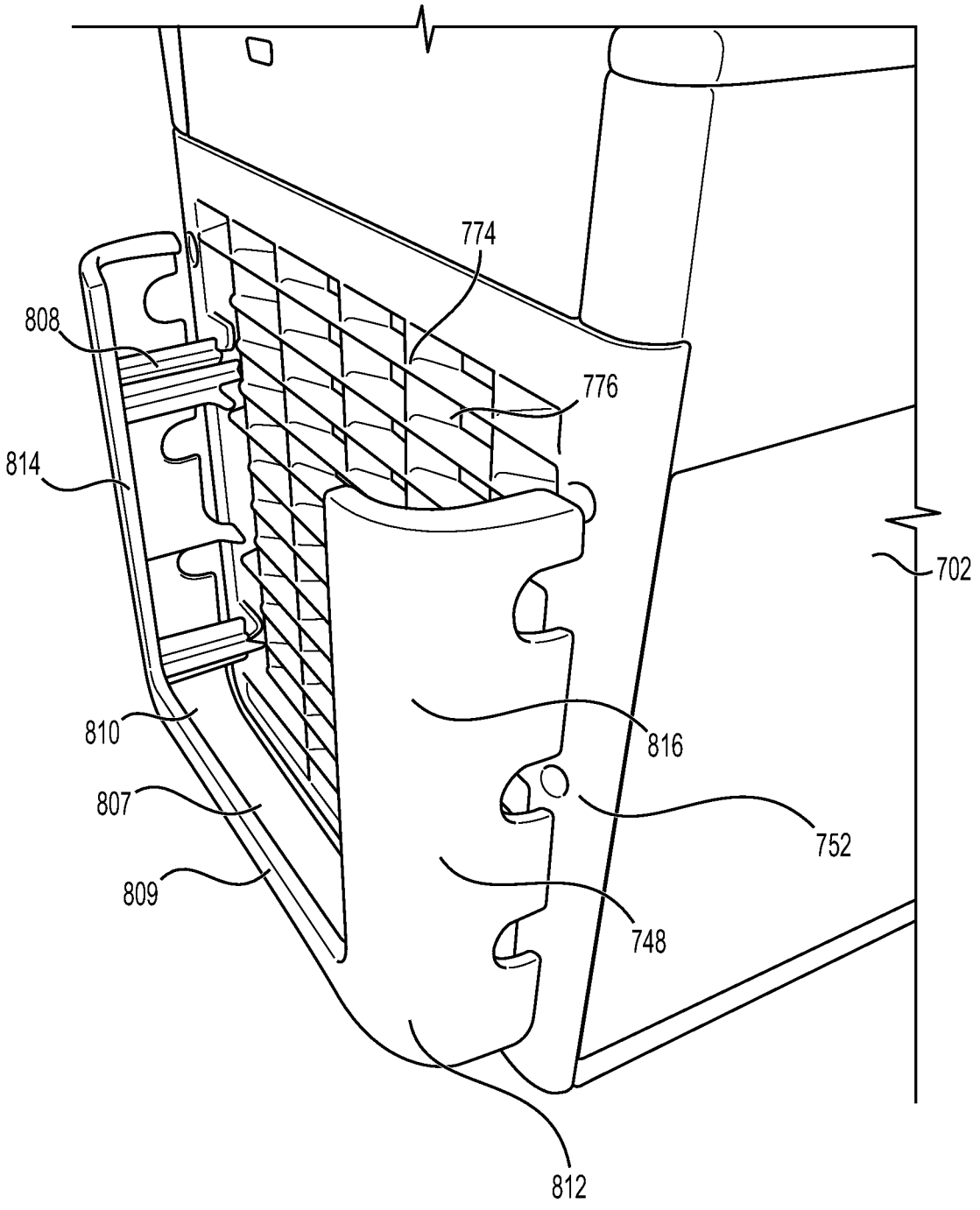
FIG. 36 generally illustrates a perspective rear view of the evaporative air cooler as illustrated in FIG. 27 without an ice pack received and supported in the holder attached thereto.

FIG. 36 generally illustrates a perspective rear view of the evaporative air cooler 700 as illustrated in FIG. 27 without an ice pack received and supported in the holder attached thereto. The holder 748 may be removably attached to the back face 752 of the housing 702 of the air cooler 700. The holder 748 may include a shape and a size to receive and support an ice pack (e.g., the ice pack 750) therein. Referring to FIG. 36, the holder 748 may include a body 807 and a plurality of arms 808 extending from the body 807 and configured for attaching the holder 748 to the air cooler 700. Particularly, the body 807 may include a base 809 having a first end portion 810 and a second end portion 812 opposing to the first end portion 810. The body 807 may further include a first bracket 814 extending upwardly from the first end portion 810 of the base 809. The first bracket 814 may be configured for receiving and supporting at least a portion of an article (e.g., an ice pack) therein. The body 807 may also include a second bracket 816 extending upwardly from the second end portion 812 of the base 809. The second bracket 816 may be configured to receiving and supporting at least another portion of the article therein. The holder 748 may further include a plurality of arms 808 extending from the first and second brackets 814 and 816 of the body 807 thereof. The plurality of arms 808 may be configured for attaching the holder 748 to the air cooler 700, for example, to the back face 752 of the housing 702 of the air cooler 700. In some embodiments, the plurality of arms 808 may be inserted into one or more grate openings 776 defined by the plurality of ribs 774 of the grate 760 on the back face 752 of the housing 702. In some other embodiments, the plurality of arms 808 may snap onto one or more ribs 774 of the grate 760 on the back face 752 of the housing 702. It is contemplated that the plurality of arms 808 may be configured for attaching the holder 748 to the air cooler 700 through any other desired attaching mechanism. It is further contemplated that the holder 748 may be in any other desired configuration.

Consistent with the above disclosure, the examples of systems and method enumerated in the following clauses are specifically contemplated and are intended as a non-limiting set of examples.

Clause 1. An evaporative air cooler for cooling ambient air, comprising:

- a housing with a top panel, a bottom panel, and side panels defining an interior of the evaporative air cooler;
- a tank positioned adjacent the top panel and at least one of the side panels, wherein the tank is configured to receive, store, and release liquid;
- a misting structure comprising a mister and a misting structure coupling, wherein the misting structure is configured to create a mist within the evaporative air cooler;
- a filter structure with a plurality of filters, wherein the plurality of filters are configured to absorb the mist; and
- a fan configured to draw the ambient air into the evaporative air cooler, wherein the ambient air is cooled by at least one of the mist and the filter structure, and wherein the fan directs the ambient air thorough the filter structure and from the interior.

Clause 2. The evaporative air cooler of any preceding clause, wherein the plurality of filters are formed from a sponge material and positioned to define gaps between the plurality of filters.

Clause 3. The evaporative air cooler of any preceding clause, wherein the filter structure is positioned in a drawer; and wherein the drawer is removable from the evaporative air cooler.

Clause 4. The evaporative air cooler of any preceding clause, further comprising a front grill with a tab for pulling the drawer from the evaporative air cooler.

Clause 5. The evaporative air cooler of any preceding clause, wherein the plurality of filters are removable from the evaporative air cooler and configured to be soaked with liquid prior to entering the evaporative air cooler.

Clause 6. The evaporative air cooler of any preceding clause, wherein the plurality of filters are aligned parallel to each other and define air gaps between the plurality of filters; and wherein the ambient air is cooled before exiting the evaporative air cooler.

Clause 7. The evaporative air cooler of any preceding clause, wherein the misting structure distributes the mist into the ambient air and onto the plurality of filters.

Clause 8. The evaporative air cooler of any preceding clause, wherein the tank comprises a liquid inlet and a liquid outlet;

wherein liquid enters the tank through the liquid inlet and exits the tank through the liquid outlet;

wherein the misting structure is in liquid communication with the tank and configured to create a mist as the liquid flows through the liquid outlet; and wherein the mister is positioned within the tank wherein the liquid flows from the tank toward the mister.

Clause 9. The evaporative air cooler of any preceding clause, wherein the misting structure creates a first volume of mist when the fan is at a first speed; and wherein the misting structure creates a second volume of mist when the fan is at a second speed.

Clause 10. The evaporative air cooler of any preceding clause, wherein the first volume is larger than the second volume; and wherein the first speed is faster than the second speed.

Clause 11. The evaporative air cooler of any preceding clause, further comprising:

an internal assembly configured to form a seal with the fan, wherein the seal causes the ambient air to exit the evaporative air cooler with a greater force than when entering the evaporative air cooler.

Clause 12. The evaporative air cooler of any preceding clause, wherein the internal assembly comprises the filter structure and a drawer.

Clause 13. The evaporative air cooler of any preceding clause, wherein the filter structure is configured for removal from the interior; and wherein the filter structure and the plurality of filters are washable and reusable.

Clause 14. The evaporative air cooler of any preceding clause, wherein the plurality of filters are formed from sponge-like material.

Clause 15. The evaporative air cooler of any preceding clause, further comprising: a shroud adjacent to an underside of the tank, wherein the shroud is v-shaped.

Clause 16. An evaporative air cooler for cooling ambient air, comprising:

a housing with a top panel, a bottom panel, and side panels defining an interior of the evaporative air cooler;

a tank positioned adjacent to the top panel and at least one of the side panels and configured to receive, store, and release liquid;

a misting structure comprising a mister and a misting structure coupling, wherein the misting structure is in fluid communication with the tank, and wherein the misting structure is configured to create a mist within the evaporative air cooler;

a filter structure with a plurality of filters, wherein the plurality of filters are configured to absorb the mist, and wherein the filter structure is adjacent to the bottom panel and at least one of the side panels;

a fan configured to draw the ambient air into the evaporative air cooler, wherein the ambient air is cooled by at least one of the mist and the filter structure, and wherein the fan directs the ambient air through the filter structure and from the interior; and a v-shaped shroud positioned underneath the tank and configured to direct the mist toward the filter structure.

Clause 17. The evaporative air cooler of any preceding clause, further comprising:

a fan cover adjacent to the fan and configured to direct air from outside the evaporative air cooler toward the v-shaped shroud, wherein the fan is positioned adjacent to at least one of the side panels.

Clause 18. The evaporative air cooler of any preceding clause, wherein the v-shaped shroud directs the mist toward a top portion of the filter structure and through the filter structure.

Clause 19. The evaporative air cooler of any preceding clause, wherein the filter structure comprises a plurality of filters aligned parallel to each other and defining air gaps;

wherein the plurality of filters stores the mist; and wherein air is cooled by the mist, travels through the air gaps, and exits the evaporative air cooler through one of the side panels.

Clause 20. The evaporative air cooler of any preceding clause, further comprising:

an internal assembly attached to one of the side panels, wherein the one of the side panels is configured to detach from the evaporative air cooler;

wherein the internal assembly comprises a drawer attached to the one of the side panels;

wherein the drawer includes a water tray angled toward the one of the side panels; and wherein the filter structure is positioned on the water tray, and the filter structure is positioned adjacent to the one of the side panels.

Clause 21. An evaporative air cooler for cooling air, comprising:

a housing defining an interior of the evaporative air cooler;

a tank positioned adjacent to a top portion of the housing, wherein the tank is configured to receive, store, and release liquid;

a mister in fluid communication with the tank, wherein the mister is configured to create a mist from the liquid;

a filter structure with a filter, wherein the filter is configured to absorb the mist;

a fan configured to draw the air into the interior, wherein the air is cooled by at least one of the mist and the filter, and wherein the fan directs the air through the filter structure and from the interior; and a clip coupled to the housing.

Clause 22. The evaporative air cooler of any preceding clause, wherein the filter is formed from a sponge material.

Clause 23. The evaporative air cooler of any preceding clause, wherein the filter is configured in a zig-zag formation and defines air gaps.

Clause 24. The evaporative air cooler of any preceding clause, further comprising a second filter coupled to at least a portion of a perimeter of the filter structure, wherein the second filter is configured to absorb the mist.

Clause 25. The evaporative air cooler of any preceding clause, wherein the second filter is in fluid communication with the filter.

Clause 26. The evaporative air cooler of any preceding clause, wherein the filter structure is configured for removal from the interior;

wherein the filter structure and the filter are washable and reusable; and wherein the filter is configured to store liquid.

Clause 27. The evaporative air cooler of any preceding clause, further comprising an angling member coupled to the housing, wherein the angling member is configured to rotate the housing.

Clause 28. The evaporative air cooler of any preceding clause, wherein the angling member is configured to rotate the housing in at least one of a vertical direction and a horizontal direction.

Clause 29. The evaporative air cooler of any preceding clause, wherein the angling member is configured to rotate the housing 360 degrees.

Clause 30. The evaporative air cooler of any preceding clause, wherein the clip is coupled to the angling member.

Clause 31. The evaporative air cooler of any preceding clause, wherein the clip is configured to removably couple the evaporative air cooler to an object.

Clause 32. The evaporative air cooler of any preceding clause, further comprising a grill configured to removably couple to the housing.

Clause 33. The evaporative air cooler of any preceding clause, further comprising a safety interlock configured to prevent operation of the evaporative air cooler if at least one of the grill and the filter structure is removed from the housing.

Clause 34. The evaporative air cooler of any preceding clause, wherein the tank comprises a liquid inlet and a liquid outlet;

wherein liquid enters the tank through the liquid inlet and exits the tank through the liquid outlet; and wherein, in response to the liquid flowing through the liquid outlet, the mister is configured to create the mist.

Clause 35. The evaporative air cooler of any preceding clause, further comprising:

a fan cover adjacent to the fan, wherein the fan cover is configured to direct the air from the fan toward the filter structure.

Clause 36. An evaporative air cooler for cooling air, comprising:

a housing defining an interior of the evaporative air cooler;

a tank positioned adjacent to a top portion of the housing, wherein the tank is configured to receive, store, and release liquid;

a mister in fluid communication with the tank, wherein the mister is configured to create a mist from the liquid;

a filter structure with a filter, wherein the filter is configured to absorb the mist;

a fan configured to draw the air into the interior, wherein the air is cooled by at least one of the mist and the filter, and wherein the fan directs the air through the filter structure and from the interior;

an angling member coupled to the housing, wherein the angling member is configured to rotate the housing; and a clip coupled to the angling member.

Clause 37. The evaporative air cooler of any preceding clause, wherein the angling member is configured to rotate the housing in at least one of a vertical direction and a horizontal direction.

Clause 38. The evaporative air cooler of any preceding clause, wherein the clip is configured to removably couple the evaporative air cooler to an object.

Clause 39. An evaporative air cooler for cooling air, comprising:

a housing defining an interior of the evaporative air cooler;

a tank positioned adjacent to a top portion of the housing, wherein the tank is configured to receive, store, and release liquid;

a mister in fluid communication with the tank, wherein the mister is configured to create a mist from the liquid;

a filter structure with a filter and a second filter, wherein the filter and the second filter are configured to absorb the mist;

a fan configured to draw the air into the interior, wherein the air is cooled by at least one of the mist, the filter, and the second filter, and wherein the fan directs the air through the filter structure and from the interior; and a clip coupled to the housing.

Clause 40. The evaporative air cooler of any preceding clause, wherein the filter is configured in a zig-zag formation and defines air gaps;

wherein the second filter is coupled to at least a portion of a perimeter of the filter structure; and wherein the second filter is in fluid communication with the filter.

Clause 41. An evaporative air cooling tower, comprising:

a housing defining an interior of the evaporative air cooling tower;

a grill coupled to the housing and defining openings;

a tank positioned adjacent to a bottom portion of the housing, wherein the tank is configured to receive and store liquid;

a tray positioned adjacent to a top portion of the housing, wherein the tray is configured to receive and release the liquid;

a hose in fluid communication with the tank and the tray;

a pump configured to pump the liquid from the tank to the tray through the hose;

a filter structure comprising a filter configured to receive the liquid from the tray; and a fan configured to draw air into the interior, wherein the air is cooled by the filter and directed out of the interior through the openings.

Clause 42. The evaporative air cooler of any preceding clause, wherein the filter structure further comprises filter holders configured to receive and secure the filter.

Clause 43. The evaporative air cooler of any preceding clause, wherein the filter holders are positioned between two sides of the filter structure, and wherein the filter holders define slits for receiving the filter, the slits being positioned between 5-85 degrees relative to at least one of the two sides.

Clause 44. The evaporative air cooler of any preceding clause, wherein the filter structure is coupled to a filter tray configured to receive the liquid from the tray and defining filter tray openings configured for the liquid to flow through and onto the filter.

Clause 45. The evaporative air cooler of any preceding clause, wherein the filter structure further comprises a second filter in fluid communication with the filter and the filter tray.

Clause 46. The evaporative air cooler of any preceding clause, wherein at least one of the filter and the second filter is formed from a sponge material.

Clause 47. The evaporative air cooler of any preceding clause, wherein the tray comprises an outlet configured to release the liquid from the tray toward the filter tray.

Clause 48. The evaporative air cooler of any preceding clause, wherein the housing is formed in a tower shape.

Clause 48. The evaporative air cooler of any preceding clause, further comprising a motor operatively coupled to the housing, wherein the motor is configured to rotate the housing.

Clause 50. The evaporative air cooler of any preceding clause, wherein the motor is configured to oscillate the housing.

Clause 51. The evaporative air cooler of any preceding clause, wherein the fan is configured to rotate 360 degrees.

Clause 52. The evaporative air cooler of any preceding clause, wherein the grill is configured to removably couple to the housing;

wherein the filter structure is configured for removal from the interior;

wherein the filter structure and the filter are washable and reusable; and wherein the filter is configured to store the liquid.

Clause 53. The evaporative air cooler of any preceding clause, further comprising a safety interlock configured to prevent operation of the evaporative air cooling tower if at least one of the grill and the filter structure is removed from the housing.

Clause 54. An evaporative air cooling tower, comprising:

a housing defining an interior of the evaporative air cooling tower;

a grill removably coupled to the housing and defining openings;

a tank positioned adjacent to a bottom portion of the housing, wherein the tank is configured to receive and store liquid;

a tray comprising an outlet, the tray being positioned adjacent to a top portion of the housing, wherein the tray is configured to receive the liquid from the tank and release the liquid through the outlet;

a hose in fluid communication with the tank and the tray;

a pump configured to pump the liquid from the tank to the tray through the hose;

a filter structure comprising a filter and a filter tray, the filter tray configured to receive the liquid from the tray and defining filter tray openings configured for the liquid to flow through and onto the filter;

a fan configured to draw air into the interior, wherein the air is cooled by the filter and directed out of the interior through the openings; and a motor coupled to the housing, wherein the motor is configured to rotate the housing.

Clause 55. The evaporative air cooler of any preceding clause, wherein the filter structure further comprises filter holders configured to receive and secure the filter;

wherein the filter holders are positioned between two sides of the filter structure; and wherein the filter holders define slits for receiving the filter, the slits being positioned between 5-85 degrees relative to at least one of the two sides.

Clause 56. The evaporative air cooler of any preceding clause, wherein the filter structure further comprises a second filter in fluid communication with the filter and the filter tray, wherein at least one of the filter and the second filter is formed from a sponge material.

Clause 57. The evaporative air cooler of any preceding clause, wherein the housing is formed in a tower shape.

Clause 58. The evaporative air cooler of any preceding clause, wherein the filter structure is configured for removal from the interior;

wherein the filter structure and the filter are washable and reusable; and wherein the filter is configured to store the liquid.

Clause 59. An evaporative air cooling tower, comprising:

a housing defining an interior of the evaporative air cooling tower, wherein the housing is formed in a tower shape;

a grill removably coupled to the housing and defining openings;

a tank positioned adjacent to a bottom portion of the housing, wherein the tank is configured to receive and store liquid;

a tray comprising an outlet, the tray being positioned adjacent to a top portion of the housing, wherein the tray is configured to receive the liquid and release the liquid through the outlet;

a hose in fluid communication with the tank and the tray;

a pump configured to pump the liquid from the tank to the tray through the hose;

a filter structure comprising a filter tray and a filter, wherein the filter tray defines filter tray openings and is configured to receive the liquid from the tray and direct the liquid to through the filter tray openings to the filter, wherein the filter is formed from a sponge material;

a fan configured to draw air into the interior, wherein the air is cooled by the filter and directed out of the interior through the openings, wherein the fan is configured to rotate; and a motor coupled to the housing, wherein the motor is configured to oscillate the housing.

Clause 60. The evaporative air cooler of any preceding clause, the filter structure further comprising:

a second filter in fluid communication with the filter and the filter tray, wherein the filter is configured to receive the liquid from the filter tray and distribute the liquid to the filter;

two sides substantially parallel to each other; and filter holders coupled the two sides and defining slits for receiving the filter; wherein the slits are positioned between 5-85 degrees relative to at least one of the two sides.

Clause 61. An evaporative air cooler, comprising:

a housing comprising a top panel and defining an interior of the evaporative air cooler;

a tank positioned at least partially adjacent to the top panel, wherein the tank is configured to receive, store, and release liquid;

a filter structure comprising a filter, wherein the filter is configured to absorb the liquid; and a fan configured to draw air into the interior and direct the air through the filter structure and out of the interior.

Clause 62. The evaporative air cooler of any preceding clause, wherein the housing further comprises:

a side panel, wherein the tank is positioned at least partially adjacent to the side panel.

Clause 63. The evaporative air cooler of any preceding clause, wherein the air drawn into the interior is cooled at least by the liquid absorbed by the filter.

Clause 64. The evaporative air cooler of any preceding clause, further comprising:

a water tray formed adjacent to a bottom of the housing, wherein the water tray is configured to store at least a portion of the liquid.

Clause 65. The evaporative air cooler of any preceding clause, wherein the liquid is absorbed by the filter at a first end of the filter.

Clause 66. The evaporative air cooler of any preceding clause, wherein the first end of the filter is adjacent to and in fluid communication with a water tray.

Clause 67. The evaporative air cooler of any preceding clause, wherein the liquid is absorbed by the filter at a second end of the filter.

Clause 68. The evaporative air cooler of any preceding clause, wherein the second end of the filter is adjacent to and in fluid communication with the tank.

Clause 69. The evaporative air cooler of any preceding clause, wherein the filter structure comprises a plurality of filters defining air gaps.

Clause 70. The evaporative air cooler of any preceding clause, wherein the filter structure is configured for removal from the interior.

Clause 71. The evaporative air cooler of any preceding clause, further comprising:

a shroud configured to distribute the liquid toward the filter structure.

Clause 72. The evaporative air cooler of any preceding clause, wherein the fan is configured to draw the air into the interior through a grate and direct the air from the interior through a front grill.

Clause 73. An evaporative air cooler, comprising:

a housing comprising a top panel and a side panel, wherein the housing defines an interior of the evaporative air cooler;

a tank positioned at least partially adjacent to the top and side panels, wherein the tank is configured to receive, store, and release liquid;

a filter structure comprising a plurality of filters, wherein the plurality of filters are configured to absorb the liquid; and a fan configured to draw air into the interior, direct the air through the filter structure to be cooled by the liquid absorbed by the plurality of filters, and direct the cooled air out of the interior.

Clause 74. The evaporative air cooler of any preceding clause, further comprising:

a water tray formed adjacent to a bottom of the housing, wherein the water tray is configured to store at least a portion of the liquid.

Clause 75. The evaporative air cooler of any preceding clause, wherein the liquid is absorbed by the plurality of filters at a first end of the plurality of filters.

Clause 76. The evaporative air cooler of any preceding clause, wherein the first end of the plurality of filters is adjacent to and in fluid communication with a water tray.

Clause 77. The evaporative air cooler of any preceding clause, wherein the liquid is absorbed by the plurality of filters at a second end of the plurality of filters.

Clause 78. The evaporative air cooler of any preceding clause, wherein the second end of the plurality of filters is adjacent to and in fluid communication with the tank.

Clause 79. The evaporative air cooler of any preceding clause, wherein the filter structure is configured for removal from the interior.

Clause 80. The evaporative air cooler of any preceding clause, wherein the fan is configured to draw the air into the interior through a grate and direct the cooled air from the interior through a front grill.

Clause 81. An evaporative air cooler, comprising:

a housing comprising a top panel, wherein the housing defines an interior of the evaporative air cooler;

a tank positioned at least partially adjacent the top panel, wherein the tank is configured to receive, store, and release liquid;

a filter structure comprising a filter, wherein the filter is configured to absorb the liquid; and a fan configured to draw air into the interior and direct the air through the filter structure and out of the interior.

Clause 82. The evaporative air cooler of any preceding clause, wherein the housing further comprises:

a side panel, wherein the tank is positioned at least partially adjacent the side panel.

Clause 83. The evaporative air cooler of any preceding clause, wherein the air drawn into the interior is cooled at least by the liquid absorbed by the filter.

Clause 84. The evaporative air cooler of any preceding clause, further comprising:

a water tray formed adjacent a bottom of the housing, wherein the water tray is configured to store at least a portion of the liquid.

Clause 85. The evaporative air cooler of any preceding clause, wherein the liquid is absorbed by the filter at a first end of the filter.

Clause 86. The evaporative air cooler of any preceding clause, wherein the first end of the filter is adjacent and in fluid communication with a water tray.

Clause 87. The evaporative air cooler of any preceding clause, wherein the liquid is absorbed by the filter at a second end of the filter.

Clause 88. The evaporative air cooler of any preceding clause, wherein the second end of the filter is adjacent and in fluid communication with the tank.

Clause 89. The evaporative air cooler of any preceding clause, wherein the filter structure comprises a plurality of filters defining air gaps.

Clause 90. The evaporative air cooler of any preceding clause, wherein the filter structure is configured for removal from the interior.

Clause 91. The evaporative air cooler of any preceding clause, further comprising:

a shroud configured to distribute the liquid toward the filter structure.

Clause 92. The evaporative air cooler of any preceding clause, wherein the fan is configured to draw the air into the interior through a grate and direct the air from the interior through a front grill.

Clause 93. An evaporative air cooler, comprising:

a housing comprising a top panel and a side panel, wherein the housing defines an interior of the evaporative air cooler;

a tank positioned at least partially adjacent the top and side panels, wherein the tank is configured to receive, store, and release liquid;

a filter structure comprising a plurality of filters, wherein the plurality of filters are configured to absorb the liquid; and a fan configured to draw air into the interior, direct the air through the filter structure to be cooled by the liquid absorbed by the plurality of filters, and direct the cooled air out of the interior.

Clause 94. The evaporative air cooler of any preceding clause, further comprising:

a water tray formed adjacent a bottom of the housing, wherein the water tray is configured to store at least a portion of the liquid.

Clause 95. The evaporative air cooler of any preceding clause, wherein the liquid is absorbed by the plurality of filters at a first end of the plurality of filters.

Clause 96. The evaporative air cooler of any preceding clause, wherein the first end of the plurality of filters is adjacent and in fluid communication with a water tray.

Clause 97. The evaporative air cooler of any preceding clause, wherein the liquid is absorbed by the plurality of filters at a second end of the plurality of filters.

Clause 98. The evaporative air cooler of any preceding clause, wherein the second end of the plurality of filters is adjacent and in fluid communication with the tank.

Clause 99. The evaporative air cooler of any preceding clause, wherein the filter structure is configured for removal from the interior.

Clause 100. The evaporative air cooler of any preceding clause, wherein the fan is configured to draw the air into the interior through a grate and direct the cooled air from the interior through a front grill.

Clause 101. An evaporative air cooler, comprising:

a housing including a top portion and a bottom portion coupled to the top portion;

a water tank disposed in the top portion of the housing and configured to store water therein, wherein the water tank includes an upper portion and a lower portion extending from the upper portion;

a fan disposed within the housing;

a holder removably attached to a back face of the housing; and an ice pack at least partially received and supported by the holder, wherein the ice pack is configured for cooling air entering the evaporative air cooler.

Clause 102. The evaporative air cooler of any preceding clause, further comprising:

a ring plate disposed between the fan and the lower portion of the water tank, wherein the ring plate is configured for concentrating and/or directing an air flow from the fan to the center of the fan when the evaporative air cooler is in operation.

Clause 103. The evaporative air cooler of any preceding clause, further comprising:

a first mister at least partially attached to a first location on the lower portion of the water tank and configured to dispense mist using the water in the water tank.

Clause 104. The evaporative air cooler of any preceding clause, further comprising:

a second mister at least partially attached to a second location on the lower portion of the water tank and configured to dispense mist using the water in the water tank, wherein the second location is different from the first location.

Clause 105. The evaporative air cooler of any preceding clause, wherein the ice pack includes a body, an opening positioned on a portion of the body, and a cap configured for sealing or unsealing the opening thereof.

Clause 106. The evaporative air cooler of any preceding clause, wherein the holder includes a body and a plurality of arms extending from the body, wherein the plurality of arms are configured for attaching the holder to the back face of the housing of the evaporative air cooler.

Clause 107. The evaporative air cooler of any preceding clause, further comprising:

a first button disposed on the housing thereof and configured to control the evaporative air cooler to operate in a turbo mode, and a second button disposed on the housing thereof and configured to control the evaporative air cooler to operate in a mist mode.

Clause 108. The evaporative air cooler of any preceding clause, comprising:

a housing including a top portion and a bottom portion coupled to the top portion;

a water tank disposed in the top portion of the housing and configured to store water therein, wherein the water tank includes an upper portion and a lower portion extending from the upper portion;

a fan disposed within the housing;

a filter structure disposed within the housing, wherein the filter structure is disposed between the lower portion of the water tank and a front face of the housing;

a holder removably attached to a back face of the housing; and an ice pack at least partially received and supported by the holder, wherein the ice pack is configured for cooling air entering the evaporation air cooler.

Clause 109. The evaporative air cooler of any preceding clause, further comprising:

a ring plate disposed between the fan and the lower portion of the water tank, wherein the ring plate is configured for concentrating and/or directing an air flow from the fan to the center of the fan when the evaporative air cooler is in operation.

Clause 110. The evaporative air cooler of any preceding clause, further comprising:

a first mister at least partially attached to a first location on the lower portion of the water tank and configured to dispense mist using the water in the water tank.

Clause 111. The evaporative air cooler of any preceding clause, further comprising:

a second mister at least partially attached to a second location on the lower portion of the water tank and configured to dispense mist using the water in the water tank, wherein the second location is different from the first location.

Clause 112. The evaporative air cooler of any preceding clause, wherein the ice pack includes a body, an opening positioned on a portion of the body, and a cap configured for sealing or unsealing the opening thereof.

Clause 113. The evaporative air cooler of any preceding clause, wherein the holder includes a body and a plurality of arms extending from the body, wherein the plurality of arms are configured for attaching the holder to the back face of the housing of the evaporative air cooler.

Clause 114. The evaporative air cooler of any preceding clause, further comprising:

a first button disposed on the housing thereof and configured to control the evaporative air cooler to operate in a turbo mode, and a second button disposed on the housing thereof and configured to control the evaporative air cooler to operate in a mist mode.

Clause 115. An evaporative air cooler, comprising:

a housing including a top portion and a bottom portion coupled to the top portion;

a water tank disposed in the top portion of the housing and configured to store water therein, wherein the water tank includes an upper portion and a lower portion extending from the upper portion;

a fan disposed within the housing; and a first ice pack disposed within the housing, wherein the first ice pack is disposed between the lower portion of the water tank and a front face of the housing.

Clause 116. The evaporative air cooler of any preceding clause, further comprising:

a ring plate disposed between the fan and the lower portion of the water tank, wherein the ring plate is configured for concentrating and/or directing an air flow from the fan to the center of the fan when the evaporative air cooler is in operation.

Clause 117. The evaporative air cooler of any preceding clause, further comprising:

a first mister at least partially attached to a first location on the lower portion of the water tank and configured to dispense mist using the water in the water tank.

Clause 118. The evaporative air cooler of any preceding clause, further comprising:

a second mister at least partially attached to a second location on the lower portion of the water tank and configured to dispense mist using the water in the water tank, wherein the second location is different from the first location.

Clause 119. The evaporative air cooler of any preceding clause, wherein the ice pack includes a body, an opening positioned on a portion of the body, and a cap configured for sealing or unsealing the opening thereof.

Clause 120. The evaporative air cooler of any preceding clause, wherein the holder includes a body and a plurality of arms extending from the body, wherein the plurality of arms are configured for attaching the holder to the back face of the housing of the evaporative air cooler.

No part of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

The foregoing description, for purposes of explanation, use specific nomenclature to provide a thorough understanding of the described embodiments. However, it should be apparent to one skilled in the art that the specific details are not required to practice the described embodiments. Thus, the foregoing descriptions of specific embodiments are presented for purposes of illustration and description. They are not intended to be exhaustive or to limit the described embodiments to the precise forms disclosed. It should be apparent to one of ordinary skill in the art that many modifications and variations are possible in view of the above teachings.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An evaporative air cooler comprising:

a housing including a top portion, a bottom portion coupled to the top portion, a grate on a back face of the housing and comprising one or more ribs that define grate openings;

a water tank disposed in the top portion of the housing and configured to store water therein, wherein the water tank includes an upper portion and a lower portion extending from the upper portion;

a fan disposed within the housing;

a mister configured to receive water from the water tank and dispense mist;

a holder removably attached to a back face of the housing, the holder comprising a plurality of arms that are insertable into the grate openings to removably attach the holder to the housing; and an ice pack at least partially received and supported by the holder, wherein the ice pack is configured for cooling air entering the evaporative air cooler.

2. The evaporative air cooler of claim 1, wherein the evaporative air cooler further comprises a ring plate disposed between the fan and the lower portion of the water tank, wherein the ring plate is configured for concentrating and/or directing an air flow from the fan to the center of the fan when the evaporative air cooler is in operation.

3. The evaporative air cooler of claim 1, wherein the mister is at least partially attached to a first location on the lower portion of the water tank and configured to dispense mist using the water in the water tank.

4. The evaporative air cooler of claim 3, wherein the evaporative air cooler further comprises a second mister at least partially attached to a second location on the lower portion of the water tank and configured to dispense mist using the water in the water tank, wherein the second location is different from the first location.

5. The evaporative air cooler of claim 1, wherein the ice pack includes a body, an opening positioned on a portion of the body, and a cap configured for sealing or unsealing the opening thereof.

6. The evaporative air cooler of claim 1, wherein the holder includes a body and a plurality of arms extending from the body, wherein the plurality of arms are configured for attaching the holder to the back face of the housing of the evaporative air cooler.

7. The evaporative air cooler of claim 1, wherein the evaporative air cooler further comprises a first button disposed on the housing thereof and configured to control the evaporative air cooler to operate in a turbo mode, and a second button disposed on the housing thereof and configured to control the evaporative air cooler to operate in a mist mode.

8. The evaporative air cooler of claim 1, wherein the evaporative air cooler further comprises a holder removably attached to a back face of the housing, and a second ice pack at least partially received and supported by the holder, wherein the second ice pack is configured for cooling air entering the evaporative air cooler.

9. An evaporative air cooler comprising:

a housing including a top portion a bottom portion coupled to the top portion, a grate on a back face of the housing;

a water tank disposed in the top portion of the housing and configured to store water therein, wherein the water tank includes an upper portion and a lower portion extending from the upper portion;

a fan disposed within the housing;

a mister configured to receive water from the water tank and dispense mist;

a filter structure disposed within the housing, wherein the filter structure is disposed between the lower portion of the water tank and a front face of the housing;

a holder removably attached to a back face of the housing; and an ice pack at least partially received and supported by the holder, wherein the ice pack is configured for cooling air entering the evaporation air cooler and comprises one or more openings that permit air to flow through the ice pack and the grate.

10. The evaporative air cooler of claim 9, wherein the evaporative air cooler further comprises a ring plate disposed between the fan and the lower portion of the water tank, wherein the ring plate is configured for concentrating and/or directing an air flow from the fan to the center of the fan when the evaporative air cooler is in operation.

11. The evaporative air cooler of claim 9, wherein the evaporative air cooler further comprises a first mister at least partially attached to a first location on the lower portion of the water tank and configured to dispense mist using the water in the water tank.

12. The evaporative air cooler of claim 11, wherein the evaporative air cooler further comprises a second mister at least partially attached to a second location on the lower portion of the water tank and configured to dispense mist using the water in the water tank, wherein the second location is different from the first location.

13. The evaporative air cooler of claim 9, wherein the ice pack includes a body, an opening positioned on a portion of the body, and a cap configured for sealing or unsealing the opening thereof.

14. The evaporative air cooler of claim 9, wherein the holder includes a body and a plurality of arms extending from the body, wherein the plurality of arms are configured for attaching the holder to the back face of the housing of the evaporative air cooler.

15. The evaporative air cooler of claim 9, wherein the evaporative air cooler further comprises a first button disposed on the housing thereof and configured to control the evaporative air cooler to operate in a turbo mode, and a second button disposed on the housing thereof and configured to control the evaporative air cooler to operate in a mist mode.

16. An evaporative air cooler comprising:

a housing including a top portion a bottom portion coupled to the top portion, a grate on a back face of the housing and comprising one or more ribs that define grate openings;

a water tank disposed in the top portion of the housing and configured to store water therein, wherein the water tank includes an upper portion and a lower portion extending from the upper portion;

a fan disposed within the housing;

a mister configured to receive water from the water tank and dispense mist;

a holder removably attached to a back face of the housing, the holder comprising a plurality of arms that are insertable into the grate openings to removably attach the holder to the housing;

a first ice pack disposed within the housing, wherein the first ice pack is disposed between the lower portion of the water tank and a front face of the housing; and a second ice pack at least partially received and supported by the holder, wherein the second ice pack is configured for cooling air entering the evaporation air cooler and comprises one or more openings that permit air to flow through the ice pack and the grate.

17. The evaporative air cooler of claim 16, wherein the evaporative air cooler further comprises a ring plate disposed between the fan and the lower portion of the water tank, wherein the ring plate is configured for concentrating and/or directing an air flow from the fan to the center of the fan when the evaporative air cooler is in operation.

18. The evaporative air cooler of claim 16, wherein the evaporative air cooler further comprises a first mister at least partially attached to a first location on the lower portion of the water tank and configured to dispense mist using the water in the water tank.

19. The evaporative air cooler of claim 18, wherein the evaporative air cooler further comprises a second mister at least partially attached to a second location on the lower portion of the water tank and configured to dispense mist using the water in the water tank, wherein the second location is different from the first location.

20. The evaporative air cooler of claim 16, wherein the first ice pack includes a body, an opening positioned on a portion of the body, and a cap configured for sealing or unsealing the opening thereof.

* * * * *